US011718925B2

(12) United States Patent
Moriyama et al.

(10) Patent No.: US 11,718,925 B2
(45) Date of Patent: Aug. 8, 2023

(54) HOLDER FOR HOLDING SUBSTRATE AND SYSTEM FOR PLATING

(71) Applicant: EBARA CORPORATION, Tokyo (JP)

(72) Inventors: Shota Moriyama, Tokyo (JP); Matsutaro Miyamoto, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/689,312

(22) Filed: Mar. 8, 2022

(65) Prior Publication Data

US 2022/0186395 A1 Jun. 16, 2022

Related U.S. Application Data

(62) Division of application No. 16/609,884, filed as application No. PCT/JP2018/022391 on Jun. 12, 2018, now Pat. No. 11,299,817.

(30) Foreign Application Priority Data

Jun. 28, 2017 (JP) ..... 2017-126582
Apr. 17, 2018 (JP) ..... 2018-079388

(51) Int. Cl.
*C25D 17/08* (2006.01)
*C25D 21/00* (2006.01)

(52) U.S. Cl.
CPC ..... *C25D 17/08* (2013.01); *C25D 21/00* (2013.01)

(58) Field of Classification Search
None
See application file for complete search history.

(56) References Cited

U.S. PATENT DOCUMENTS

| | | | | |
|---|---|---|---|---|
| 8,236,151 | B1 | 8/2012 | Olson et al. | |
| 2003/0192782 | A1 | 10/2003 | Yamamoto | |
| 2006/0191786 | A1 | 8/2006 | Yamamoto et al. | |
| 2015/0276835 | A1 | 10/2015 | Minami | |
| 2015/0294894 | A1* | 10/2015 | Yoshioka | C25D 17/06 204/297.01 |
| 2017/0058423 | A1 | 3/2017 | Mine et al. | |
| 2017/0321344 | A1 | 11/2017 | Fendel et al. | |

(Continued)

FOREIGN PATENT DOCUMENTS

| | | | |
|---|---|---|---|
| JP | S54-019649 | A | 2/1979 |
| JP | 2000-150421 | A | 5/2000 |
| JP | 2003-301299 | A | 10/2003 |

(Continued)

OTHER PUBLICATIONS

International Patent Application No. PCT/JP2018/022391; Int'l Search Report; dated Aug. 14, 2018; 5 pages.

*Primary Examiner* — Louis J Rufo
(74) *Attorney, Agent, or Firm* — BakerHostetler

(57) ABSTRACT

There is provided a substrate holder for holding a substrate including a first holding member having a first opening portion for exposing a first surface of the substrate, and a second holding member configured to hold the substrate together with the first holding member and having a second opening portion for exposing a second surface of the substrate, wherein the first holding member has at least one first external connection contact, and the second holding member has at least one second external connection contact that is independent of the first external connection contact.

5 Claims, 39 Drawing Sheets

(56) References Cited

U.S. PATENT DOCUMENTS

2020/0199770 A1 6/2020 Moriyama et al.

FOREIGN PATENT DOCUMENTS

| | | | | |
|---|---|---|---|---|
| JP | 2006-233296 | A | | 9/2006 |
| JP | 2008-057024 | A | | 3/2008 |
| JP | 2008-184692 | A | | 8/2008 |
| JP | 2008184692 | A | * | 8/2008 |
| JP | 2008-231539 | A | | 10/2008 |
| JP | 2015-200017 | A | | 11/2015 |
| JP | 2017-043815 | A | | 3/2017 |
| JP | 6952007 | B2 | | 10/2021 |
| TW | 201635426 | A | | 10/2016 |
| WO | WO 2014/076781 | A1 | | 5/2014 |
| WO | WO 2016/190180 | A1 | | 12/2016 |

* cited by examiner

B - B

C - C

HOLDER FOR HOLDING SUBSTRATE AND SYSTEM FOR PLATING

TECHNICAL FIELD

The present invention relates to a holder for holding a substrate and a system for plating.

BACKGROUND ART

Conventionally, wiring and bumps (projecting electrodes) are formed on a surface of a substrate such as a semiconductor wafer or a printed circuit board. An electro plating method is known as a method for forming such wiring and bumps. A plating system for use for the electro plating method includes a substrate holder configured to hold a circular or polygonal substrate with a surface (a surface to be plated) exposed while sealing end faces of the substrate. In applying a plating treatment to the surface of the substrate in such a plating system, the substrate holder holding the substrate is submerged in plating liquid.

PTL 1 describes a substrate jig for use in applying a plating treatment to both surfaces of a substrate. This substrate jig includes a base portion 1, a cover portion 2, and a center portion 3, which are made up of different members, and a substrate is placed in such a state that the center portion 3 is superposed on the base portion 1, the cover portion 2 is superposed further thereon, and the base portion 1, the center portion 3, and the cover portion 2 are held and fixed together from both sides by a clamp portion 4. In supplying an electric current to the substrate, an electric current is supplied from an energizing path of an arm portion 14 provided on the base portion 1, to an energizing ring 6 of the base portion 1 via one energizing rod 34 in the center portion 3 and to an energizing ring 6 of the cover portion 2 via the other energizing rod 34, whereby the electric current is supplied to each surface of the substrate from the energizing rings 6 (FIGS. 3, 6).

PTL 2 describes a substrate jig 70 for use in applying a plating treatment to both surfaces of a substrate, and in this substrate jig 70, a substrate is held between a first holding member 11 including a hanger 14 and a second holding member 12 to be held therebetween. In supplying an electric current to the substrate, an electric current is supplied to both surfaces of the substrate by way of a conductive plate 22 and a conductive film pin 23 within the first holding member 11. The conductive film pin 23 connected to one surface of the substrate is connected with a terminal plate 27 provided on one side of the hanger 14, and the conductive film pin 23 connected to the other surface of the substrate is connected with a terminal plate 28 provided on the other side of the hanger 14 (FIGS. 9, 10).

In addition, a configuration is described in which an upper edge portion of a square or rectangular substrate is held by a first holding member 71 and a second holding member 72, and an electric current is supplied to both surfaces of the substrate from end terminals 78, 79 on both sides of the first holding member 71. In this configuration, an electric current is supplied from one terminal plate 79 of the first holding member 71 to one surface of the substrate by way of an electrode contact 75, and an electric current is supplied from the other terminal plate 78 of the first holding member 71 to the other surface of the substrate by way of an energizing contact 81, and by way of an energizing spring contact 82 of the second holding member 72 and an electrode contact 76 (FIGS. 20, 21).

PTL 3 describes a wafer carrier 100 in which two wafers are superposed one on the other and two surfaces that are exposed to exteriors are plated simultaneously. This wafer carrier 100 includes a non-conductive flange 120 for holding the wafers and a hanger-like conductive flange 110 provided at an upper portion of the flange 120. In this configuration, an electric current is supplied from the conductive flange 110 by way of conductors 426, contacts 427 and a plurality of POGO pins 428 disposed in flange pieces 121, 122 of the non-conductive flange 120 to surfaces of the wafers.

CITATION LIST

Patent Literature

PTL 1: International Publication WO2014-076781
PTL 2: Japanese Patent Application Laid-Open No. 2008-184692
PTL 3: U.S. Pat. No. 8,236,151, Specification

SUMMARY OF INVENTION

Technical Problem

In electro plating, a number of contacts (substrate contacts) suitable for a size of a substrate need to be provided on a substrate jig to supply an electric current to these substrate contact. In addition, there is preferably a case where the substrate contacts are connected through individual separate electric current paths to one or a plurality of external connection contacts, and when the size of a substrate increases, the numbers of contacts and electric current paths tend to increase. However, in case the numbers of contacts and electric current paths increase, there may be caused fears that the thickness of a substrate jig is increased. Although this problem is considered to constitute a serious problem in particular in a substrate jig for use in plating both surface of a substrate, the problem can similarly constitute a serious problem also in plating one surface of a substrate.

An object of the present invention is to solve at least part of the problem described above.

Solution to Problem

One aspect of the present invention relates to a holder for holding a substrate. This holder has a first holding member having a first opening portion for exposing a first surface of the substrate, and a second holding member configured to hold the substrate together with the first holding member and having a second opening portion for exposing a second surface of the substrate, and the first holding member has at least one first external connection contact, and the second holding member has at least one second external connection contact, which is independent of the first external connection contact.

Another aspect of the present invention relates to a system for plating including a holder for holding a substrate, a substrate attaching and detaching unit configured to attach and detach the substrate to and from the holder, and a plating tank configured to apply a plating treatment to the holder holding the substrate. In this system for plating, the holder has a first holding member having a first opening portion for exposing a first surface of the substrate, and a second holding member configured to hold the substrate together with the first holding member and having a second opening portion for exposing a second surface of the substrate, and the first holding member has at least one first external connection contact, and the second holding member has at least one second external connection contact, which is independent of the first external connection contact.

DESCRIPTION OF EMBODIMENTS

Hereinafter, embodiments of a plating system and a substrate holder for use in the plating system according to the present invention will be described by reference to accompanying drawings. In the accompanying drawings, like or similar reference signs will be given to like or similar elements, and in describing the embodiments, repeated descriptions regarding those like or similar elements may be omitted from time to time. Characteristics described in one of the embodiments can be applied to the other embodiments, provided that they do not contradict each other. In this specification, a "substrate" includes not only a semiconductor substrate, a glass substrate, and a printed circuit board but also a magnetic recording medium, a magnetic recording sensor, a mirror, an optical element or a minute mechanical element, or an incomplete partially fabricated integrated circuit. The substrate includes a substrate of any shape (polygonal, circular, or the like). In this specification, although expressions such as "front surface", "rear or back surface", "front", "back", "up", "down", "left", "right", and the like are used, these denote positions on sheets of paper on which illustrated drawings are drawn in the matter of convenience in description, and therefore, those directional expressions may denote different directions in an actual arrangement in use.

Figure 1:
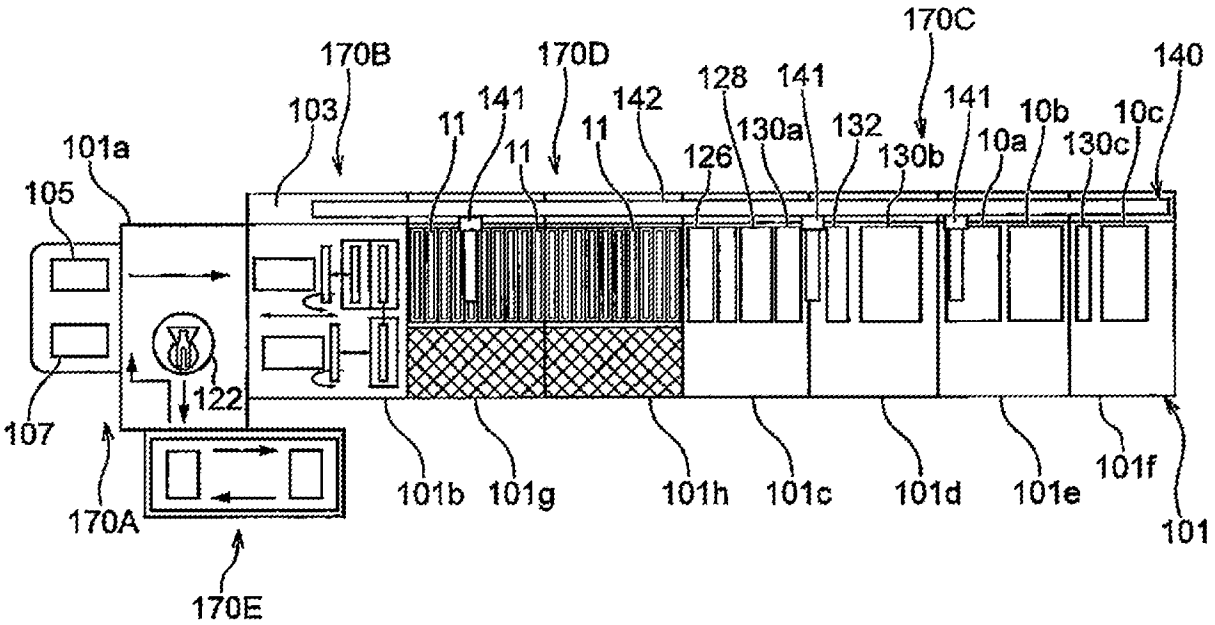
FIG. 1 is a schematic diagram illustrating one embodiment of a plating system.

FIG. 1 is a schematic diagram illustrating one embodiment of a plating system. As shown in FIG. 1, the plating system includes a platform 101, a control unit 103 for controlling the operation of the plating system, a loading/unloading section 170A for loading and unloading a substrate W (refer to FIG. 2), a substrate setting section (a machine compartment, a substrate attaching and detaching compartment) 170B for setting and removing a substrate W to/from a substrate holder 11 (refer to FIG. 2), a processing section (a pre-treatment compartment, a plating compartment) 170C for plating a substrate W, a holder storage section (a stocker compartment) 170D for storing substrate holders 11, and a cleaning section 170E for cleaning and drying a plated substrate W. The plating system according to this embodiment is an electro plating system for plating a first surface and a second surface of a substrate W with metal by causing an electric current to flow to plating liquid. The first surface and the second surface are surfaces that face each other, and in this embodiment, the first surface and the second surface are a front surface and a rear surface. In addition, a substrate W that constitutes a treatment target in this embodiment is a semiconductor packaged substrate or the like. A conductive layer made up of a seed layer and the like is formed on each of a front surface side and a rear surface side of a substrate W, and further, a resist layer is formed on a pattern forming area on the conductive layer, and a trench and a via are formed in advance on the resist layer. This embodiment can include a substrate (a so-called through-hole substrate) including a through hole connecting a front surface with a rear surface of the substrate.

As shown in FIG. 1, the platform 101 is made up of a plurality of platform members 101*a* to 101*h*, and these platform members 101*a* to 101*h* are configured to be coupled to one another. Constituent elements of the loading/unloading section 170A are disposed on a first platform member 101*a*, constituent elements of the substrate setting section 170B are disposed on a second platform member 101*b*, constituent elements of the processing section 170C are disposed on a third platform member 101*c* to a sixth platform member 101*f*, and constituent elements of the holder storage section 170D are disposed on a seventh platform member 101*g* and an eighth platform member 101*h*.

A loading stage 105 where a cassette (not shown) storing a pre-plating substrate W is installed and an unloading stage 107 where a cassette (not shown) storing a substrate W plated in the processing section 170C is installed are provided on the loading/unloading section 170A. Further, a substrate transport device 122 made up of a transport robot for transporting a substrate W is disposed on the loading/unloading section 170A.

The substrate transport device 122 is configured so that a cassette installed on the loading stage 105 is accessed to take out a pre-plating substrate W from the cassette and the substrate W so taken out is then transferred to the substrate setting section 170B. In the substrate setting section 170B, the pre-plating substrate W is set in the substrate holder 11, and the plated substrate W is taken out from the substrate holder 11.

The processing section 170C includes a pre-wetting tank 126, a pre-soaking tank 128, a first rinsing tank 130*a*, a blower tank 132, a second rinsing tank 130*b*, a first plating tank 10*a*, a second plating tank 10*b*, a third rinsing tank 130*c*, and a third plating tank 10*c*, all of which are disposed thereon. These tanks 126, 128, 130*a*, 132, 130*b*, 10*a*, 10*b*, 130*c*, 10*c* are arranged sequentially in this order. In the following description, the first plating tank 10*a*, the second plating tank 10*b*, and the third plating tank 10*c* may be referred to generally as a plating tank 10, or any one of the tanks may be referred to simply as a plating tank 10.

In the pre-wetting tank 126, a substrate W is submerged in pure water as a pre-treatment preparation. In the pre-soaking tank 128, an oxide film on a surface of a conductive layer such as a seed layer formed on a surface of a substrate W is etching removed by chemical liquid. In the first rinsing tank 130*a*, the pre-soaked substrate W is cleaned with cleaning liquid (for example, pure water).

In at least one plating tank 10 in the first plating tank 10*a*, the second plating tank 10*b*, and the third plating tank 10*c*, both surfaces of a substrate W are plated. In the embodiment illustrated in FIG. 1, although the three plating tanks 10 are provided, an arbitrary number of plating tanks 10 may be provided in another embodiment.

In the second rinsing tank 130*b*, a substrate W that is plated in the first plating tank 10*a* or the second plating tank 10*b* is cleaned together with a substrate holder 11 holding it with cleaning liquid (for example, pure water). In the third rinsing tank 130*c*, a substrate W that is plated in the third plating tank 10*c* is cleaned together with a substrate holder 11 holding it with cleaning liquid (for example, pure water). In the blower tank 132, the liquid remaining on the substrate W that has been cleaned is removed before and after the plating treatment.

The pre-wetting tank 126, the pre-soaking tank 128, the rinsing tanks 130*a* to 130*c*, and the plating tanks 10*a* to 10*c* are treatment tanks that can store corresponding treatment liquid (liquid) therein. These treatment tanks each include a plurality of treatment cells for storing treatment liquid, but the present invention is not limited to this configuration, and hence, these treatment tanks may each include a single treatment cell. Alternatively, at least some of these treatment tanks may each include a single treatment cell, while the other treatment tanks may each include a plurality of treatment cells.

The plating system includes further a transport machine 140 for transporting substrate holders 11. The transport machine 140 is configured to move between the constituent elements of the plating system. The transport machine 140 includes a fixing base 142 that extends in a horizontal direction from the substrate setting section 170B to the processing section 170C, and a plurality of transporters 141 configured to move along the fixing base 142.

These transporters 141 each have a movable portion (not shown) for holding a substrate holder 11 and are configured to hold a substrate holder 11. The transporters 141 are each configured to transport a substrate holder 11 among the substrate setting section 170B, the holder storage section 170D, and the processing section 170C and further to move the substrate holder 11 up and down together a substrate W that the substrate holder 11 holds. For example, one of the transporters 141 lowers a substrate holder 11 that holds a substrate W from above the plating tank 10 to thereby submerge the substrate W together with the substrate holder 11 in the plating liquid in the plating tank 10. As a moving mechanism of the transporter 141, for example, a combination of a motor and a rack and pinion mechanism is raised. In the embodiment illustrated in FIG. 1, although three transporters are provided, an arbitrary number of transporters may be adopted as another embodiment.

(Substrate Holder)

Figure 2A:
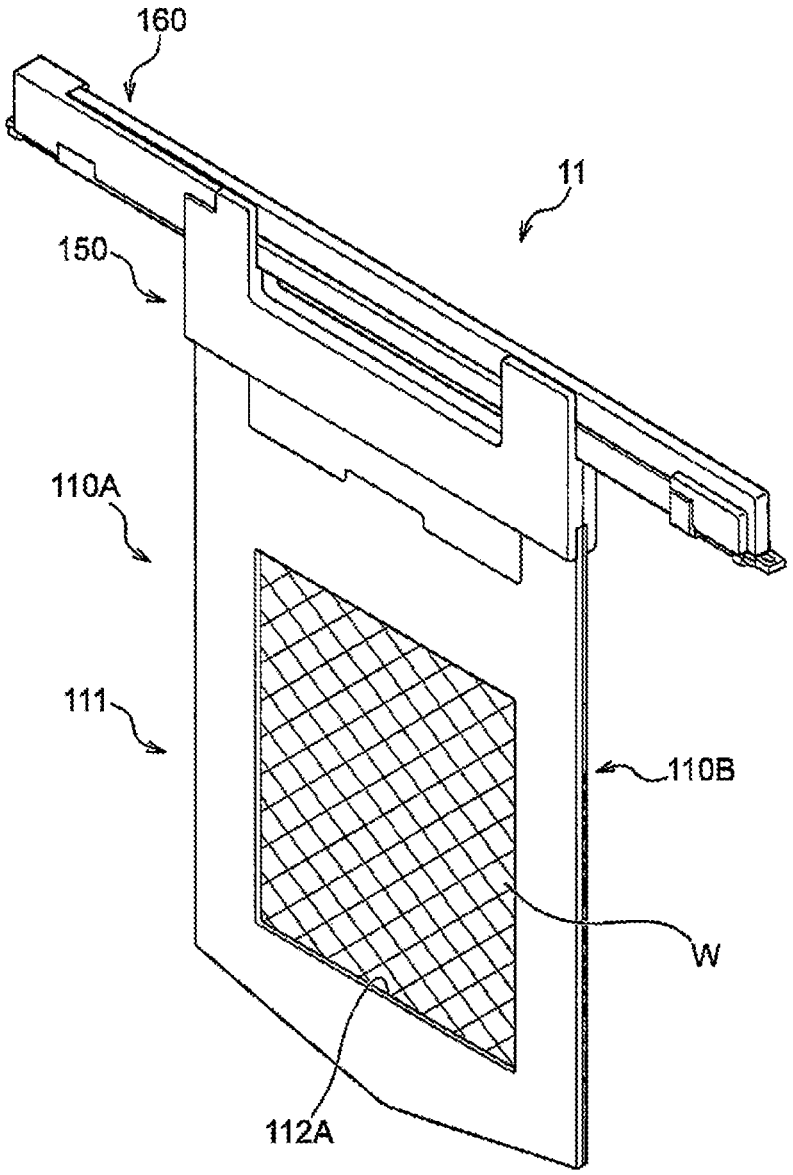
FIG. 2A is a perspective view of a substrate holder as seen from a first side.
Figure 2B:
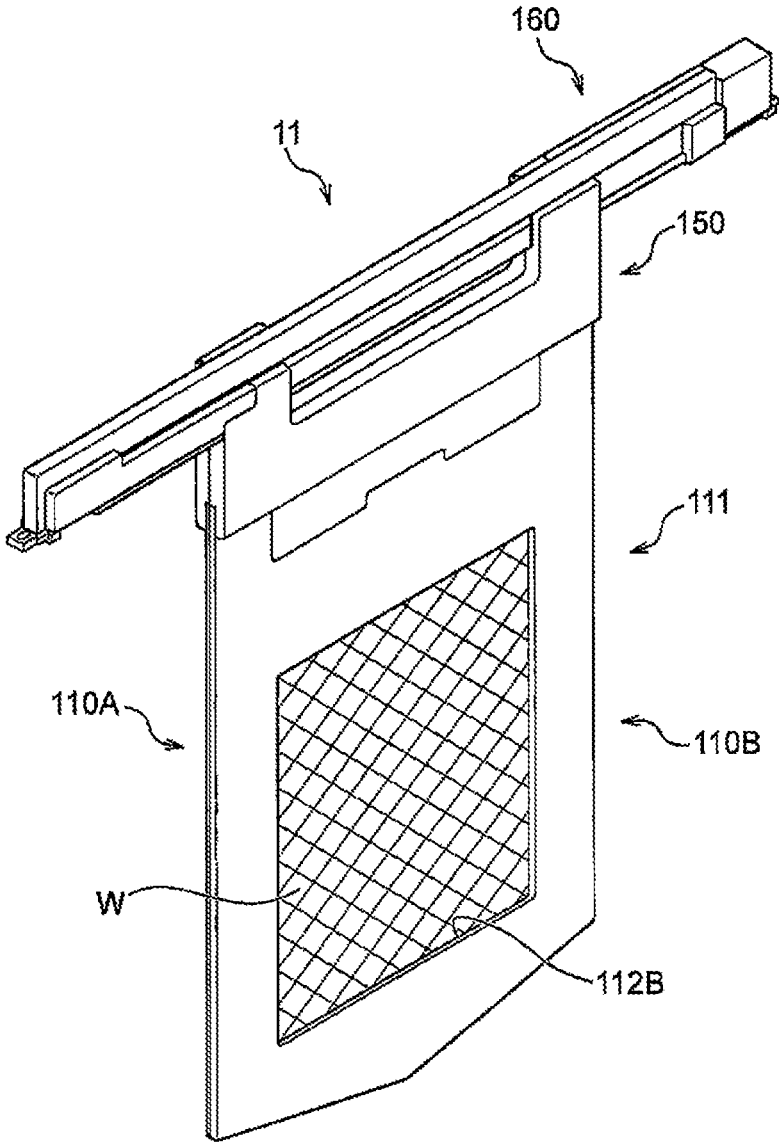
FIG. 2B is a perspective view of the substrate holder as seen from a second side.
Figure 3A:
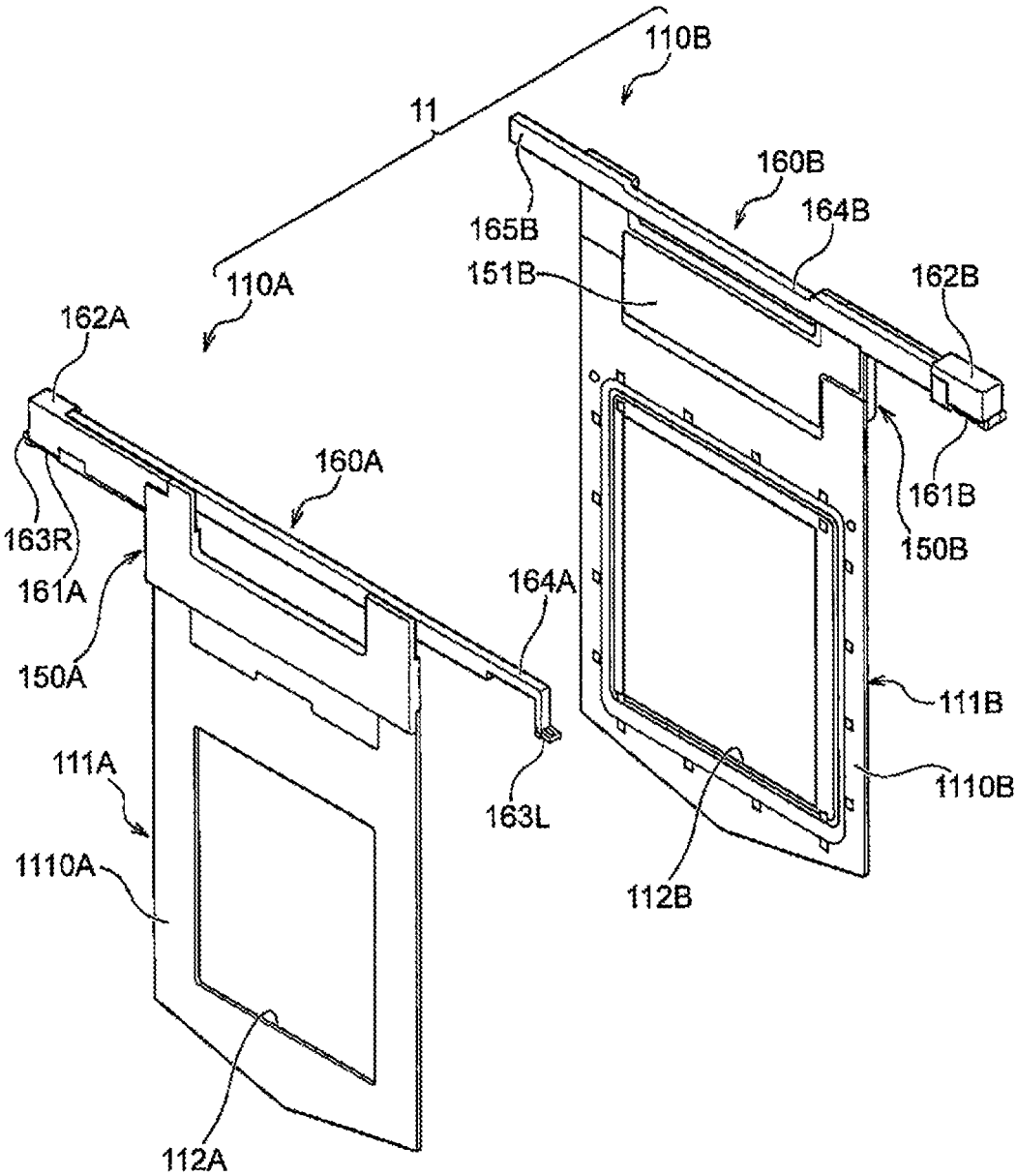
FIG. 3A is a perspective view of a first holding member and a second holding member of the substrate holder as seen from the first side with the substrate holder opened.
Figure 3B:
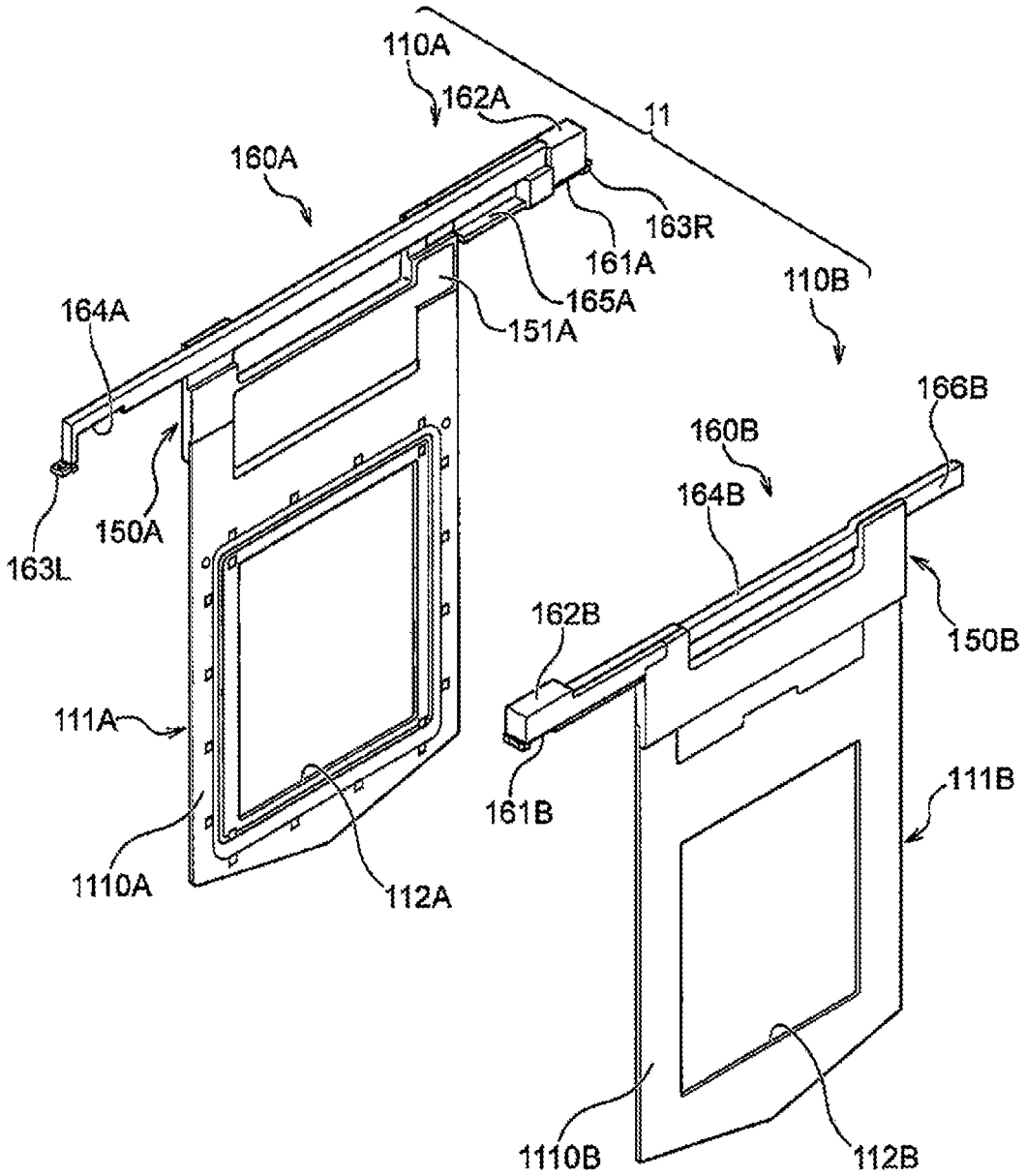
FIG. 3B is a perspective view of the first holding member and the second holding member of the substrate holder as seen from the second side with the substrate holder opened.
Figure 4A:
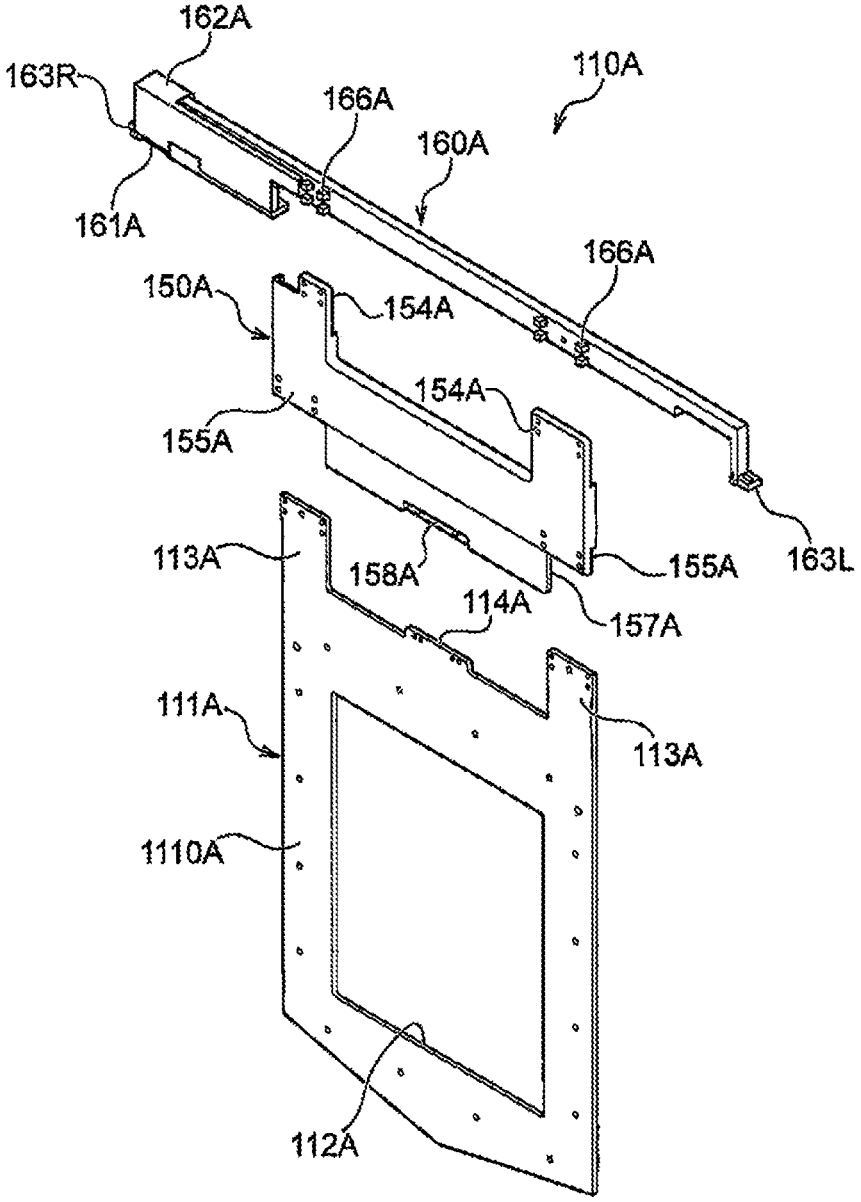
FIG. 4A is an exploded perspective view of the first holding member as seen from the first side.
Figure 4B:
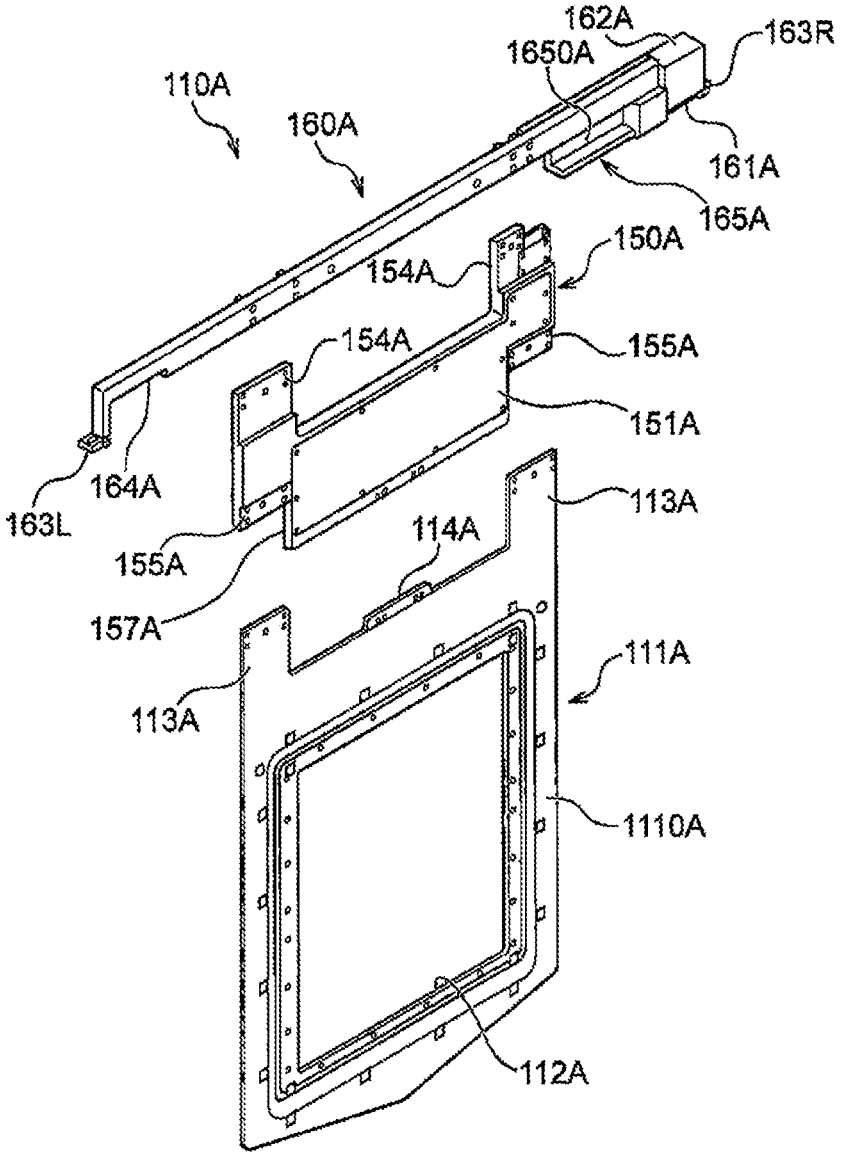
FIG. 4B is an exploded perspective view of the first holding member as seen from the second side.
Figure 4C:
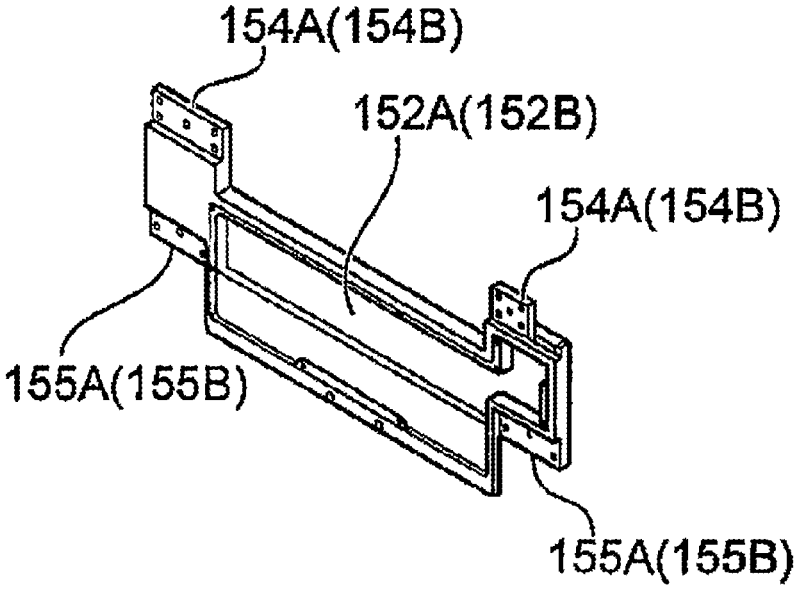
FIG. 4C is an exploded perspective view of a wiring storage portion.
Figure 5A:
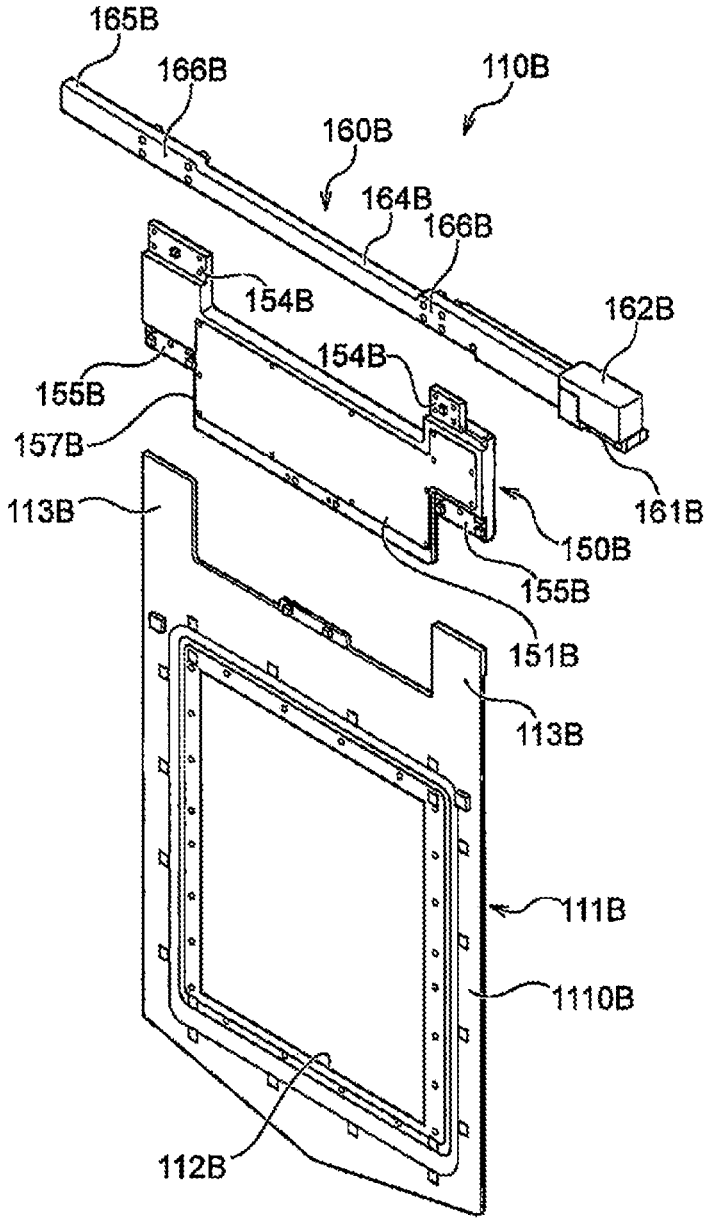
FIG. 5A is an exploded perspective view of the second holding member as seen from the first side.
Figure 5B:
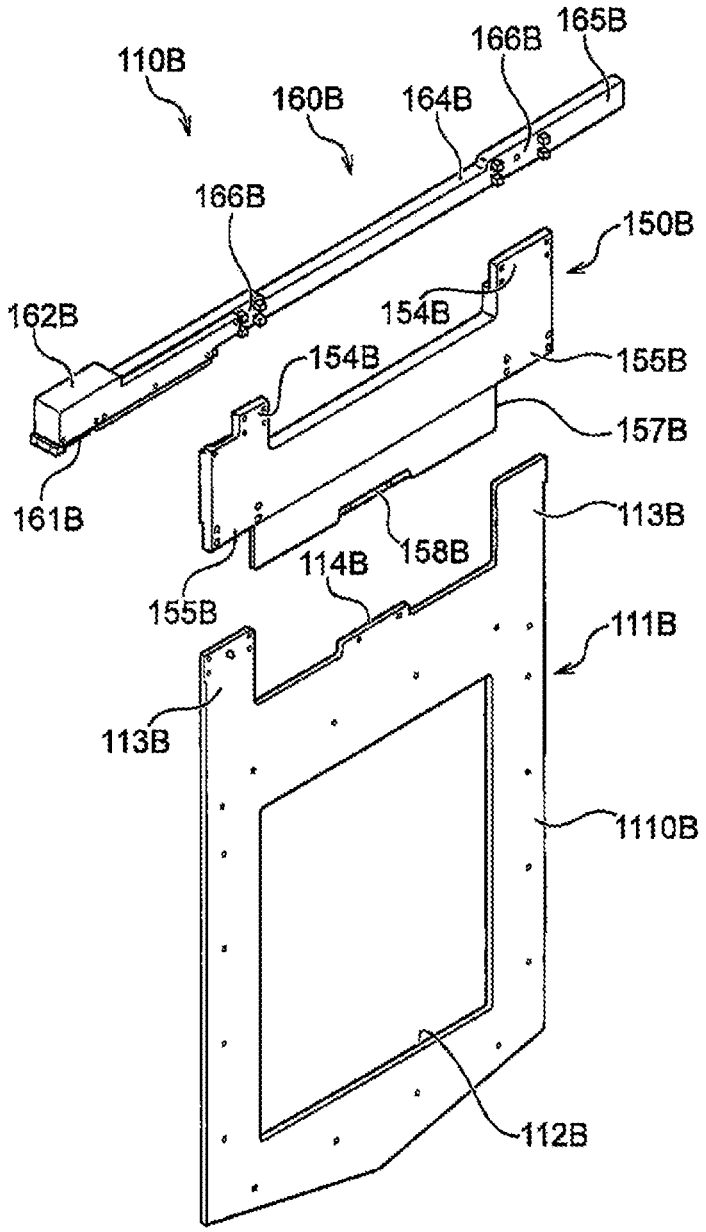
FIG. 5B is an exploded perspective view of the second holding member as seen from the second side.

FIG. 2A is a perspective view of a substrate holder as seen from a first side. FIG. 2B is a perspective view of the substrate holder as seen from a second side. FIG. 3A is a perspective view of a first holding member and a second holding member as seen from the first side, with the substrate holder disengaged. FIG. 3B is a perspective view of the first holding member and the second holding member as seen from the second side, with the substrate holder disengaged. FIG. 4A is an exploded perspective view of the first holding member as seen from the first side. FIG. 4B is an exploded perspective view of the first holding member as seen from the second side. FIG. 4C is a perspective view of a wiring storage portion. FIG. 5A is an exploded perspective view of the second holding member as seen from the first side. FIG. 5B is an exploded perspective view of the second holding member as seen from the second side.

The substrate holder 11 includes a first holding member 110A having a first opening portion 112A and a second holding member 110B having a second opening portion 112B. The substrate holder 11 holds a substrate W by sandwiching it between the first holding member 110A and the second holding member 110B. The first holding member 110A and the second holding member 110B hold a substrate W in such a manner that plating target surfaces of a first surface (a front surface) and a second surface (a rear surface) of the substrate W are exposed by the first opening portion 112A and the second opening portion 112B, respectively. In other words, the first holding member 110A and the second holding member 110B hold the substrate W by sandwiching only an outer circumferential portion of the substrate W from both sides. The substrate holder 11 includes an arm portion 160, and the substrate holder 11 is transported with the arm portion 160 held by the transporter 141. In the following description, a side of the substrate holder 11 where the first surface (the front surface) of the substrate W is exposed may be referred to as a first side, and a side where the second surface (the rear surface) of the substrate is exposed may be referred to as a second side. FIG. 2A illustrates a state where the first surface (the front surface) of the substrate W is exposed from the first opening portion 112A of the first holding member 110A. FIG. 2B illustrates a state where the second surface (the rear surface) of the substrate W is exposed from the second opening portion 112B of the second holding member 110B.

In this embodiment, although the substrate holder 11 is described as holding a square or rectangular substrate W, the present invention is not limited to this configuration, and hence, the substrate holder 11 may be configured to hold a circular substrate. In this case, the first opening portion 112A and the second opening portion 112B also take a circular shape. Alternatively, the substrate W can also be formed into a polygonal substrate such as a hexagonal substrate. In this case, similarly, the first opening portion 112A and the second opening portion 112B also take a polygonal shape.

The first holding member 110A includes a first main body portion 111A, a first wiring storage portion 150A, and a first arm portion 160A (FIGS. 3A, 4A). The second holding member 110B includes a second main body portion 111B, a second wiring storage portion 150B, and a second arm portion 160B (FIGS. 3A, 5A).

The first main body portion 111A provides a main body portion 111 for holding a substrate W together with the second main body portion 111B (FIGS. 2A, 3A). The first main body portion 111A includes a first main body 1110A where the first opening portion 112A is formed and other constituent members such as a seal, which will be described later, and a substrate contact. The first main body 1110A constitutes a plate-like member having an outer surface and an inner surface which constitute an outer side and an inner side, respectively, when the first holding member 110A and the second holding member 110B are brought into engagement with each other. The constituent members such as the seal, the substrate contact and the like are disposed on the inner surface of the first main body 1110A. The first main body portion 111A has attachment portions 113A that are attached to attachment portions 155A of the first wiring storage portion 150A at both ends of a projecting portion 157A of the first wiring storage portion 150A (FIG. 4A). Each attachment portion 113A projects at each end of the projecting portion 157A of the first wiring storage portion 150A. The first main body portion 111A has an attachment portion 114A which constitutes a projecting portion configured to be attached to a substantially central attachment portion 158A of the first wiring storage portion 150A side (FIG. 4A). Attachment structures such as bolt holes or the like are provided on the attachment portions 113A, 114A and the attachment portions 155A, 158A. The attachment portions 113A, 114A are fixed to the attachment portions 155A, 158A, respectively, with fastening members such as bolts. In this embodiment, the attachment portions 113A, 114A are formed integrally with the first main body 1110A.

The first wiring storage portion 150A provides a path through which a plurality of wiring lines L (electric current paths) pass and provides a wiring storage portion 150 where an extra length portion of each of the wiring lines L is stored (FIGS. 2A, 3A). The first wiring storage portion 150A has a storage space 152A (FIG. 4C). The storage space 152A provides a path through which the plurality of wiring lines L (electric current paths) pass which extend from an external connection portion 161A to substrate contacts, and stores an extra length portion of each of the wiring lines L. The first wiring storage portion 150A has a first lid portion 151A configured to close the storage space 152A. In this embodiment, each external connection contact 168 and each substrate contact 117 are connected by a individual separate wiring line L, and lengths of the wiring lines L are made substantially the same, so that a resistance value between each external connection contact 168 and each substrate contact 117 (FIG. 12B) is made uniform. As a result, a uniform electric current flows to each substrate contact 117. In this case, a distance between each external connection contact 168 and each substrate contact 117 differs depending on the position of the substrate contact 117, and the length of the wiring is set to match a path having a longest distance. Due to this, depending on positions of substrate contacts 117, extra length portions are generated on the wiring, but the first wiring storage portion 150A stores the extra length portions so generated.

The first wiring storage portion 150A has two attachment portions 154A that are attached to corresponding attachment portions 166A of the first arm portion 160A (FIG. 4A). Attachment structures such as bolt holes or the like are provided on the attachment portion 154A to attach the attachment portion 154A to the first arm portion 160A. Additionally, the first wiring storage portion 150A has further the two attachment portions 155A which are attached to the two attachment portions 113A of the first main body portion 111A, and the attachment portion 158A which is attached to the attachment portion 114A of the first main body portion 111A. Attachment structures such as bolt holes or the like are provided on the attachment portions 155A, 158A to attach the attachment portions 155A, 158A to the first main body portion 111A. The first wiring storage portion 150A is fixed to the first arm portion 160A and the first main body portion 111A at the individual attachment portions with fastening devices such as bolts.

The first arm portion 160A provides, together with the second arm portion 160B, a portion that is held by the transporter 141 and the arm portion 160 that is held in the plating tank (FIGS. 2A, 3A). The first arm portion 160A includes a thin elongated plate-like member or a rod-like member. The first arm portion 160A has the external connection portion 161A and an external connection portion cover 162A configured to protect the corresponding external connection portion 161A and the wiring lines L. Additionally, the first arm portion 160A has engagement portions 164A, 165A configured to be brought into engagement with the second arm portion 160B of the second holding member 110B (FIG. 3B). The first arm portion 160A and the second arm portion 160B are brought into engagement with each other by the engagement portions 164A, 165A and are then positioned in place. In addition, the first arm portion 160A has two attachment portions 166A that correspond individually to the two attachment portions 154A of the first wiring storage portion 150A (FIG. 4A). As illustrate in FIGS. 4B and 6D, the engagement portion 165A has a thin portion 1650A that extends further towards the first main body portion 111A than other portions (for example, a central portion) of the thin elongated plate-like member or the rod-like member. In addition, a portion having substantially the same thickness as the other portions (for example, the central portion) is formed into a flange-like configuration on a side of the thin portion 1650A that faces the first main body portion 111A. A block-like portion, which is thicker than the thin portion, is provided on a side of the thin portion 1650A that faces the external connection portion 161A. Consequently, the thin portion 1650A constitutes a recessed portion that is surrounded from three directions, and an end portion 165B of the second arm portion 160B is brought into engagement with this recessed portion.

Figure 16A:
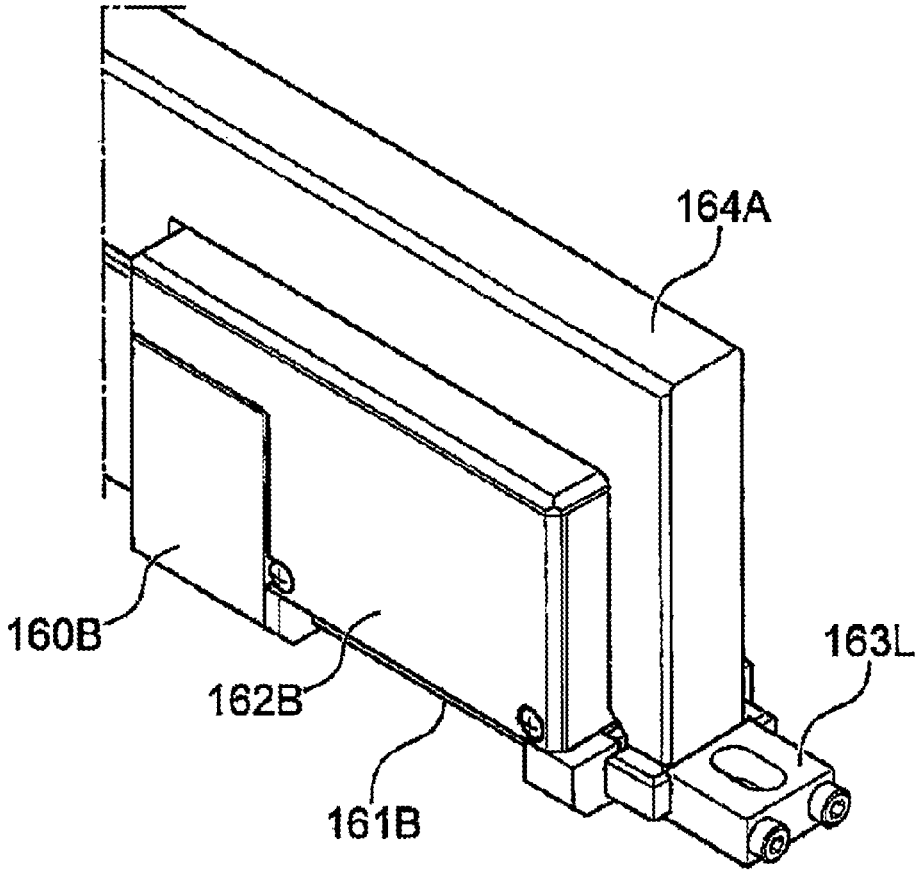
FIG. 16A is an enlarged perspective view of the vicinity of a positioning portion of the first arm portion of the first holding member on an opposite side to the external connection portion.
Figure 16B:
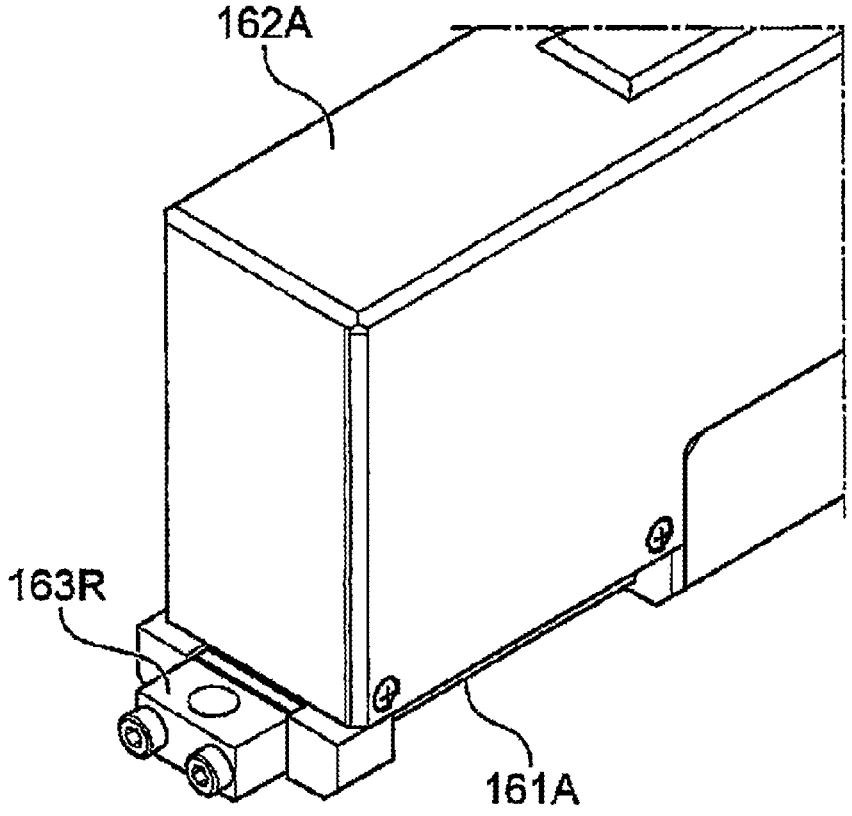
FIG. 16B is an enlarged perspective view of the vicinity of a positioning portion of the first arm portion of the first holding member on an external connection portion side.

FIG. 16A is an enlarged perspective view of the vicinity of a positioning portion at the end of the first arm portion of the first holding member that lies opposite to the end thereof where the external connection portion is provided. FIG. 16B is an enlarged perspective view of the vicinity of a positioning portion at the end of the first arm portion of the first holding member where the external connection portion is provided. As illustrated in FIGS. 16A and 16B, the first arm portion 160A at both end portions thereof has positioning portions 163R, 163L for positioning a substrate holder 11 on the substrate setting section 170B and in the plating tank 10. The positioning portions 163R, 163L each have a positioning hole, whereby a substrate holder 11 is positioned on the substrate setting section 170B and in the plating tank 10 by the positioning holes being brought into engagement with positioning pins (not shown) provided on the substrate setting section 170B and in the plating tank 10. One of the positioning holes may be formed into an elongated hole so as to enable a substrate holder 11 to be adjusted in position in a left-right direction. FIG. 16A illustrates a case where the positioning hole of the positioning portion 163L is formed into an elongated hole.

The second holding member 110B includes a second main body portion 111B, a second wiring storage portion 150B, and a second arm portion 160B (FIGS. 3A, 5A). Since the configurations of the second main body portion 111B and the second wiring storage portion 150B are substantially the same as the configurations of the first main body portion 111A and the first wiring storage portion 150A, a detailed description thereof will be omitted here, and like reference numerals and an alphabet character of B are added to the like configurations.

The second arm portion 160B includes a thin elongated plate-like member or a rod-like member. The second arm portion 160B has an external connection portion 161B and an external connection portion cover 162B that protect the external connection portion 161B and wiring lines L. Additionally, the second arm portion 160B has two attachment portions 166B that correspond individually to two attachment portions 154B of the second wiring storage portion 150B (FIG. 5A). The second arm portion 160B is attached to the attachment portions 154B of the second wiring storage portion 150B at the attachment portions 166B with fastening devices such as bolts or the like, for example. Additionally, the second arm portion 160B has a narrow portion 164B, which is narrower than other portions, between the two attachment portions 166B.

Figure 6A:
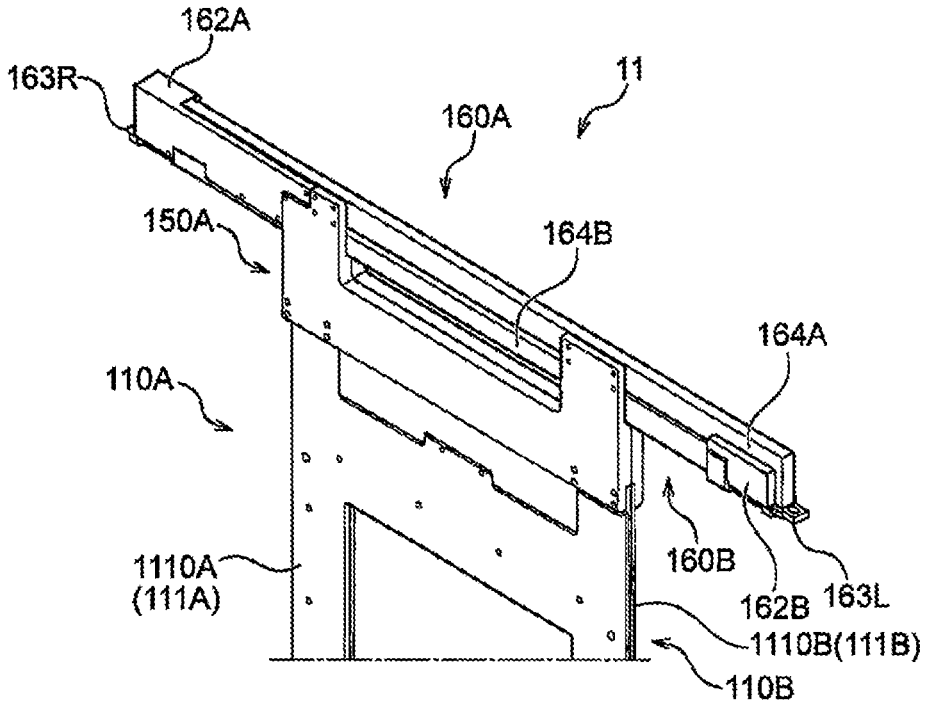
FIG. 6A is an enlarged perspective view of the vicinity of an arm portion, illustrating a state, as seen from the first side, where a first arm portion and a second arm portion are in engagement.
Figure 6B:
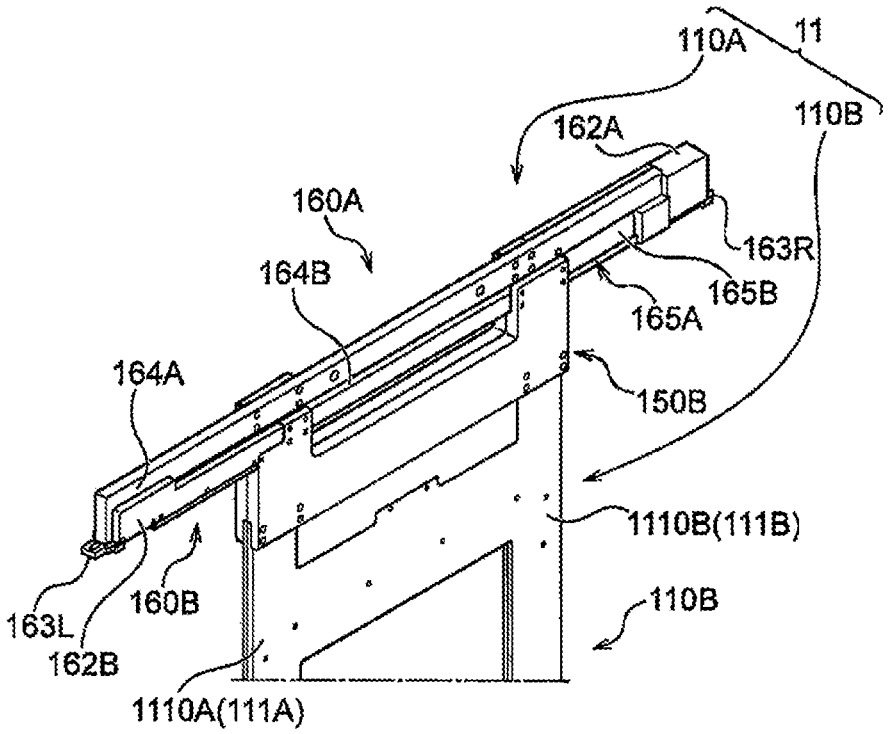
FIG. 6B is an enlarged perspective view of the vicinity of the arm portion, illustrating a state, as seen from the second side, where the first arm portion and the second arm portion are in engagement.
Figure 6C:
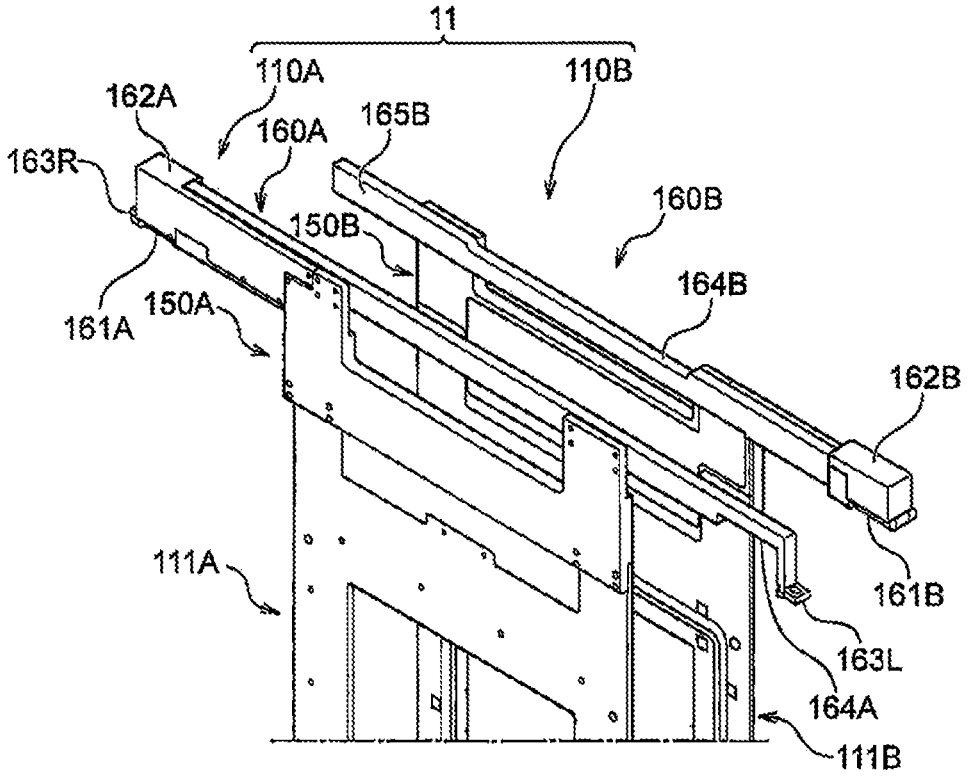
FIG. 6C is an enlarged perspective view of the vicinity of the arm portion, illustrating a state, as seen from the first side, where the first arm portion and the second arm portion are disengaged.
Figure 6D:
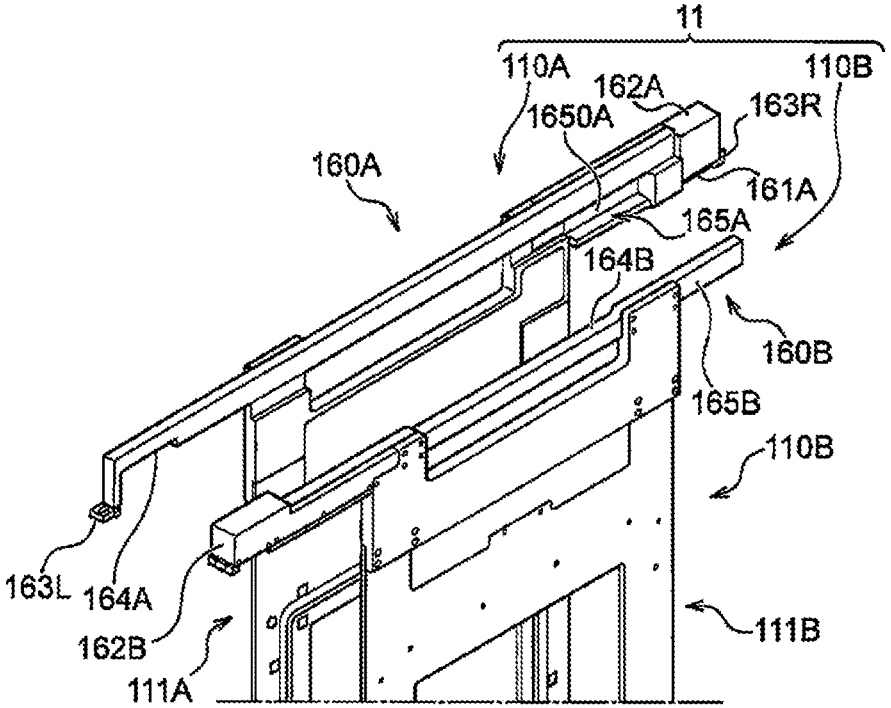
FIG. 6D is an enlarged perspective view of the vicinity of the arm portion, illustrating a state, as seen from the second side, where the first arm portion and the second arm portion are disengaged.

FIG. 6A is an enlarged perspective view of the vicinity of the arm portion illustrating the first arm portion and the second arm portion, which are in engagement with each other, as seen from the first side. FIG. 6B is an enlarged perspective view of the vicinity of the arm portion illustrating the first arm portion and the second arm portion, which is in engagement with each other, as seen from the second side. FIG. 6C is an enlarged perspective view of the vicinity of the arm portion illustrating the first arm portion and the second arm portion, which are disengaged from each other, as seen from the first side. FIG. 6D is an enlarged perspective view of the vicinity of the arm portion illustrating the first arm portion and the second arm portion, which are disengaged from each other, as seen from the second side.

As shown in FIGS. 6A to 6D, the engagement portion 164A of the first arm portion 160A is brought into engagement with an upper surface and end face of the external connection portion cover 162B of the second arm portion 160B (FIGS. 6A, 6B). The end portion 165B of the second arm portion 160B that is provided on an opposite side to the side where the external connection portion cover 162B is provided is brought into engagement with the recessed portion of the engagement portion 165A of the first arm portion 160A (FIG. 6B). At this time, the engagement portion 165A of the first arm portion 160A has a shape in which the engagement portion 165A fits on the end portion 165B of the second arm portion 160B in the up-down direction and from an end face side. In this way, the first arm portion 160A and the second arm portion 160B are brought into engagement with each other in such a manner that the first arm portion 160A overlaps over the second arm portion 160B as a whole. That is, with the first holding member 110A and the second holding member 110B staying in engagement with each other, the first arm portion 160A and the second arm portion 160B are aligned in a direction from the first and second main body portions 111A, 111B towards the first and second arm portions 160A, 160B. In other words, an upper space and a lower space of a substrate holder 11 are assigned for the first arm portion 160A and the second arm portion 160B, respectively, whereby the first arm portion 160A and the second arm portion 160B are positioned separately in the up-down direction. According to this configuration, an increase in a thickness-wise dimension of a substrate holder 11 is suppressed or prevented.

In addition, a gap is formed between the first arm portion 160A and the second arm portion 160B at the narrow portion 164B of the second arm portion 160B, and this gap constitutes a clearance space for a claw of the transporter 141 (a claw for grasping a substrate holder 11).

In addition, as shown in FIGS. 6A to 6D, when the first arm portion 160A and the second arm portion 160B are brought into engagement with each other, the first and second external connection portions 161A, 161B of the first and second arm portions 160A, 160B are disposed on opposite sides of a substrate holder 11 in a widthwise direction thereof so that the first and second external connection portions 161A, 161B do not interfere with each other. That is, the first and second external connection portions 161A, 161B are positioned at left and right ends of the substrate holder 11, that is, at left and right ends of the arm portion 160. Since a first surface and a second surface of a substrate W can be fed from the left and right ends of the arm portion 160 of a substrate holder 11 that holds the substrate W in the plating tank 10, compared with a mode where external connection portions are collected at one end portion of the arm portion 160, an increase in thickness of the substrate holder 11 can be prevented.

Figure 7A:
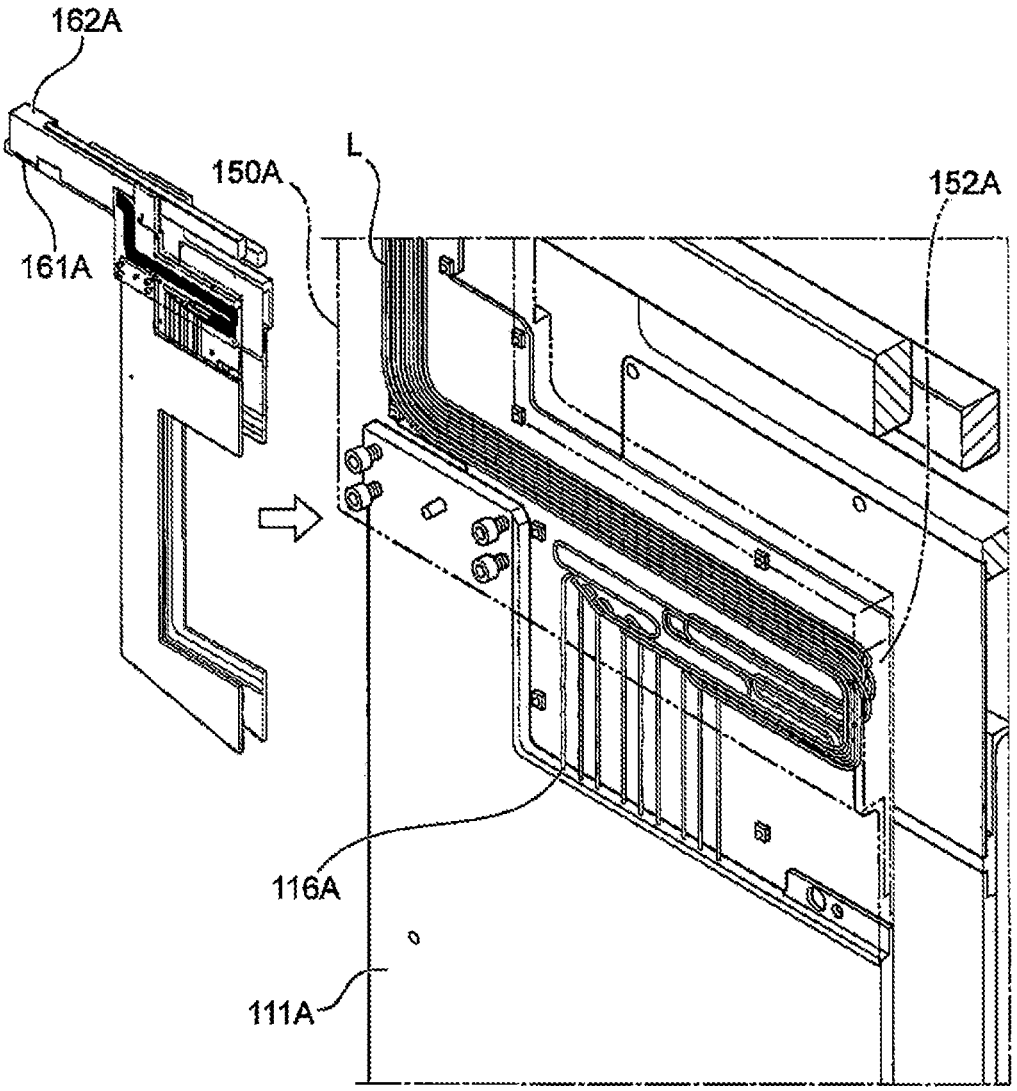
FIG. 7A is a partially cut-away perspective view of the first holding member illustrating a configuration of a wiring path reaching a first main body portion from a first external connection portion.
Figure 7B:
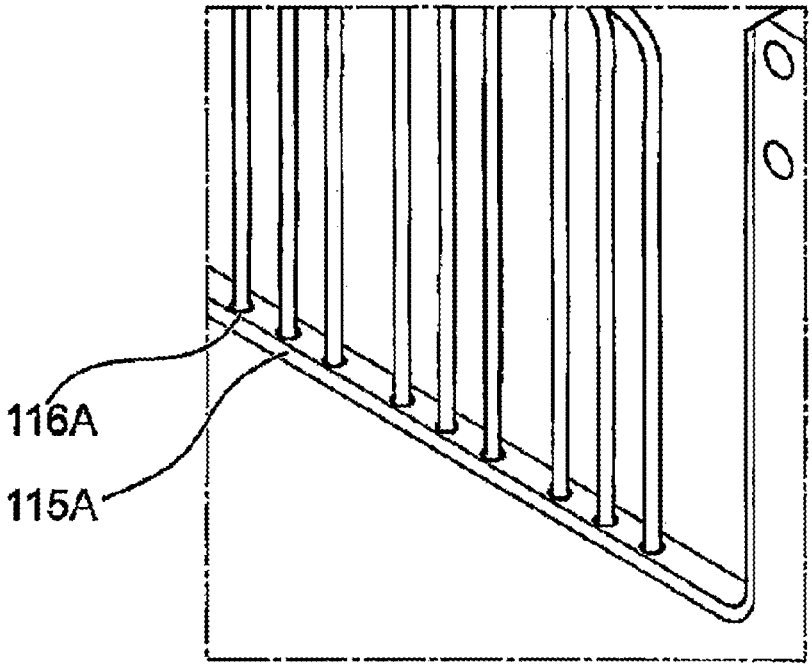
FIG. 7B is a perspective view of the first main body portion at a connecting portion with the wiring storage portion of the first main body portion.
Figure 7C:
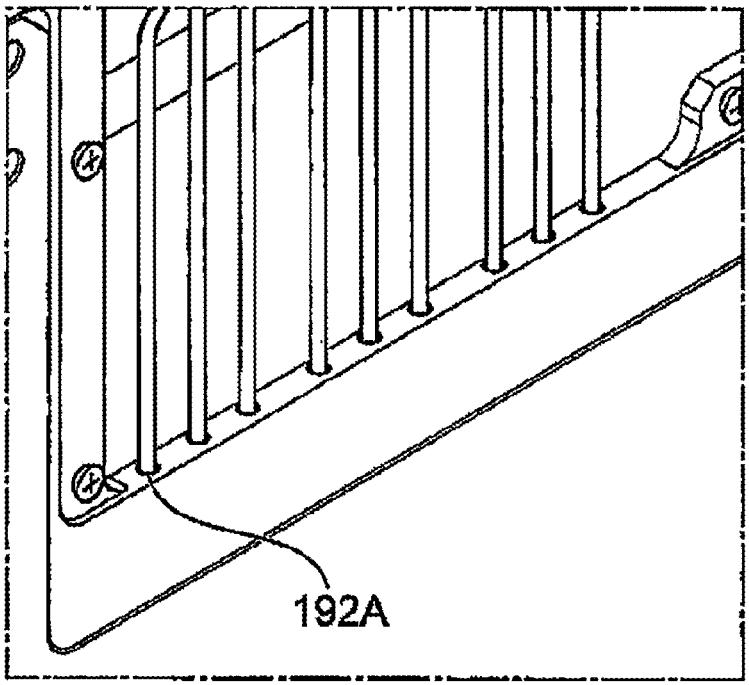
FIG. 7C is a perspective view of the wiring storage portion as seen from an inner side thereof at a connecting portion of the wiring storage portion with the first main body portion.
Figure 7D:
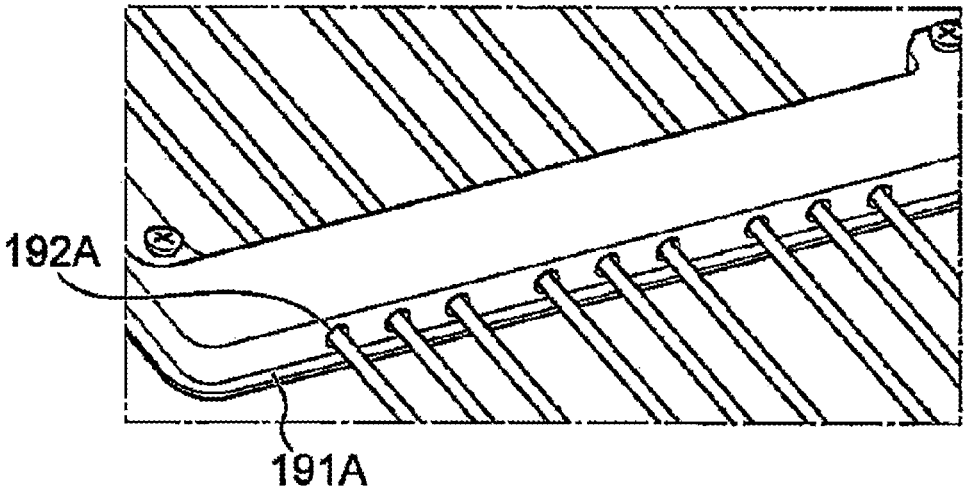
FIG. 7D is a perspective view of the wiring storage portion as seen from an outer side thereof at the connecting portion of the wiring storage portion with the first main body portion.

FIG. 7A is a partially cut-away perspective view of the first holding member illustrating a configuration of a wiring path reaching the first main body portion from the first external connection portion. FIG. 7B is a perspective view of the first main body portion at a connecting portion with the wiring storage portion of the first main body portion. FIG. 7C is a perspective view of the wiring storage portion as seen from an inner side thereof at a connecting portion of the wiring storage portion with the first main body portion. FIG. 7D is a perspective view of the wiring storage portion as seen from an outer side thereof at the connecting portion of the wiring storage portion with the first main body portion. In the following description, although a path of wiring lines L of the first holding member 110A will be described, the same or similar descriptions can be applied to a path of wiring lines L of the second holding member 110B.

As illustrated in FIG. 7A, a plurality of wiring lines L connected to the first external connection portion 161A pass the storage space 152A (FIG. 4C) inside the first wiring storage portion 150A and then pass through wiring holes 116A (FIGS. 7A, 7B) provided on the first main body portion 111A to be introduced into the first main body portion 111A. The wiring holes 116A are drilled holes formed by machining and are provided in such a manner as to correspond individually to the wiring lines L. A plurality of wiring holes 192A, which correspond individually to the wiring lines L, are provided on a thick portion on a side of the first wiring storage portion 150A that faces the first main body portion 111A (FIGS. 7C, 7D). The plurality of wiring lines L pass through the wiring holes 192A and are then introduced to the side facing the first main body portion 111A. The wiring lines L emerging from the plurality of wiring holes 192A pass through the corresponding wiring holes 116A of the first main body portion 111A (FIG. 7B) and are then introduced into the first main body portion 111A.

Figure 8:
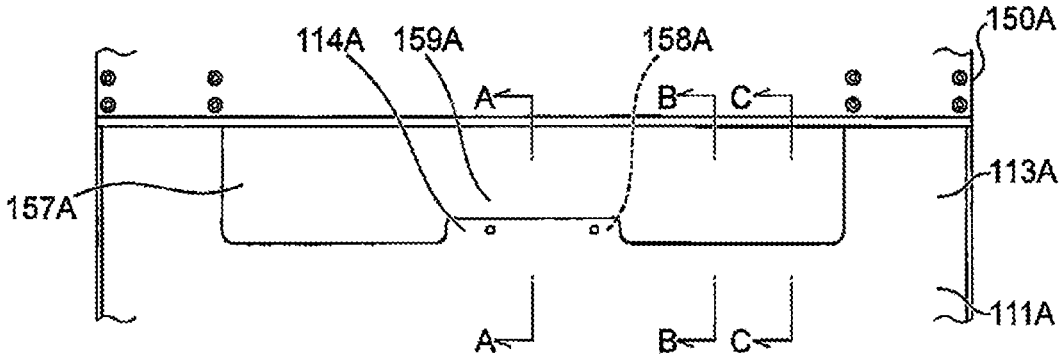
FIG. 8 is an enlarged plan view of the connecting portion between the wiring storage portion and a main body portion.
Figure 8A:
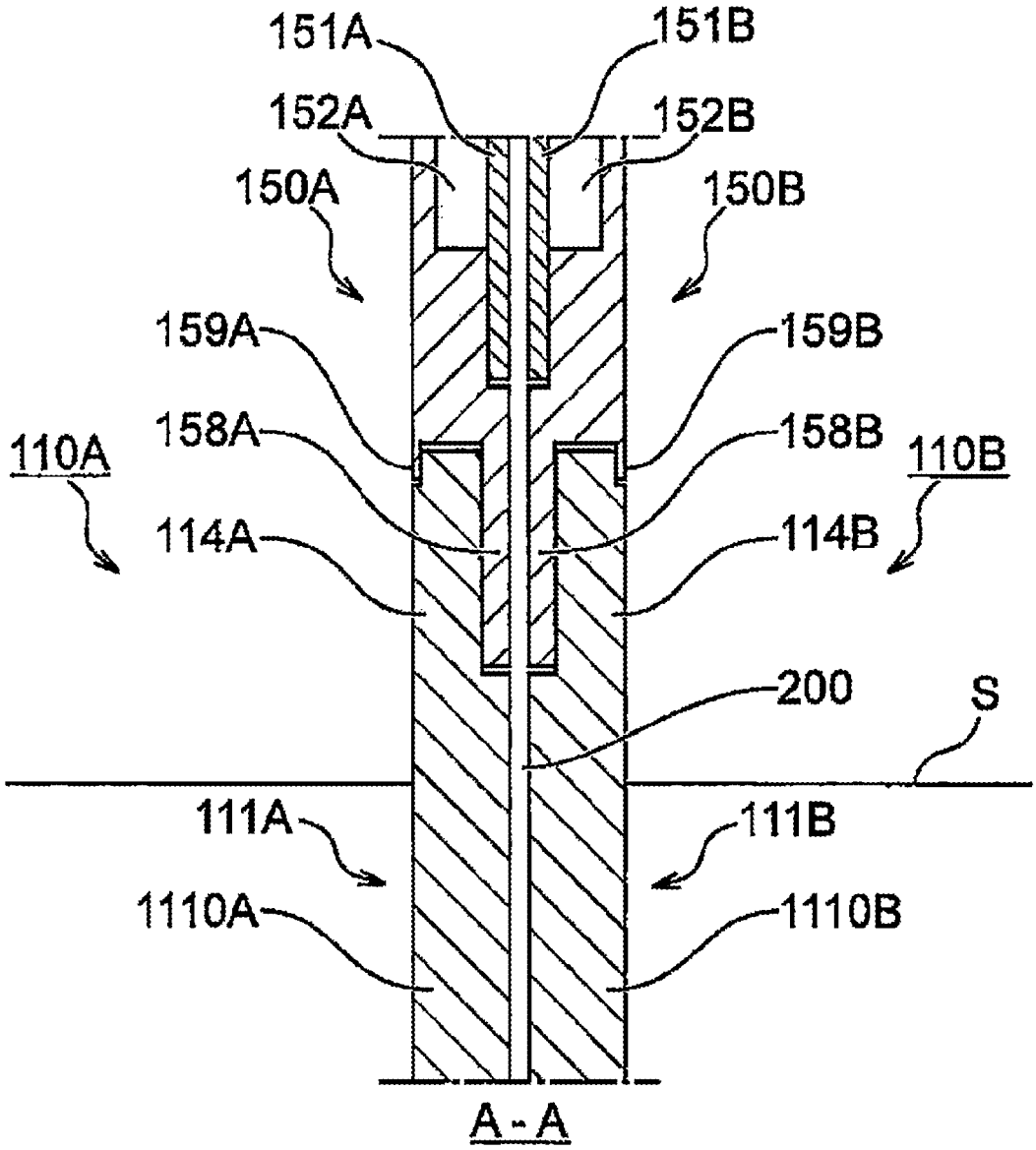
FIG. 8A is a cross-sectional view taken along a line A-A in FIG. 8.
Figure 8B:
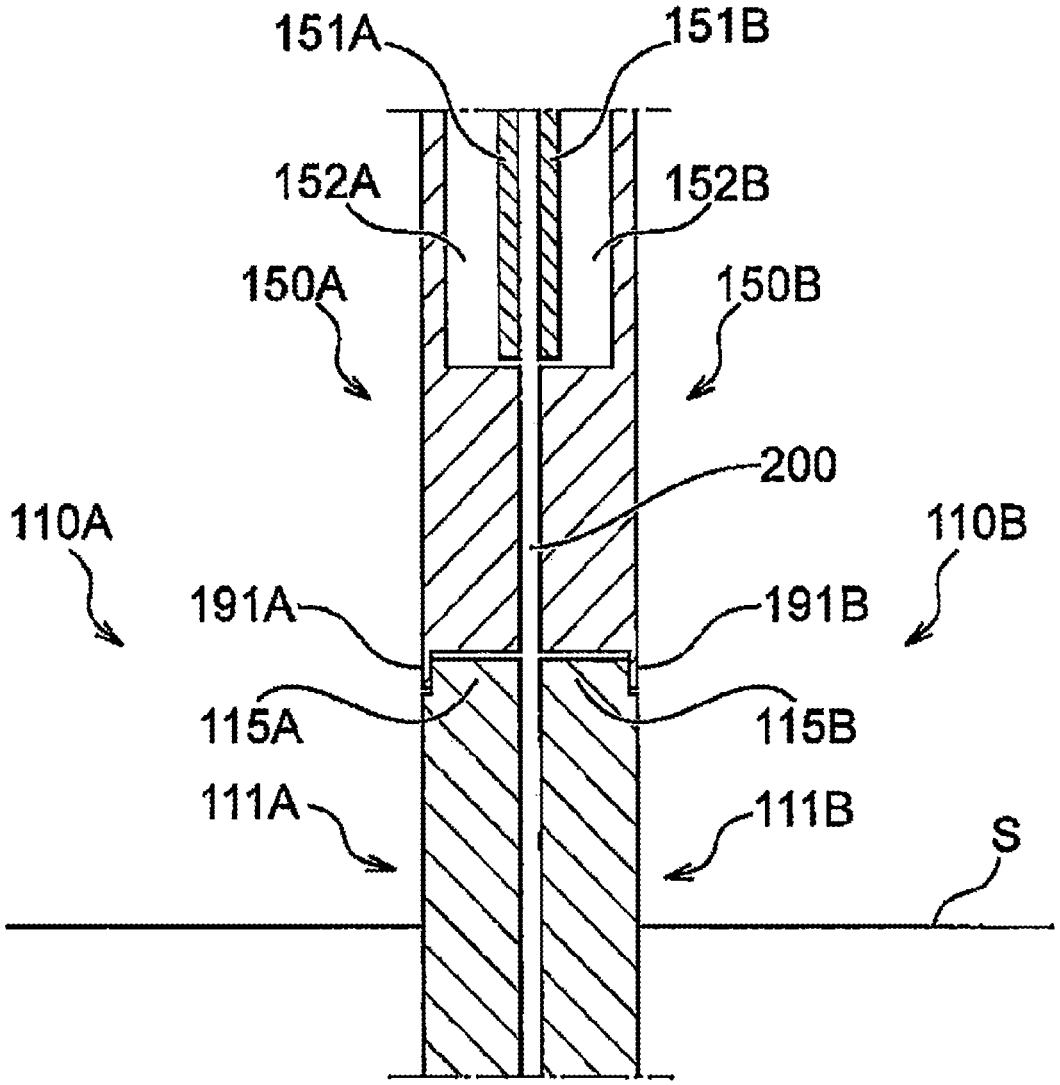
FIG. 8B is a cross-sectional view taken along a line B-B in FIG. 8, illustrating a portion where no wiring hole is formed.
Figure 8C:
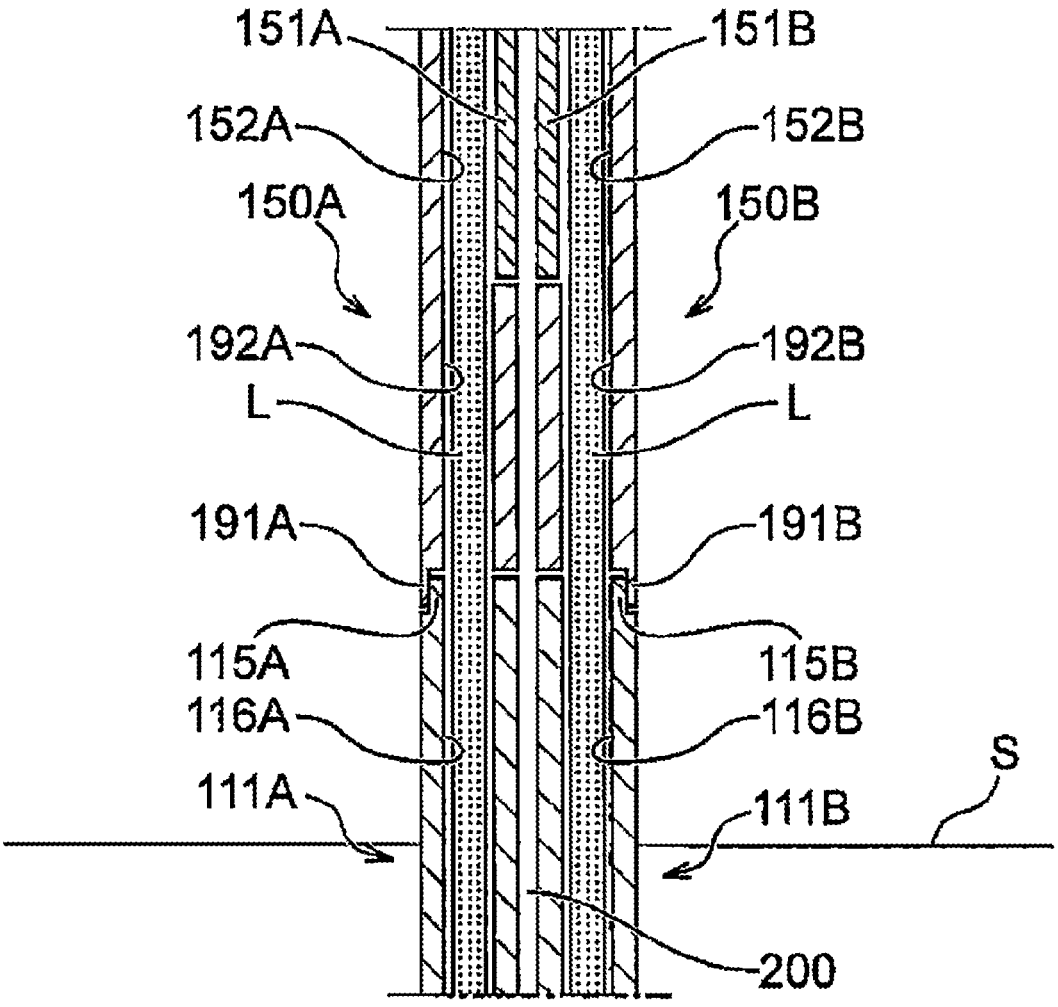
FIG. 8C is a cross-sectional view taken along a line C-C in FIG. 8, illustrating a portion where wiring holes are formed.

FIG. 8 is an enlarged plan view of the connecting portion between the wiring storage portion and the main body portion. FIG. 8A is a cross-sectional view taken along a line A-A in FIG. 8. FIG. 8B is a cross-sectional view taken along a line B-B in FIG. 8, illustrating a portion where no wiring hole is formed. FIG. 8C is a cross-sectional view taken along a line C-C in FIG. 8, illustrating a portion where the wiring holes are formed.

As illustrated in FIGS. 8 and 8A, the first main body portion 111A has the attachment portion 114A, which constitutes a thin portion, substantially at a center in a widthwise direction. The attachment portion 114A has a step portion made up of the thin portion having a smaller thickness than those of other portions of the first main body portion 111A on an inner surface (a surface facing the second holding member 110B) and an outer surface (an opposite surface to the surface facing the second holding member 110B). The first wiring storage portion 150A has attachment portions 158A and 159A that form a recessed portion having a shape matching the step portion at the attachment portion 114A of the first main body portion 111A. For example, bolt holes (not shown) are formed on the attachment portion 114A of the first main body portion 111A and the attachment portion 158A of the first wiring storage portion 150A, whereby the attachment portion 114A and the attachment portion 158A are fixed together with bolts. The second main body portion 111B and the second wiring storage portion 150B of the second holding member 110B also have similar configurations.

According to this configuration, since an umbrella structure is provided in which the attachment portion 159A of the first wiring storage portion 150A overlaps the outer surface of the attachment portion 114A of the first main body portion 111A, an intrusion of plating liquid into an inner space 200 defined between the first holding member 110A and the second holding member 110B from an outer surface side of the first holding member 110A can be restrained or prevented. Similarly, since an umbrella structure is provided in which the attachment portion 159B of the second wiring storage portion 150B overlaps an outer surface of an attachment portion 114B of the second main body portion 111B, an intrusion of plating liquid into the inner space 200 from an outer surface side (an opposite side to a side facing the first holding member 110A) of the second holding member 110B can be restrained or prevented. That is, the intrusion of plating liquid into the inner space 200 of the substrate holder 11 due to splashing of the plating liquid or the like can be restrained or prevented by the umbrella structures.

As shown in FIGS. 8 and 8B, the first main body portion 111A has the attachment portion 115A at a portion other than the attachment portion 114A where no wiring hole 116A is formed. The attachment portion 115A has a step portion made up of a thin portion having a smaller thickness than those of other portions of the first main body portion 111A on an outer surface (an opposite surface to a surface facing the second holding member 110B). The first wiring storage portion 150A has an attachment portion 191A made up of a flange portion having a shape matching the step portion of the attachment portion 115A of the first main body portion 111A. When the first holding member 110A and the second holding member 110B are brought into engagement with each other, the attachment portion 191A of the first wiring storage portion 150A is brought into engagement with the step portion of the attachment portion 115A of the first main body portion 111A. The second main body portion 111B and the second wiring storage portion 150B of the second holding member 110B have similar configurations.

According to this configuration, since an umbrella structure is provided in which the attachment portion 191A of the first wiring storage portion 150A overlaps the outer surface of the attachment portion 115A of the first main body portion 111A, an intrusion of plating liquid into the inner space 200 of the substrate holder 11 from an outer surface side of the first holding member 110A can be restrained or prevented. Similarly, since an umbrella structure is provided in which an attachment portion 191B of the second wiring storage portion 150B overlaps an outer surface of the attachment portion 115B of the second main body portion 111B, an intrusion of plating liquid into the inner space 200 of the substrate holder 11 from an outer surface side of the second holding member 110B can be restrained or prevented. That is, the intrusion of plating liquid into the inner space 200 of the substrate holder 11 due to splashing of the plating liquid or the like can be restrained or prevented by the umbrella structures.

As illustrated in FIG. 8C, in the position of the line C-C in FIG. 8, the wiring hole 192A and the wiring hole 116A are provided in both the first wiring storage portion 150A and the first main body portion 111A. A coupling structure between the first wiring storage portion 150A and the first main body portion 111A is similar to that shown in FIG. 8B. The wiring line L passes through the wiring hole 192A from the storage space 152A of the first wiring storage portion 150A and then passes through the wiring hole 116A of the first main body portion 111A. The second main body portion 111B of the second holding member 110B and the second wiring storage portion 150B also have the similar configuration.

According to this configuration, since an umbrella structure is provided in which the attachment portion 191A of the first wiring storage portion 150A overlaps the outer surface of the attachment portion 115A of the first main body portion 111A, an intrusion of plating liquid into the inner space 200 of the substrate holder 11 from an outer surface side of the first holding member 110A can be restrained or prevented. Similarly, since an umbrella structure is provided in which an attachment portion 191B of the second wiring storage portion 150B overlaps the outer surface of the attachment portion 115B of the second main body portion 111B, an intrusion of plating liquid into the inner space 200 of the substrate holder 11 from the outer surface side of the second holding member 110B can be restrained or prevented. That is, the intrusion of plating liquid into the inner space 200 of the substrate holder 11 due to splashing of the plating liquid or the like can be restrained or prevented by the umbrella structures.

As has been described heretofore by reference to FIGS. 8 to 8C, the first main body portion 111A and the first wiring storage portion 150A have the umbrella structure in which a wall portion (the attachment portion) of the first wiring storage portion 150A overlaps a wall portion (the attachment portion) of the first main body portion 111A from the outer side at the coupling portion. This configuration can restrain or prevent plating liquid from intruding into the wiring holes 192A and the wiring holes 116A from the outer surface side of the first holding member 110A, by way of the coupling portion between the first main body portion 111A and the first wiring storage portion 150A and/or the inner space 200. Similarly, the second main body portion 111B and the second wiring storage portion 150B have the umbrella structure in which a wall portion (the attachment portion) of the second wiring storage portion 150B overlaps a wall portion (the attachment portion) of the second main body portion 111B from the outer side at the coupling portion. This configuration can restrain or prevent plating liquid from intruding into the wiring holes 192B and the wiring holes 116B from the outer surface side of the second holding member 110B, by way of the coupling portion between the second main body portion 111B and the second wiring storage portion 150B and/or the inner space 200. According to this configuration, a seal member for sealing up the wiring holes 192 and the wiring holes 116 to protect the wiring lines L from plating liquid can be omitted.

In addition, in this embodiment, the coupling portion between the first main body portion 111A and the first wiring storage portion 150A and the coupling portion between the second main body portion 111B and the second wiring storage portion 150B are disposed so that these coupling portions are positioned above a plating liquid surface S when the substrate holder 11 is disposed in the plating tank 10 (FIGS. 8A to 8C). In other words, the substrate holder 11 is configured so that the plating liquid surface S stays above a holding position of the substrate W and below the coupling portion between the first main body portion 111A and the first wiring storage portion 150A and the coupling portion between the second main body portion 111B and the second wiring storage portion 150B. Thus, the intrusion of plating liquid into the wiring holes 192 and the wiring holes 116 can be restrained or prevented more effectively by the umbrella structures at the coupling portion between the first main body portion 111A and the first wiring storage portion 150A and the coupling portion between the second main body portion 111B and the second wiring storage portion 150B, and by the disposition of the coupling portions away from the plating liquid. According to this configuration, a seal member for sealing up the wiring holes 192 and the wiring holes 116 to protect the wiring lines L from plating liquid can be omitted.

Additionally, in this embodiment, the first and second wiring storage portions 150A, 150B are disposed so that the first and second wiring storage portions 150A, 150B are positioned above the plating liquid surface S when the substrate holder 11 is disposed in the plating tank 10. According to this configuration, since the first and second wiring storage portions 150A, 150B are disposed above a space where puddles are disposed close to both the sides of the substrate holder 11, a limitation is hardly imposed on the thickness-wise dimensions of the first and second wiring storage portions 150A, 150B.

Figure 9A:
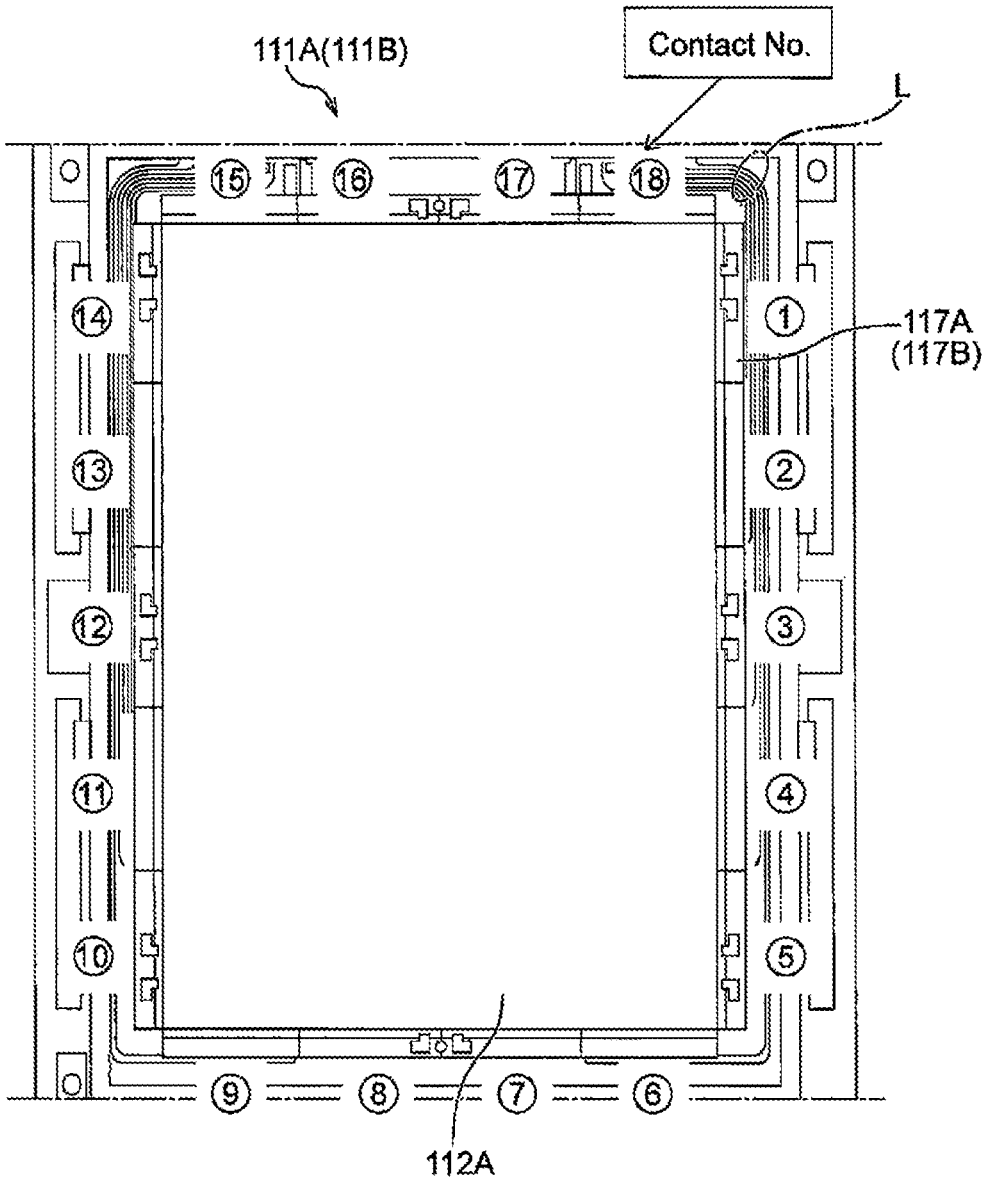
FIG. 9A is a front view of the first holding member as seen from an inner surface side thereof.
Figure 9B:
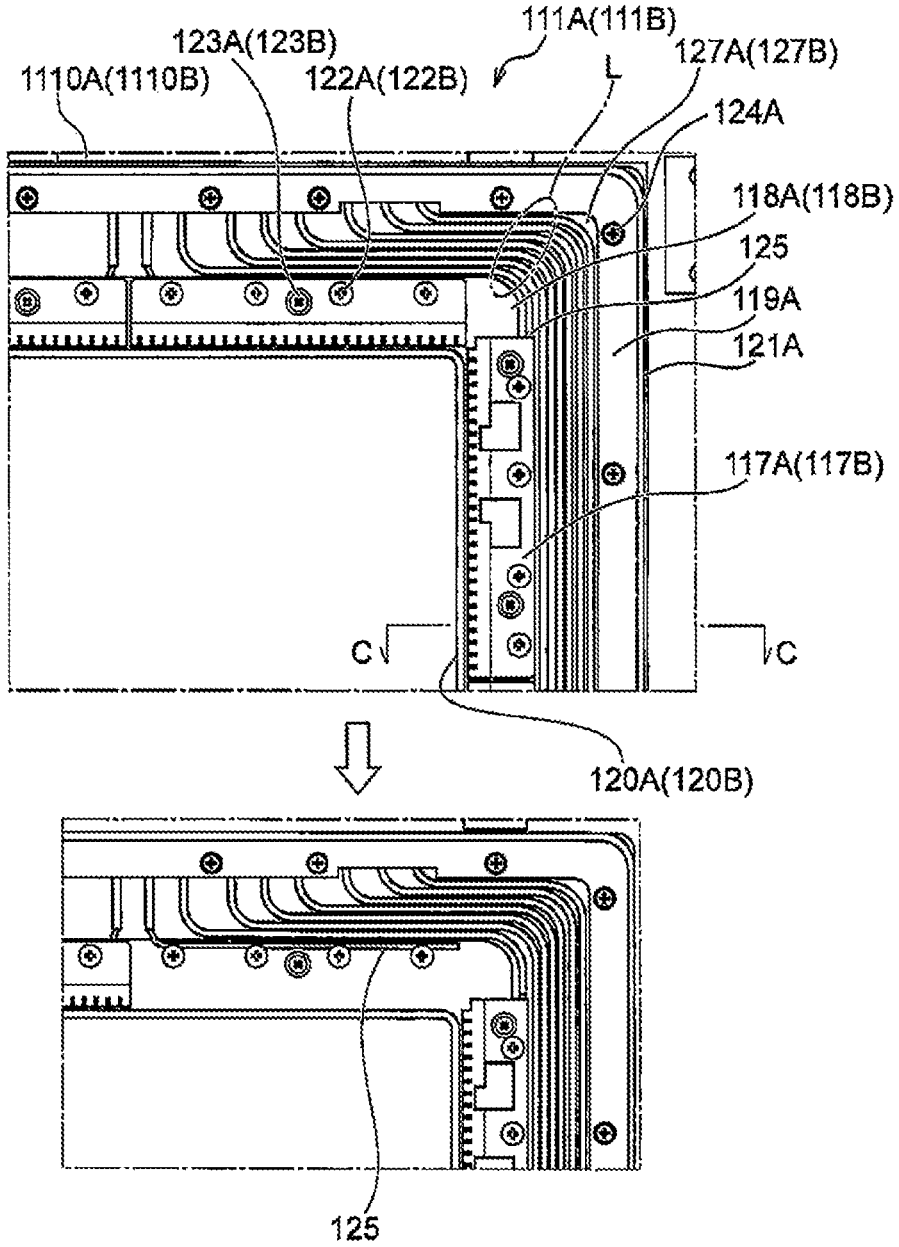
FIG. 9B is a partially enlarged front view of the first holding member as seen from the inner surface side thereof.
Figure 9C:
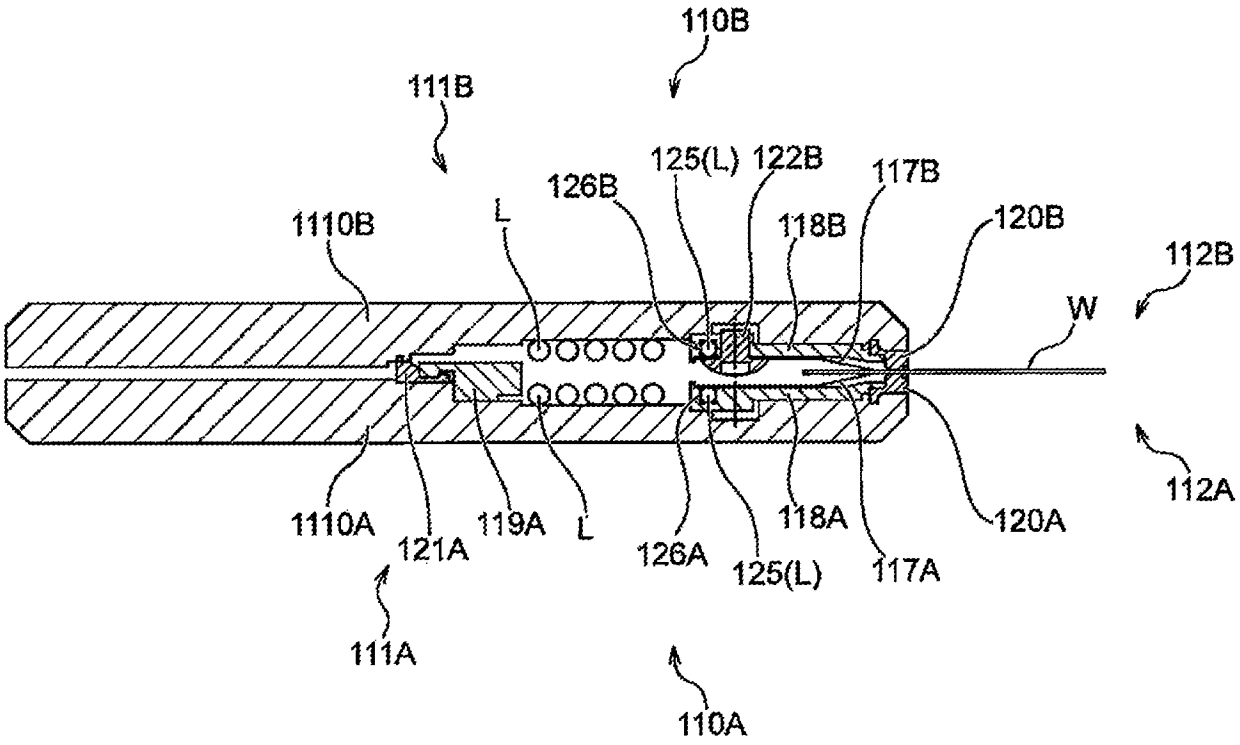
FIG. 9C is a cross-sectional view taken along a line C-C in FIG. 9B, illustrating the second holding member together with the first holding member.

FIG. 9A is a front view of the first holding member as seen from an inner surface side thereof. FIG. 9B is a partially enlarged front view of the first holding member as seen from the inner surface side thereof. FIG. 9C is a cross-sectional view taken along a line C-C in FIG. 9B, illustrating the second holding member together with the first holding member.

In FIGS. 9A, 9B, a description will be made by reference to the first holding member 110A as an example. Similar description will be made for the second holding member 110B excluding a configuration in which the second holding member 110B has no outer seal. As illustrated in FIG. 9A, the first holding member 110A has a plurality of substrate contacts 117A on a circumference of the first opening portion 112A. In this embodiment, although a case is illustrated in which 18 substrate contacts 117A are provided, an arbitrary number of substrate contacts can be provided according to the dimensions of the substrate W, the magnitude of plating current, and the like. Each substrate contact 117A is connected to the external connection portion 161A (FIG. 3A) by each wiring line L.

As illustrated in FIG. 9B, the first main body portion 111A includes an inner seal 120A, a seal holder 118A for attaching the inner seal 120A, an outer seal 121A, and a seal holder 119A for attaching the outer seal 121A on the inner surface of the first main body 1110A. A wiring path 127A for passage of the wiring lines L is formed between the seal holder 118A and the seal holder 119A. The substrate contacts 117A are fixed to the seal holder 118A with screws 122A on an outer side of the inner seal 120A. The seal holder 118A is fixed to the first main body 1110A with the inner seal 120A held between the seal holder 118A and the first main body 1110A (FIG. 9C). In this embodiment, the seal holder 118A is fixed to the first main body 1110A with screws 123A (FIG. 9B). Holes are provided in the substrate contacts 117A at portions where the screws 123A are disposed, so that the screws 123A are prevented from coming into contact with the substrate contacts 117A. The seal holder 119A is fixed to the first main body 1110A with the outer seal 121A held between the seal holder 119A and the first main body 1110A (FIG. 9C). In this embodiment, the seal holder 119A is fixed to the first main body 1110A with screws 124A (FIG. 9B).

The wiring lines L extend to the vicinities of the corresponding substrate contacts 117A, and coverings at distal ends thereof are removed to expose conductive wires 125 (FIG. 9B). The conductive wire 125 of the wiring line L is introduced into a groove 126A (FIG. 9C) provided on the seal holder 118A, and the conductive wire 125 of the wiring line L and the substrate contact 117A are fastened to the seal holder 118A with a screw 122A (FIG. 9B). This electrically connects the wiring line L to the corresponding substrate contact 117A. FIG. 9C illustrates a portion where a conductive wire 125 of a wiring line L and a substrate contact 117B are fastened to the seal holder 118A with screws 122B on the second main body portion 111B of the second holding member 110B. The second main body portion 111B has a similar configuration to that of the first main body portion 111A as illustrated in FIG. 9C except the feature that the second main body portion 111B does not have an outer seal and a seal holder therefor. An outer seal may be provided on a second main body portion 111B in another embodiment.

As illustrated in FIG. 9C, a space defined between the plating target areas (the sides facing the first and second opening portions) of the substrate W and the inner circumferential side end portions of the first and second main body portions 111A, 111B is sealed up by the inner seal 120. Additionally, a space defined between the first and second main body portions 111A, 111B is sealed up on the outer circumferential side by the outer seal 121A of the first holding member 110A being closely secured to the inner surface of the second main body 1110B of the second holding member 110B. As a result, the internal space between the first and second main body portions 111A, 111B is tightly closed by the inner seals 120A, 120B and the outer seal 121A, whereby the substrate contacts 117, and the cables L are protected from plating liquid.

Figure 10:
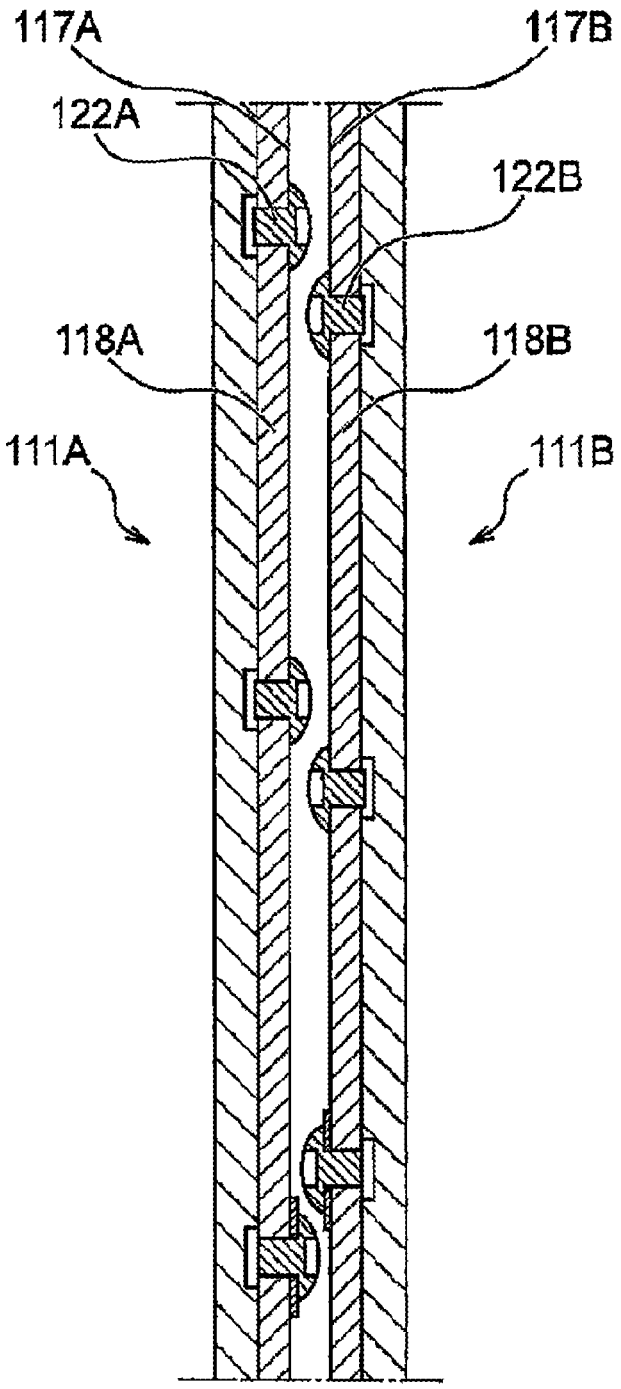
FIG. 10 is a cross-sectional view of the first main body portion and a second main body portion, illustrating an arrangement of screws for fixing substrate contacts.
Figure 11:
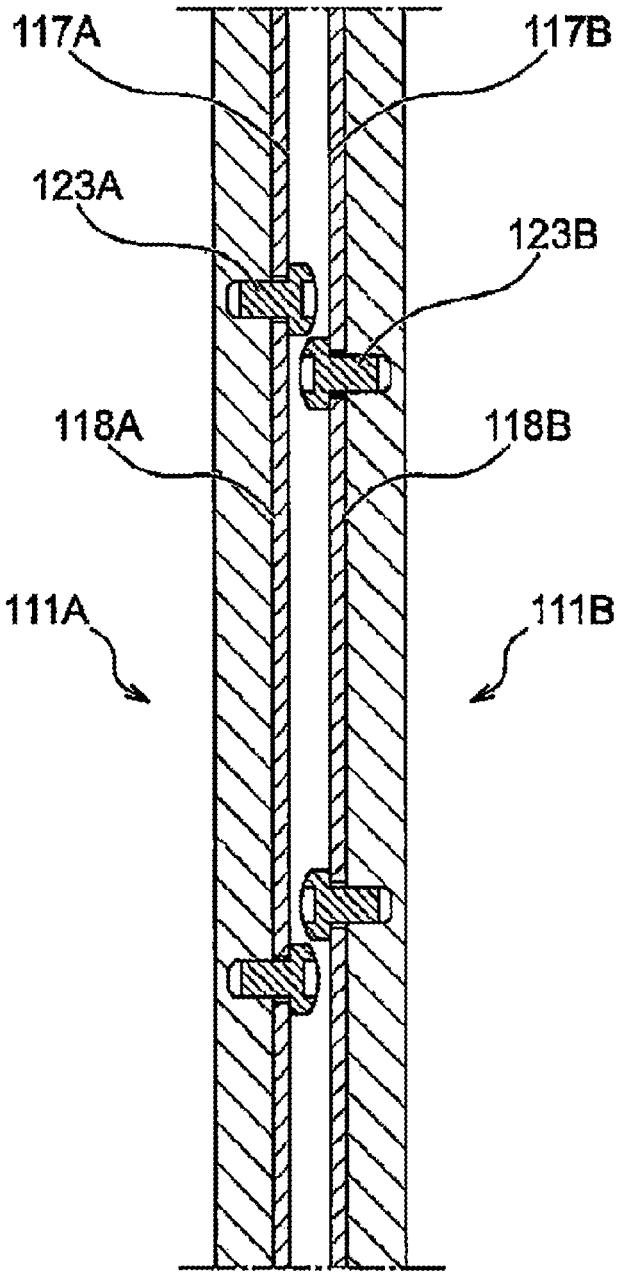
FIG. 11 is a cross-sectional view of the first and second main body portions, illustrating an arrangement of screws for fixing a seal holder for attaching an inner seal.

FIG. 10 is a cross-sectional view of the first and second main body portions, illustrating an arrangement of the screws for fixing the substrate contacts. FIG. 11 is a cross-sectional view of the first and second main body portions, illustrating an arrangement of the screws for fixing the seal holders for attaching the inner seals. As illustrated in FIG. 10, the screws 122A for fixing the substrate contacts 117A and the screws 122B for fixing the substrate contacts 117B are disposed in such a manner as not to overlap each other when the first holding member 110A and the second holding member 110B are brought into engagement with each other. A space that would be defined between the first holding member 110A and the second holding member 110B is reduced to allow them to stay closer to each other by avoiding the interference between the screws 122A of the first holding member 110A and the screws 122B of the second holding member 110B. In addition, as illustrated in FIG. 11, the screws 123A for fixing the seal holder 118A and the screws 123B for fixing the seal holder 118B are disposed in such a manner as not to overlap each other when the first holding member 110A and the second holding member 110B are brought into engagement with each other. The space that would be defined between the first holding member 110A and the second holding member 110B is reduced to allow them to stay closer to each other by avoiding the interference between the screws 123A of the first holding member 110A and the screws 123B of the second holding member 110B. As a result, the space that would be defined between the first holding member 110A and the second holding member 110B is reduced to allow them to stay closer to each other by avoiding the interference between the screws 122A, 123A of the first holding member 110A and the screws 122B, 123B of the second holding member 110B.

Figure 12A:
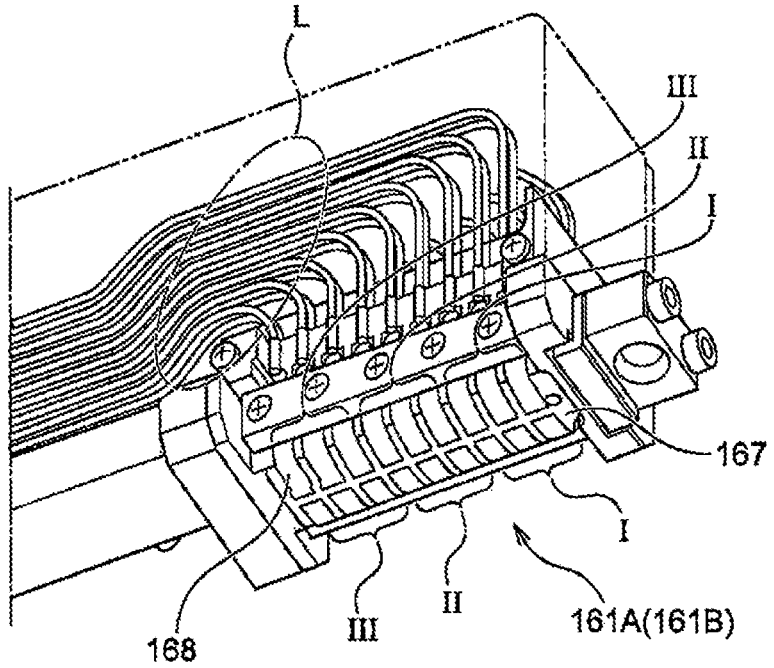
FIG. 12A is an enlarged perspective view of the external connection portion with a wiring cover removed.

FIG. 12A is an enlarged perspective view of the external connection portion with the external connection portion cover removed. Here, although the first external connection portion 161A of the first holding member 110A will be described as an example, the second external connection portion 161B of the second holding member 110B has a similar configuration thereto. The first external connection portion 161A has a number of individual separate external connection contacts 168 that corresponds to the number of substrate contacts 117A of the first holding member 110A. In this embodiment, the 18 substrate contacts 117A are disposed into two rows each made up of 9 substrate contacts 117A. In the following description, in FIG. 12A, a near side of a sheet of paper on which FIG. 12A is drawn denotes an inner side of the substrate holder, while a far side of the sheet of paper denotes an outer side of the substrate holder. In the first external connection portion 161A, a bus bar 167 is provided on inner sides of the substrate contacts 117A. The external connection contacts 168 are connected to the corresponding substrate contacts 117A by the individual separate wiring lines L, and the external connection contacts 168 and the substrate contacts 117A are electrically isolated from each other. In confirming energization, as illustrated in FIG. 12D, contacts 230 of an energization confirmation device 169 are electrically connected with the external connection contacts 168 such that the contacts 230 are brought individually into abutment with the corresponding external connection contacts 168. In applying a plating treatment, as will be described later, the external connection contacts 168 are electrically short-circuited from each other, whereby the same potential is supplied (FIG. 12E). In another embodiment, two or more wiring lines L may be connected to one external connection contact 168, and the other ends of the two or more wiring lines may be connected individually to different substrate contacts 117A. Alternatively, a plurality of external connection contacts 168 may be connected to a plurality of wiring lines L, and the wiring lines L may be connected to a single substrate contact.

Figure 12B:
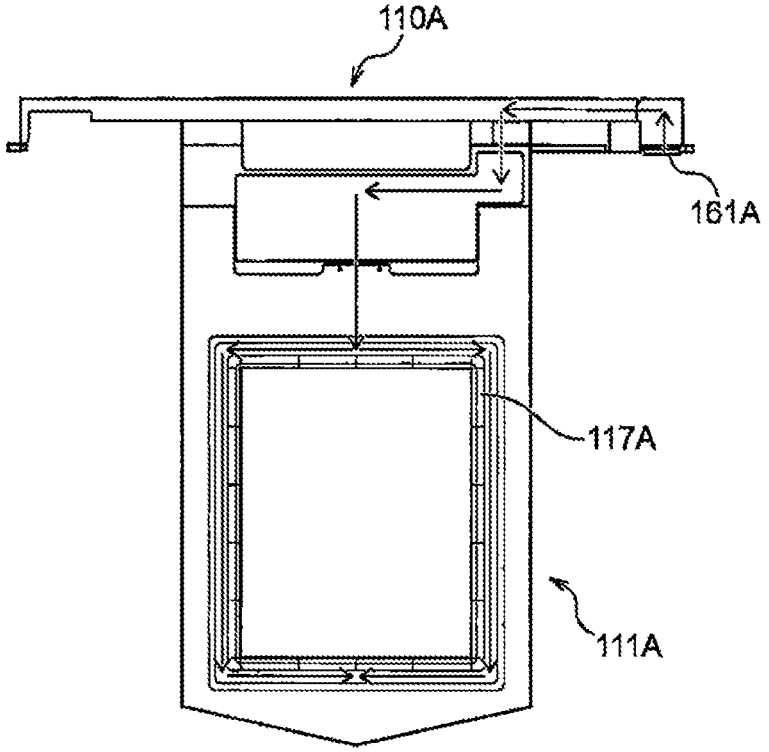
FIG. 12B is an explanatory diagram of an electric current path on the first holding member.
Figure 12C:
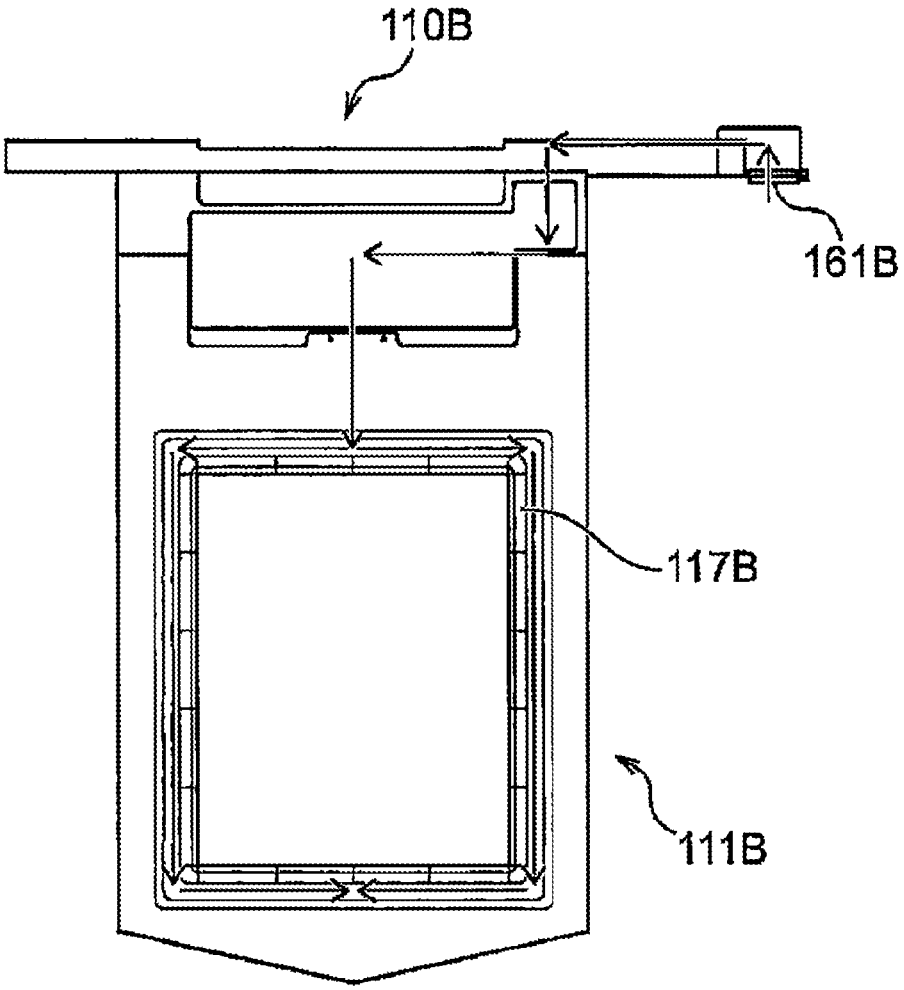
FIG. 12C is an explanatory diagram of an electric current path on the second holding member.
Figure 12D:
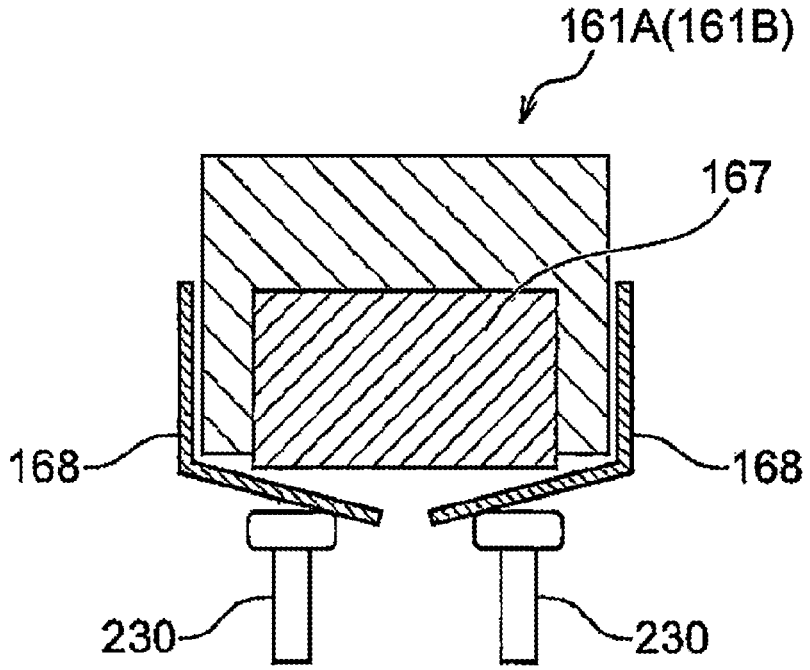
FIG. 12D is a schematic diagram illustrating connections of contacts at the external connection portion when confirming energization.
Figure 12E:
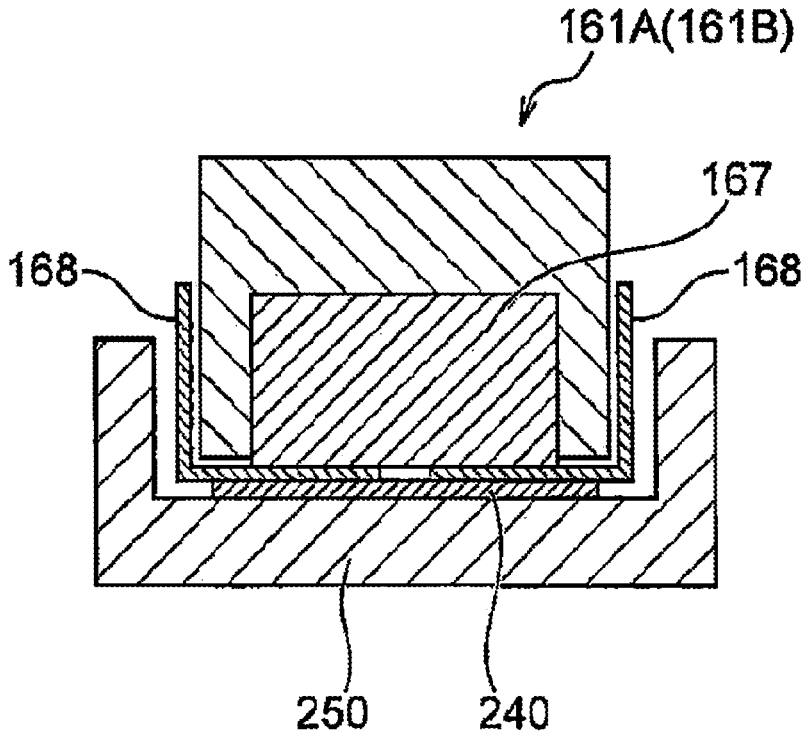
FIG. 12E is a schematic diagram illustrating a connection of contacts of the external connection portion when a plating treatment is applied.

FIG. 12B is an explanatory diagram of an electric current path on the first holding member. FIG. 12C is an explanatory diagram of an electric current path on the second holding member. In the first holding member 110A, an electric current is supplied from the individual external connection contacts 168 of the first external connection portion 161A to the individual corresponding substrate contacts 117A through a path indicted by arrows (FIG. 12B). In the second holding member 110B, an electric current is supplied from the individual external connection contacts 168 of the second external connection portion 161B to the individual corresponding substrate contacts 117B through a path indicted by arrows (FIG. 12C). In applying a plating treatment, a common potential is supplied to the external connection contacts 168 and the substrate contacts 117A, 117B of the first holding member 110A and the second holding member 110B, and in confirming energization, different potentials are supplied to some or the whole of the external connection contacts 168.

FIG. 12D is a schematic diagram illustrating a connection at each contact of the external connection portion when confirming energization. An energization confirmation process is executed with the substrate W sandwiched in the substrate holder 11 on the substrate setting section 170B (FIG. 1). The terminals 230 of the energization confirmation device 169 are disposed on the substrate setting section 170B. In this embodiment, the external connection portion 161A has the two rows of 9 aligned external connection contacts 168 (FIG. 12A). The energization confirmation process is executed with the individual external connection contacts 168 of the external connection portion 161A prevented from contacting the bus bar 167 but staying in contact with the terminals 230 of the energization confirmation device 169 (FIG. 12D). The individual terminals 230 of the energization confirmation device 169 can supply separate potentials to the corresponding external connection contacts 168, whereby an electric current between any two external connection contacts 168 can be measured. Additionally, a certain number of external connection contacts 168 can be put into groups, so that an electric current between the external connection contacts 168 can be measured group by group.

For example, as illustrated in FIG. 12A, three external connection contacts on each of the rows facing each other are put into a group, so that the nine external connection contacts on each row are grouped into three groups I, II, III for execution of the energization confirmation process. In one example, a potential difference is applied between the terminals 230 connected to the three external connection contacts 168 on the near-side row and the terminals 230 connected to the three external connection contacts 168 on the far-side row in the group I to measure an electric current. Next, a potential difference is applied between the terminals 230 connected to the three external connection contacts 168 on the near-side row and the terminals 230 connected to the three external connection contacts 168 on the far-side row in the group II to measure an electric current. Next, a potential difference is applied between the terminals 230 connected to the three external connection contacts 168 on the near-side row and the terminals 230 connected to the three external connection contacts 168 on the far-side row in the group III to measure an electric current.

Assuming that a high potential is applied to the terminals 230 on the near side, while a low potential is applied to the terminals 230 on the far side, for example, in the group I, the electric current flows along a path extending from the terminals 230 on the near side to the terminals 230 by way of the three external connection contacts 168 on the near side row in the group I, the wiring lines L connected to these three contacts, the substrate contacts 117A connected to these wiring lines L, the seed layer on the first surface (the front surface) of the substrate W, the substrate contacts 117A connected to the terminals 230 on the far side, the wiring lines L, and the three external connection contacts 168 on the far side. Similarly, an electric current flowing between the external connection contacts 168 on the first side and the second side in the other two groups II, III is measured. As a result, in case the measured values of electric current are within a predetermined range, determining that the external connection contacts 168 of the external connection portion 161A, the wiring lines L, the substrate contacts 117A, and the substrate W are all normal, the substrate holder 11 is transported to the processing section 170C (FIG. 1), where a plating treatment is applied to the substrate W. On the other hand, in case the measured values of electric current are out of the predetermined range, determining that an abnormal condition is occurring in any one of the external connection contacts 168 of the external connection portion 161A, the wiring lines L, the substrate contacts 117A, and the substrate W, the substrate W is taken out of the substrate holder 11, and the substrate holder 11 is returned to the holder storage section 170D (FIG. 1).

The number of external connection contacts included in each group is arbitrary, and the number of external connection contacts may differ from group to group. In addition, a potential difference may be applied between the external connection contacts 168 on the near side or the far side to measure an electric current. Additionally, the number of external connection contacts included in each group may be set to two, so that an electric current between is measured for each of pairs of external connection contacts 168. A portion where an abnormal condition is occurring is easily identified by measuring an electric current between the external connection contacts 168 group by group.

A similar energization confirmation device 169 is also provided on the second external connection portion 161B of the second holding member 110B, and a similar energization confirmation process is executed on the second surface (the rear surface) of the substrate W.

FIG. 12E is a schematic diagram illustrating a connection at each contact of the external connection portion when a plating treatment is applied. The substrate holder 11 is held in the plating tank 10 by the arm portion 160 being received in an arm receiving portion 250 of the plating tank 10. One arm receiving portion 250 is disposed on each side of the plating tank, so that the arm receiving portions 250 support the arm portion 160 at both ends thereof, whereby the substrate holder 11 can be suspended in the plating tank 10. An electric current supply portion 240 is disposed on the arm receiving portion 250, and the external connection portions 161A, 161B are placed on the electric current supply portions 240. At this time, the external connection contacts 168 are pressed against the electric current supply portions 240 by virtue of their own weights of the first and second external connection portions 161A, 161B or by means of an additional actuator and the like, whereby the external connection contacts 168 are deformed so as to be brought into contact with the bus bar 167. As a result, all the external connection contacts 168 are electrically short-circuited by the electric current supply portions 240 and the bus bars 167. In this state, when a potential is supplied to the electric current supply portions 240 from an external power supply 37 (FIG. 15), the same potential is supplied to all the external connection contacts 168. In applying a plating treatment, the electric current flows along a path originating from the external power supply 37 and terminating at the external power supply 37 by passing through the anode 31A (31B), plating liquid, the seed layer on the front surface (the rear surface) of the substrate W, the substrate contact 117A (117B), the wiring lines L and the external connection contacts 168 of the first and second connection portions 161A (161B). The bus bar 167 are provided to ensure a short circuit between the external connection contacts 168. Different electric currents can also be caused to flow to the electric current supply portions 240 to which the first external connection portion 161A connected and the electric current supply portions 240 to which the second external connection portion 161B connected.

Figure 13A:
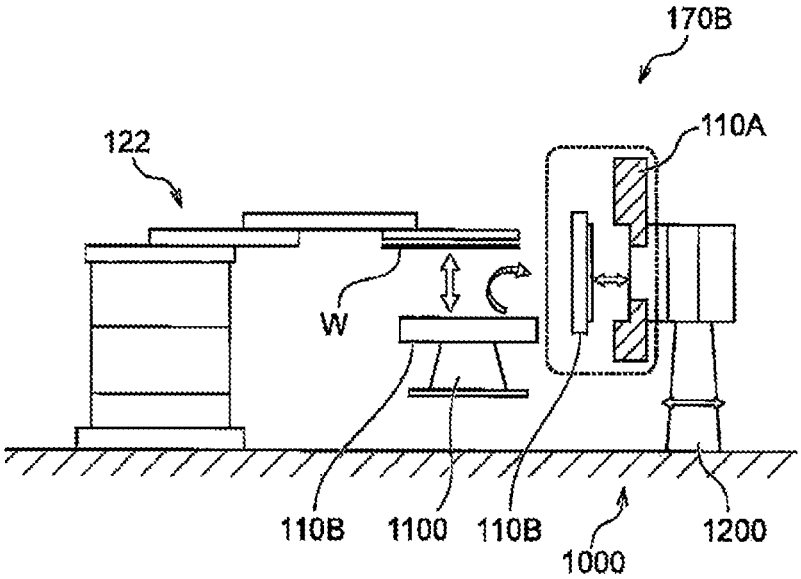
FIG. 13A is a schematic diagram explaining setting of a substrate to the substrate holder in a substrate setting section.

FIG. 13A is a schematic diagram explaining setting of a substrate to a substrate holder at the substrate setting section. In FIG. 13A, the configurations including the first holding member 110A and the second holding member 110B are illustrated schematically. A substrate attaching/detaching device 1000 is disposed on the substrate setting section 170B (FIG. 1). The substrate attaching/detaching device 1000 includes a turning device 1100 and a station 1200. The turning device 1100 attaches and detaches a substrate W to and from the second holding member 110B or rests the substrate W on the second holding member 110B with the second holding member 110B of the substrate holder 11 held in a substantially horizontal direction. The turning device 1100 sandwiches the substrate W between the second holding member 110B and the first holding member 110A which are held on the station 1200, with the second holding member 110B erected substantially in a vertical direction. As a result, the substrate W can be attached to and detached from the substrate holder 11. The station 1200 may be made up, for example, of a stationary station configured to suspend the substrate holder 11 and a support device configured to support the substrate holder 11 held on the stationary station while directing it towards the turning device 1100. The energization confirmation device described above can be provided at a portion on the station 1200 where the arm portion 160 and the first and second external connection portions 161A, 161B of the substrate holder 11 are placed, for example.

Before a substrate is installed thereon, the substrate holder 11 is separated into the first holding member 110A and the second holding member 110B, the first holding member 110A is disposed on the station 1200 while being erected, and the second holding member 110B is disposed on the stage of the turning device 1100 in a substantially horizontal state. In this state, the substrate W held by a robot hand of the transport device 122 is set on the second holding member 110B on the turning device 1100. Thereafter, the stage of the turning device turns to move the second holding member 110B into a substantially vertical state, and in this state, the first holding member 110A and the second holding member 110B are brought into engagement (fixation) with (to) each other by pressing the second holding member 110B against the first holding member, whereby the substrate W is held by the first holding member 110A and the second holding member 110B. In this state, the energization confirmation process is executed. In the case where the result of the energization confirmation process is good, the substrate holder 11 holding the substrate W is transported to the processing section 170C (FIG. 1) by the transporter 141 to be plated. In the case where the result of the energization confirmation process is not good, the substrate W is taken out from the substrate holder 11, and the substrate holder 11 is returned to the holder storage section 170D (FIG. 1).

When the substrate W is removed from the substrate holder 11, at the station 1200 the second holding member 110B is removed together with the substrate W from the first holding member 110A by the turning device 1100. Thereafter, as shown in FIG. 13A, the second holding member 110B is turned into a substantially horizontal posture, and the substrate W is taken out using the robot hand of the transport device 122.

Here, although the first holding member 110A and the second holding member 110B are described as being brought into engagement with each other while they are erected, the first holding member 110A and the second holding member 110B may be brought into engagement with each other while they are rested in a horizontal state.

Figure 13B:
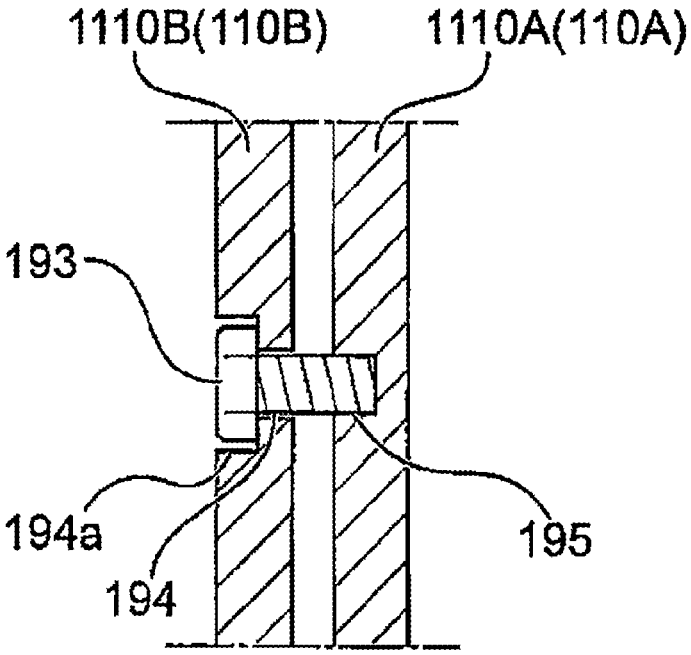
FIG. 13B illustrates one example of a substrate holder fixing method.

FIG. 13B illustrates an example of a fixing method of a substrate holder. The first holding member 110A and the second holding member 110B can be fixed together using an arbitrary fixing method. For example, as illustrated in FIG. 13B, the first holding member 110A and the second holding member 110B can be fixed together with a fastening device such as a bolt. In this example, a screw hole 195 is provided in the first main body 1110A of the first holding member 110A, a through hole 194 is provided in the second main body 1110B of the second holding member 110B, and the first holding member 110A and the second holding member 110B are fastened together with a bolt 193. In this example, a counterbore 194*a* is provided on the through hole 194, so that a head of the bolt 193 is disposed within the counterbore 194*a*. As a result, the thickness of the substrate holder 11 can be reduced. The first holding member 110A and the second holding member 110B are configured to be fixed together with bolts 193 as required at a plurality of locations. In addition, a clamp may be provided on either of the first holding member 110A and the second holding member 110B, so that the first holding member 110A and the second holding member 110B can be fixed together. Even though either of the fixing methods is used, a method can also be used together in which an actuator or the like is provided on the substrate attaching/detaching device 1000 to fix the first holding member 110A and the second holding member 110B together automatically.

Figure 14A:
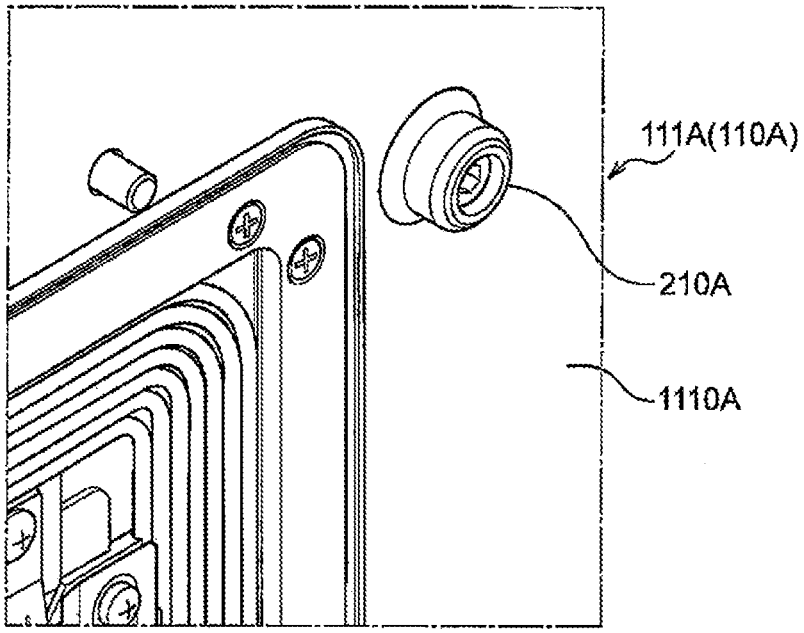
FIG. 14A is an enlarged perspective view of the vicinity of a positioning portion of the first holding member.
Figure 14B:
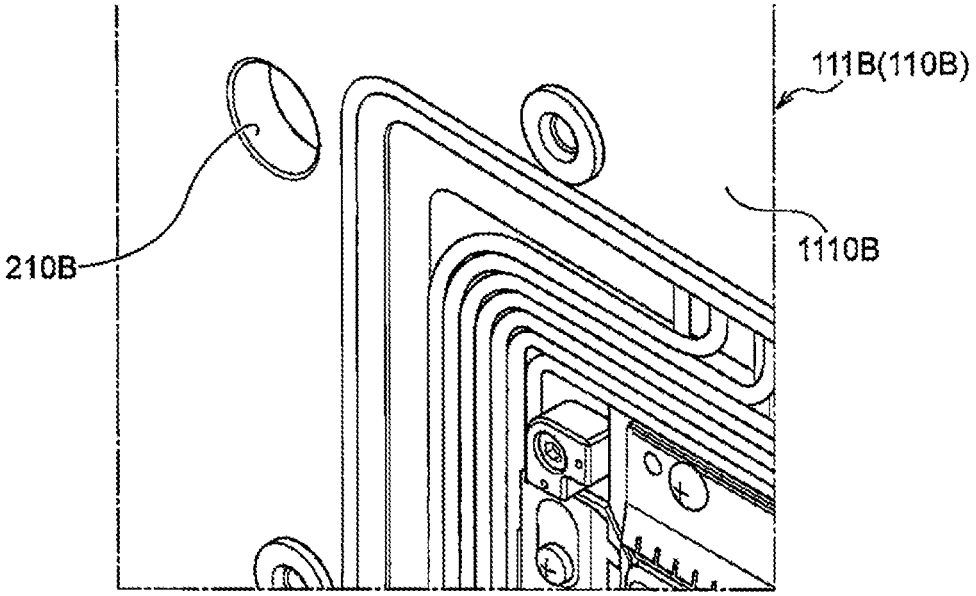
FIG. 14B is an enlarged perspective view of the vicinity of a positioning portion of the second holding member.

FIG. 14A is an enlarged perspective view of the vicinity of a positioning portion of the first holding member. FIG. 14B is an enlarged perspective view of a positioning portion of the second holding member. The first holding member 110A has a projecting portion (a positioning pin) 210A as a positioning portion on the first main body 1110A of the first main body portion 111A. The second holding member 110B has a through hole 210B as a positioning portion on the second main body 1110B of the second main body portion 111B. The projecting portion 210A is fixed to the first main body 1110A with a fastening member such as a bolt or the like. The projecting portion 210A may be fixed to the first main body portion 111A with other fixing devices or may be formed integrally with the first main body 1110A. As to the projecting portion 210A and the through hole 210B, a plurality of projecting portions 210A and a plurality of through holes 210B are provided on the first main body portion 111A and the second main body portion 111B, respectively, and the individual projecting portions 210A are inserted and fitted individually into the corresponding through holes 210B when the first holding member 110A and the second holding member 110B are brought into engagement with each other. As a result, the first holding member 110A and the second holding member 110B are positioned relative to each other. The through holes 210B may be provided on the first holding member 110A, and the projecting portions 210A may be provided on the second holding member 110B.

Figure 15:
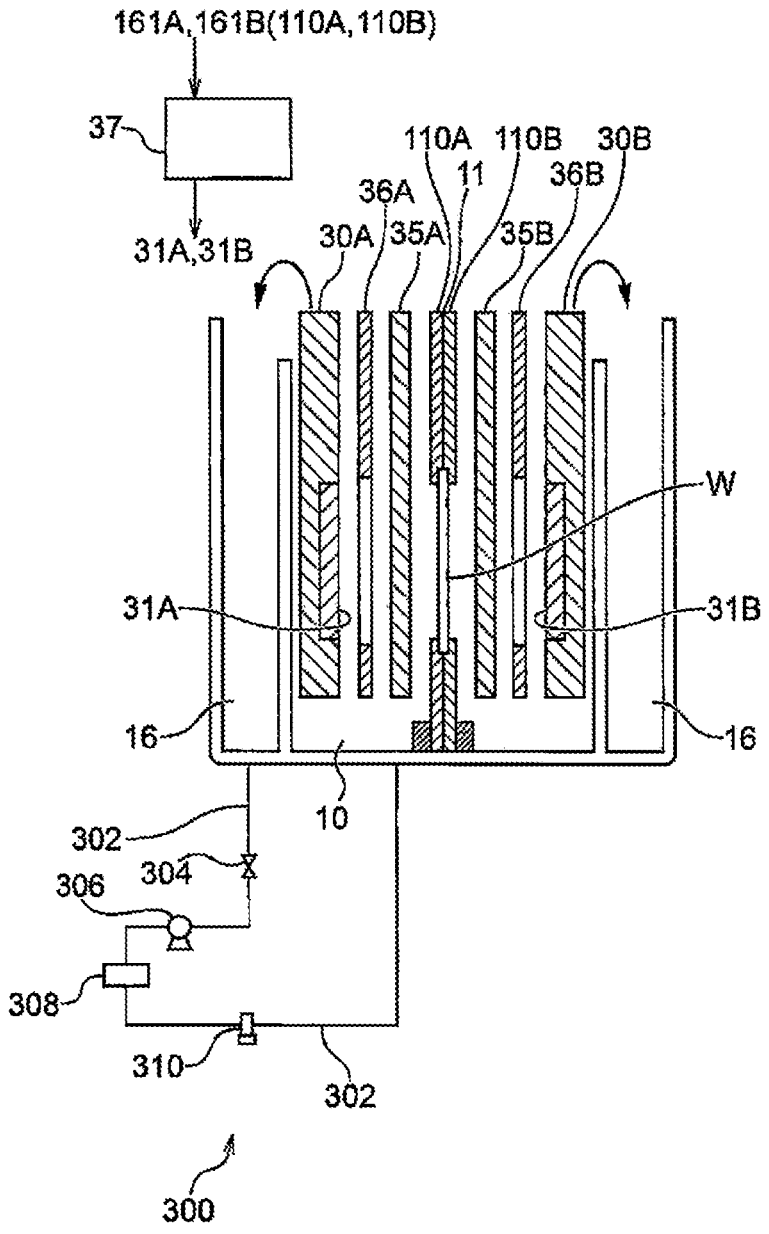
FIG. 15 is a side view illustrating schematically a configuration of a plating tank.

FIG. 15 is a side view illustrating schematically the configuration of the plating tank 10. During plating, a first anode holder 30A is disposed in such a manner as to face the first surface (the front surface) of the substrate W, and a second anode holder 30B is disposed in such a manner as to face the second surface (the rear surface) of the substrate W. The first anode holder 30A has an anode mask (not shown) for adjusting an electric field between a first anode 31A and the substrate W. The anode mask is substantially a plate-like member made, for example, from a dielectric material and is disposed on a surface of the first anode holder 30A that faces the substrate holder 11. The anode mask has an opening for passage of an electric current flowing between the first anode 31A and the substrate W at a substantially central portion, and a diameter or side length of the opening is preferably smaller than a diameter or side length of the first anode 31A. In addition, the anode mask may be configured in such a manner that the diameter or side length of the opening can be adjusted. For example, a plurality of diaphragm vanes are provided on the opening, whereby the diameter of side length of the opening can be expanded or contracted by a similar structure to an aperture diaphragm mechanism of a camera. The configuration of the second anode holder 30B is also similar to the configuration of the first anode holder 30A.

A first intermediate mask 36A is provided between the first anode holder 30A and the substrate holder 11. In addition, a second intermediate mask 36B is provided between the second anode holder 30B and the substrate holder 11. The first and second intermediate masks 36A, 36B adjust diameters or side lengths of openings provided in the first and second intermediate masks 36A, 36B by similar structures to those of first and second anode masks 32A, 32B so as to adjust electric fields between the first and second anodes 31A, 31B and the substrate W. As an embodiment, a moving mechanism is coupled to each of the first intermediate mask 36A and the second intermediate mask 36B so that a distance between the substrate W and the first intermediate mask 36A and a distance between the substrate W and the second intermediate mask 36B may be made to change. In the case where an insoluble anode is adopted, since plating liquid needs to be replenished with plating metal continuously, a replenishment mechanism of plating metal can be provided on a circulation mechanism, which will be described later.

A first paddle 35A for stirring plating liquid in the vicinity of the first surface of the substrate W is provided between the first anode holder 30A and the substrate holder 11. In addition, a second paddle 35B for stirring plating liquid in the vicinity of a plating target surface of the substrate W is provided between the second anode holder 30B and the substrate holder 11. These paddles 35A, 35B can be, for example, substantially rod-like members and can be provided in the plating tank in such a manner as to be directed in a vertical direction. The paddles 35A, 35B are configured to translate along the plating target surface of the substrate W by means of a drive device, not shown. In addition, the paddles 35A, 35B may be such that a plurality of vertical slits are provided on a plate-like member.

The first anode 31A is connected to the external power supply 37 by way of wiring inside the first anode holder 30A. As has been descried before, the first external connection portion 161A of the first holding member 110A from which the first surface (the front surface) of the substrate W in the substrate holder 11 is exposed is connected to the external power supply 37. When a voltage is supplied from the external power supply 37 to between the first anode 31A and the first external connection portion 161A of the substrate holder 11, a plating electric current flows along a path originating from the external power supply 37 and terminating at the external power supply 37 by passing through the first anode 31A, plating liquid, the seed layer on the first surface of the substrate W in the substrate holder 11, and the first external connection portion 161A (the first holding member 110A). The second anode 31B is connected to the external power supply 37 by way of wiring inside the second anode holder 30B. As has been descried before, the second external connection portion 161B of the second holding member 110B from which the second surface (the rear surface) of the substrate W in the substrate holder 11 is exposed is connected to the external power supply 37. When a voltage is supplied from the external power supply 37 to between the second anode 31B and the second external connection portion 161B of the substrate holder 11, a plating electric current flows along a path originating from the external power supply 37 and terminating at the external power supply 37 by passing through the second anode 31B, plating liquid, the seed layer on the second surface of the substrate W in the substrate holder 11, and the second external connection portion 161B (the second holding member 110B).

The plating system according to the embodiment illustrated in FIG. 15 includes a circulation mechanism 300 for circulating plating liquid between the plating tank 10 and an external tank 16. The circulation mechanism 300 includes a circulation line 302 configured to connect the plating tank 10 and the external tank 16 for receiving plating liquid overflowing from the plating tank 10. A valve 304 is provided on the circulation line 302, so as to open and close the circulation line 302. The valve 304 can be a solenoid valve, for example, and the opening and closing of the circulation line 302 may be controlled by the control unit 103 (refer to FIG. 1). A pump 306 is provided on the circulation line 302, whereby plating liquid can be circulated from the external tank 16 to the plating tank 10 by way of the circulation line 302 by the pump 306. A temperature control device 308 is provided on the circulation line 302, whereby plating liquid flowing through the circulation line 302 can be controlled in temperature. For example, a thermometer, not shown, is provided in the plating tank 10, and the temperature control device 308 may be controlled by the control unit 103 according to a plating liquid temperature measured by the thermometer. A filter 310 is provided in the circulation line 302 to thereby remove solid matters in the plating liquid flowing through the circulation line 302.

In this embodiment, the first external connection portion 161A and the second external connection portion 161B, which are independent of each other, are provided on the first holding member 110A and the second holding member 110B, respectively. As a result, the electric current path for the first surface of the substrate W that is made up of the first external connection portion 161A, the wiring lines L, and substrate contacts 117A and the electric current path for the second surface of the substrate W that is made up of the second external connection portion 161B, the wiring lines L, and the substrate contacts 117B can be divided on the first and second holding members 110A, 110B. As a result, the space for installing the electric current supply paths on the first surface and the second surface of the substrate can be ensured while restraining the thickness of the substrate holder from being increased. This configuration is effective when the number of wiring lines is increased by the dimensions of a substrate, the diameter of the wiring line is increased by the magnitude of electric current, or the like. In the case of a substrate which is plated on both surfaces, compared with a substrate which is plated on one surface, the number of wiring lines generally becomes double, and hence, the configuration is particularly effective. In addition, since an electric current can be supplied independently to the first surface and the second surface of the substrate, a plating specification such as a plating thickness on each surface of the substrate can be controlled independently.

While the substrate holder is described above as being the substrate holder for the substrate which is plated on both surfaces thereof, also, in a substrate holder for a substrate which is plated on one surface, the first external connection portion and the second external connection portion, which are independent of each other, may be provided on the first holding member and the second holding member, respectively. In case a connection path configured to connect the electric current paths provided individually on the first holding member and the second holding member is provided, an electric current can be supplied to a plating target surface from both the first and second external connection portions of the first and second holding members. In this case, a space for installing the electric current supply path can be ensured by dividing the electric current path for the first surface of the substrate on the first and second holding members. This configuration is also effective on the substrate holder for the substrate which is plated on one surface thereof when the number of wiring lines and the diameter of the wiring line are increased by the dimensions of a substrate, the magnitude of electric current, or the like.

Another Embodiment

Figure 17:
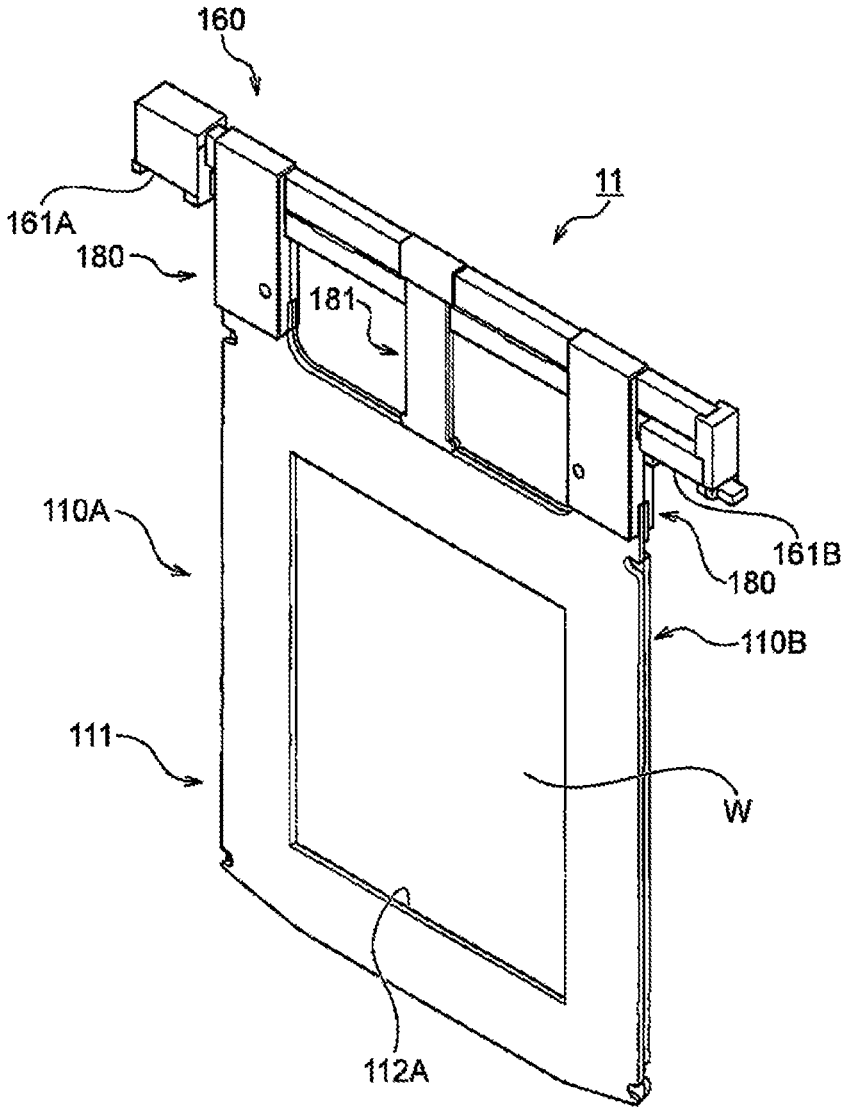
FIG. 17 is a perspective view of a substrate holder according to another embodiment as seen from a first side.
Figure 18:
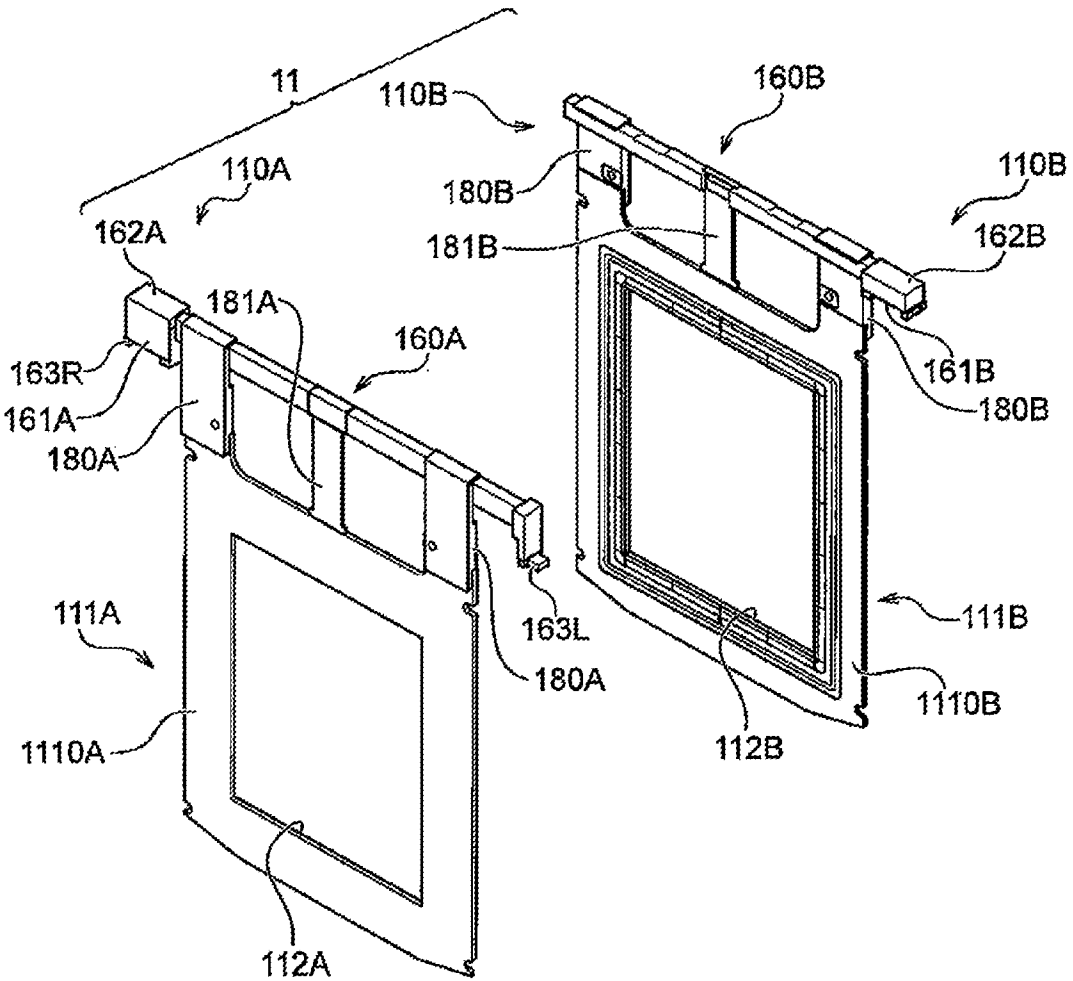
FIG. 18 is a perspective view of a first holding member and a second holding member as seen from a first side with the substrate holder disengaged.
Figure 19:
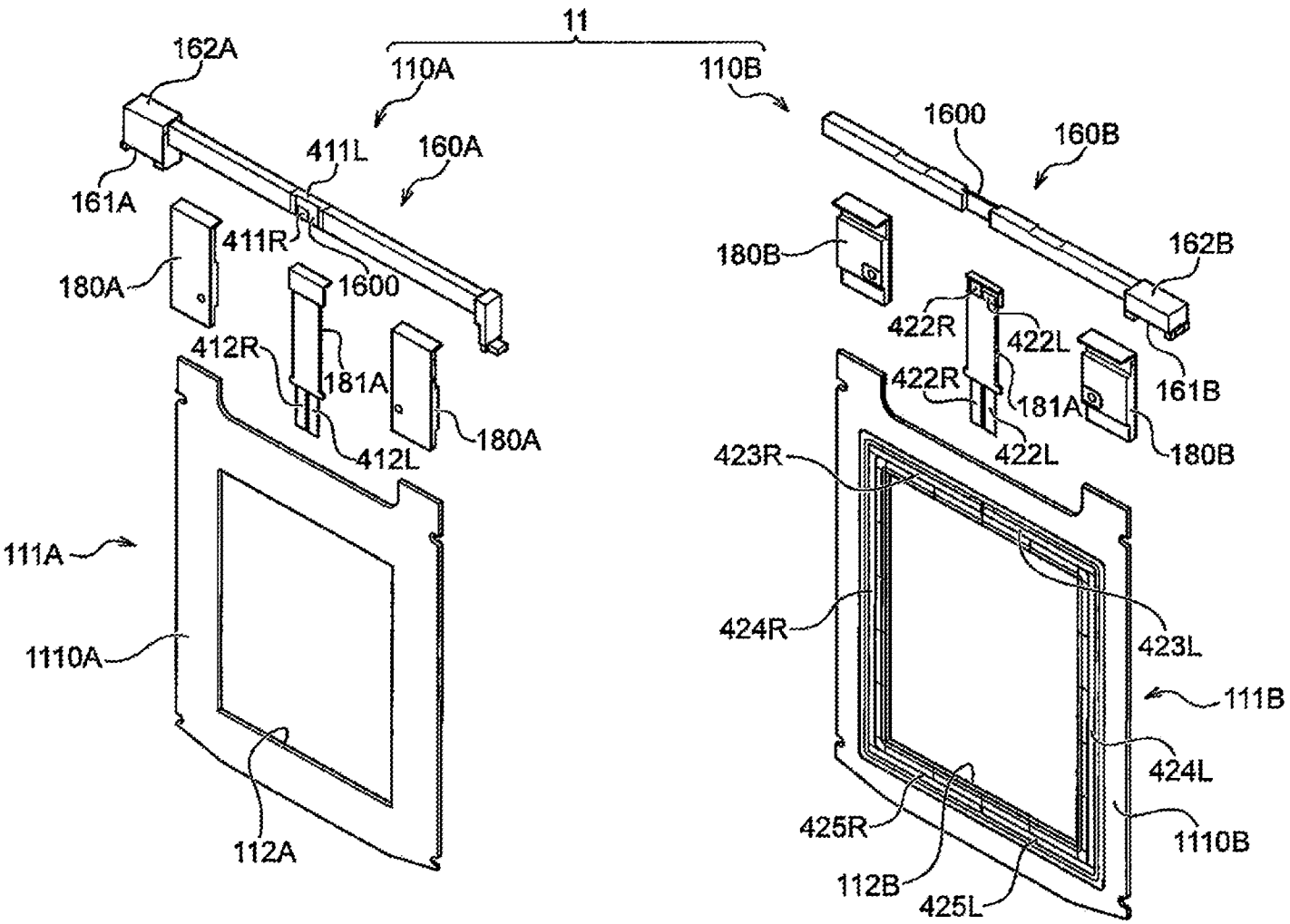
FIG. 19 is an exploded perspective view of the first holding member and the second holding member of the substrate holder.

FIG. 17 is a perspective view of a substrate holder according to another embodiment as seen from a first side. FIG. 18 is a perspective view of a first holding member and a second holding member as seen from the first side with the substrate holder disengaged. FIG. 19 is an exploded perspective view of the first holding member and the second holding member of the substrate holder.

A substrate holder 11 according to another embodiment has a generally similar configuration to that of the substrate holder that is described by reference to FIG. 2A and the like, and hence, like reference signs will be given to like configurations, and a detailed description thereof will be omitted here. In this embodiment, in place of the wiring lines L made up of the cables, a plurality of substrate contacts 117 are connected with external connection contacts 440 by conductive path portions 410, 420 (refer to FIG. 20) which each have a greater cross-sectional area than that of the wiring line L. As a result, the wiring storage portion 150 (the first wiring storage portion 150A, the second wiring storage portion 150B) can be omitted to thereby realize a reduction in size and production cost of a substrate holder. When this configuration according to the other embodiment is applied to a substrate holder for a substrate which is plated on one side, the conductive path portion may be provided on either of the first holding member and the second holding member.

As illustrated in FIGS. 17, 18, the substrate holder 11 includes a main body portion 111, left and right attachment portions 180, a central attachment portion 181, and arm portion 160. The substrate holder 11 is divided into a first holding member 110A having a first opening portion 112A and a second holding member 110B having a second opening portion 112B. The first holding member 110A includes a first main body portion 111A, left and right attachment portions 180A, a central attachment portion 181A, and a first arm portion 160A (FIGS. 18, 19). The second holding member 110B includes a second main body portion 111B, left and right attachment portions 180B, a central attachment portion 181B, and a second arm portion 160B (FIGS. 18, 19).

The first main body portion 111A is attached to the first arm portion 160A by the left and right attachment portions 180A, the central attachment portion 181A between the left and right attachment portions 180A. The left and right attachment portions 180A and the central attachment portion 181A are fixed to the first main body portion 111A and the first arm portion 160A, respectively, with fastening devices such as bolts or the like, whereby the first main body portion 111A is fixed to the first arm portion 160A.

The first arm portion 160A includes a thin elongated plate-like member or a rod-like member. The first arm portion 160A has an external connection portion 161A and an external connection portion cover 162A configured to protect the external connection portion 161A and the conductive path portion 410. In addition, similar to what has been described before, the first arm portion 160A has positioning portions 163R, 163L at both end portions thereof by which the substrate holder 11 is positioned on a substrate setting section 170B and in a plating tank 10.

The second holding member 110B includes a second main body portion 111B, left and right attachment portions 180B, a central attachment portion 181B, and a second arm portion 160B (FIGS. 18, 19). Since the configurations of the second main body portion 111B and the attachment portions 180B, 181B are similar to the configurations of the attachment portions 180A, 181A and the first main body portion 111A, a detailed description thereof will be omitted here, and like reference numerals and an alphabet character of B are added to the like configurations.

The second arm portion 160B includes a thin elongated plate-like member or a rod-like member. The second arm portion 160B has an external connection portion 161B and an external connection portion cover 162B configured to protect the external connection portion 161B and the conductive path portion 420. Similar to the embodiment that has been described before, the first and second external connection portions 161A, 161B of the first and second arm portions 160A, 160B are disposed at opposite sides of the substrate holder 11 in a left-right direction so that the first and second external connection portions 161A, 161B do not interfere with each other when the first arm portion 160A and the second arm portion 160B are brought into engagement with each other.

Figure 20:
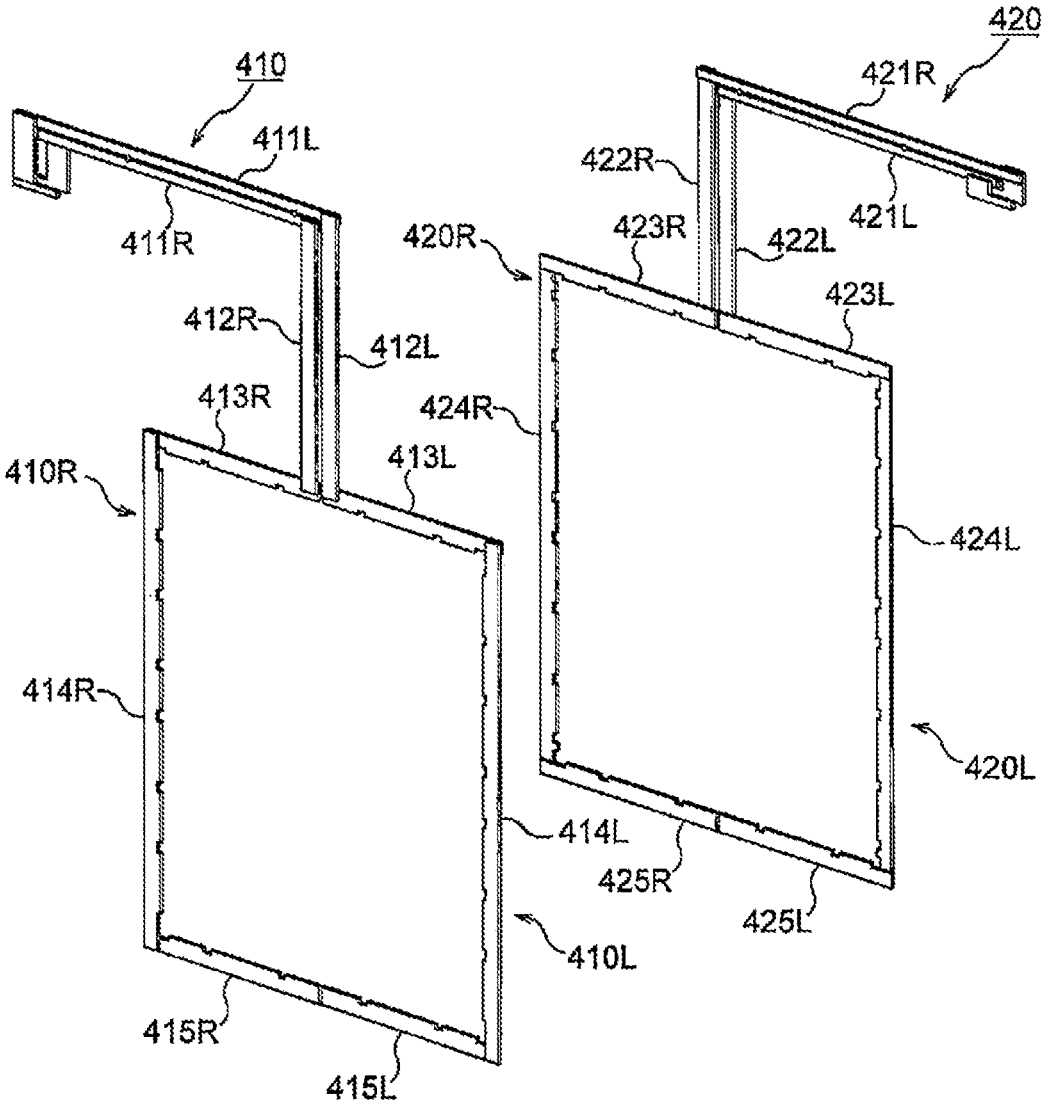
FIG. 20 is a perspective view of a conductive path portion according to the other embodiment.
Figure 21:
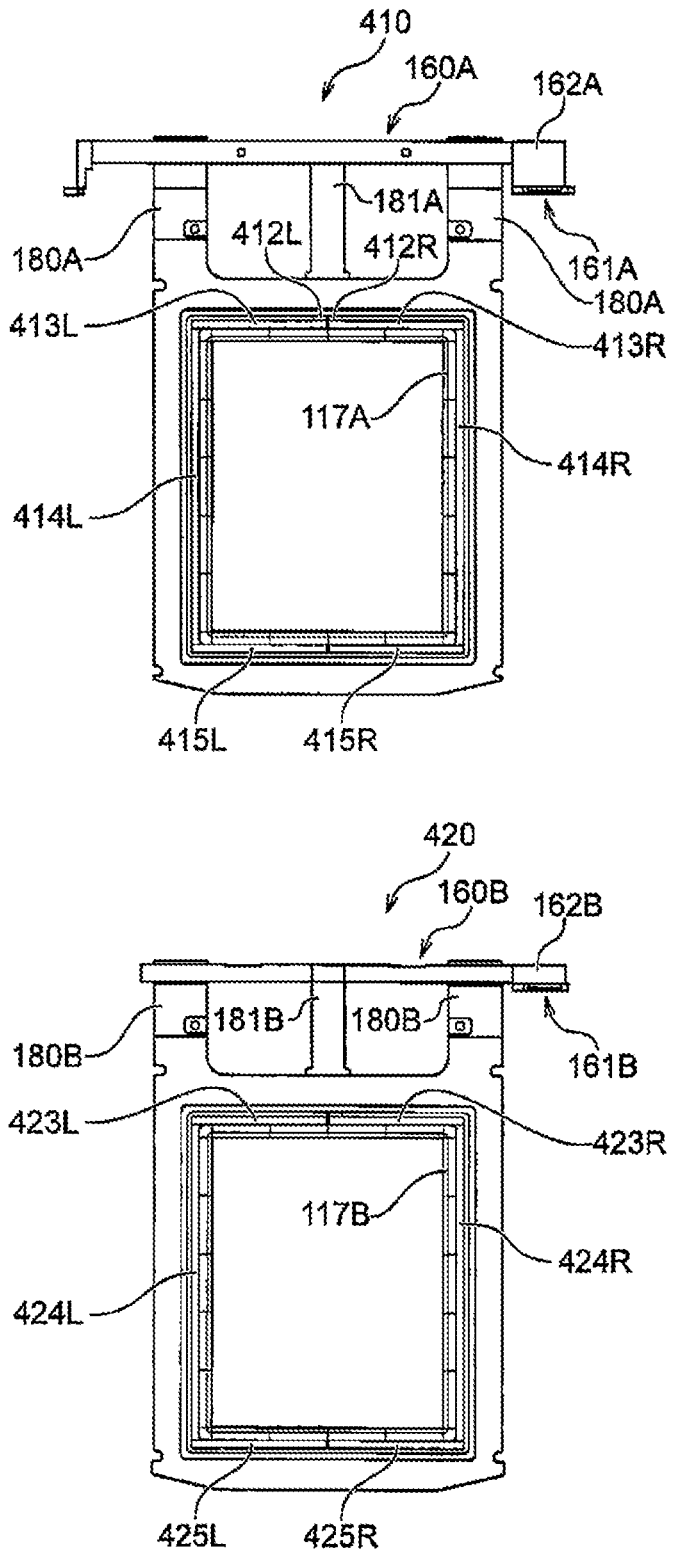
FIG. 21 is an arrow diagram of the first holding member and the second holding member as seen from a substrate holding surface side.

FIG. 20 is a perspective view of conductive path portions according to the other embodiment. FIG. 21 is an arrow diagram of the first holding member and the second holding member as seen from a substrate holding surface side. In FIG. 20, reference numeral 410 denotes a conductive path portion disposed on the first holding member 110A, and reference numeral 420 denotes a conductive path portion disposed on the second holding member 110B. Here, although the conductive path portion 410 (the conductive path portion 420) is described as including two systems of a left conductive path member 410L (420L) and a right conductive path member 410R (420R), the conductive path portion 410 may be a conductive path member of one system made up of an integral or multiple path pieces.

The conductive path portions 410, 420 are made of a material having a small resistance value such as copper (for example, oxygen-free copper). In this embodiment, as illustrated in FIG. 20, the conductive path portions 410, 420 are each formed of a plate-like member. By forming the conductive path portions 410, 420 of the plate-like material, an increase in thickness of the substrate holder can be restrained. The conductive path portions 410, 420 may be formed of a rod-like member so as to be easily worked to extend along the path. The conductive path portions 410, 420 may be coated with a chemical-resistant resin (for example, PFA) excluding contacts or conductive portions with other wiring lines.

Since the conductive path portion 410 and the conductive path portion 420 have similar configurations, hereinafter, the conductive path portion 410 will be described as representing the conductive path portion 420.

The conductive path portion 410 includes the left conductive path member 410L and the right conductive path member 410R. The left conductive path member 410L and the right conductive path member 410R are spaced apart from each other within the first holding member 110A and are electrically isolated. In other embodiments, the left conductive path member 410L and the right conductive path member 410R may be short-circuited each other within the first holding member 110A or may be formed as an integral member.

The left conductive path member 410L and the right conductive path member 410R are each made up of a plurality of path pieces (here, five path pieces) which are connected together. The left conductive path member 410L and the right conductive path member 410R may each be formed integral, may be made up of less than five connected path pieces, or may be made up of six or more connected path pieces.

The left conductive path member 410L includes a first path piece 411L, a second path piece 412L, a third path piece 413L, a fourth path piece 414L, and a fifth path piece 415L and is formed by connecting these five path pieces together. The right conductive path member 410R includes a first path piece 411R, a second path piece 412R, a third path piece 413R, a fourth path piece 414R, and a fifth path piece 415R and is formed by connecting these five path pieces together.

The first path piece 411L and the second path piece 412L of the left conductive path member 410L and the first path piece 411R and the second path piece 412R of the right conductive path member 410R extend parallel while being spaced apart from each other. The third path piece 413L, the fourth path piece 414L and the fifth path piece 415L of the left conductive path member 410L are disposed on a left half portion of the first main body portion 111A (FIG. 21). The third path piece 413R, the fourth path piece 414R and the fifth path piece 415R of the right conductive path member 410R are disposed on a right half portion of the first main body portion 111A (FIG. 21). The fifth path piece 415R of the right conductive path member 410R is spaced apart from the fifth path piece 415L of the left conductive path member 410L with a gap defined therebetween, as illustrated in FIG. 21. In this way, by forming the divided conductive path members by the right conductive path member 410R and the left conductive path member 410L, when a substrate is held by the substrate holder 11 on a substrate attaching/detaching section 170B (FIG. 1), an energization test can be enabled in which something abnormal is determined to be occurring in the substrate holder 11 or the substrate when an abnormal resistance value is obtained by applying a potential difference to between the right conductive path member 410R and the left conductive path member 410L, causing an electric current to flow along a path extending in the order of the left conductive path member 410L→the substrate (a seed layer) →the right conductive path member 410R (or in an opposite order).

The first path piece 411L is disposed in such a manner as to extend within a main body of the first arm portion 160A in FIG. 18 from the external connection portion 161A to a coupling portion between the first arm portion 160A and the central attachment portion 181A. FIG. 19 illustrates a state in which one end of the first path piece 411L is exposed into an interior of an attachment recessed portion 1600 provided on the first arm portion 160A. The other end of the first path piece 411L is connected to an external connection contact 440L (FIG. 24) in the external connection portion 161A.

The second path piece 412L is disposed in the central attachment portion 181A in such a manner as to extend through an interior of the attachment portion 181A, as illustrated in FIG. 19. One end of the second path piece 412L that faces the first arm portion 160A is exposed at one end portion of the attachment portion 181A (similar to the second path piece 422R in FIG. 19) and is brought into contact with one end of the first path piece 411L disposed within the first arm portion 160A for electrical connection with the first path piece 411L when the one end portion of the attachment portion 181A is fitted in the attachment recessed portion 1600 of the first arm portion 160A. In fixing the attachment portion 181A to the first arm portion 160A with a fastening device such as a bolt or the like, the first path piece 411L and the second path piece 412L are also bolted to be fixed together. The other end of the second path piece 412L projects from the other end portion of the attachment portion 181A and is inserted into an opening provided in the first main body 1110A for connection with one end of the third path piece 413L when the attachment portion 181A is attached to the first main body portion 111A (FIG. 21). The second path piece 412L and the third path piece 413L are also fixed together with a fastening device such as a screw, a bolt, or the like (similar to a connection of the third path piece 413R and the fourth path piece 414R in FIGS. 22A, 22B).

The third path piece 413L, the fourth path piece 414L, and the fifth path piece 415L are disposed on a left half portion on a substrate holding surface side of the first main body 1110A of the first main body portion 111A, as illustrated in FIG. 21. The third path piece 413L is provided along an upper side of the first opening portion 112A on a side lying closer to the first arm portion 160A. On end of the third path piece 413L is connected to the other end of the second path piece 412L in the vicinity of a central portion of the first holding member 110A. The other end of the third path piece 413L is connected to one end of the fourth path piece 414L with a screw 416 in the vicinity of an upper corner portion of the first opening portion 112A (similar to a connection of the third path piece 413R with the fourth path piece 414R in FIGS. 22A, 22B). The fourth path piece 414L is provided along a left side of the first opening portion 112A in such a manner as to extend from a side lying closer to the first arm portion 160A towards a side lying far away from the first arm portion 160A. The other end of the fourth path piece 414L is connected to one end of the fifth path piece 415L with a fastening device such as a screw or the like in the vicinity of a lower corner of the first opening portion 112A (similar to a connection of the third path piece 413R with the fourth path piece 414R in FIGS. 22A, 22B). The fifth path piece 415L is provided along a lower side of the first opening portion 112A on the side lying far away from the first arm portion 160A. The other end of the fifth path piece 415L terminates in the vicinity of the central portion of the first holding member 110A while being spaced apart from the fifth path piece 415R.

The path pieces 411R to 415R of the right conductive path member 410R are disposed in a generally similar manner to the manner in which the path pieces 411L to 415L of the left conductive path member 410L are disposed. However, the third path piece 413R, the fourth path piece 414R, and the fifth path piece 415R are disposed on an opposite side (a right half portion) to the side where the third path piece 413L, the fourth path piece 414L, and the fifth path piece 415L of the left conductive path member 410L are disposed with respect to the first opening portion 112A.

The first path piece 411R is disposed in such a manner as to extend within the main body of the first arm portion 160A in FIG. 18 from the external connection portion 161A to a coupling portion between the main body of the first arm portion 160A and the central attachment portion 181A. FIG. 19 illustrates a state in which one end of the first path piece 411R is exposed into an interior of the attachment recessed portion 1600 provided on the first arm portion 160A. The other end of the first path piece 411R is connected to an external connection contact 440R (FIG. 24) in the external connection portion 161A.

The second path piece 412R is disposed in the central attachment portion 181A in such a manner as to extend through an interior of the attachment portion 181A, as illustrated in FIG. 19. One end of the second path piece 412R that faces the first arm portion 160A is exposed at one end portion of the attachment portion 181A (similar to the second path piece 422L in FIG. 19) and is brought into contact with one end of the first path piece 411R disposed within the first arm portion 160A for electrical connection with the first path piece 411R when the one end portion of the attachment portion 181A is fitted in the attachment recessed portion 1600 of the first arm portion 160A. In fixing the attachment portion 181A to the first arm portion 160A with a fastening device such as a bolt or the like, the first path piece 411R and the second path piece 412R are also bolted to be fixed together. The other end of the second path piece 412R projects from the other end portion of the attachment portion 181A and is inserted into an opening provided in the first main body 1110A for connection with one end of the third path piece 413L when the attachment portion 181A is attached to the first main body portion 111A (FIG. 21). The second path piece 412R and the third path piece 413R are also fixed together with a fastening device such as a screw, a bolt, or the like (similar to a connection of the third path piece 413R and the fourth path piece 414R in FIGS. 22A, 22B).

The third path piece 413R, the fourth path piece 414R, and the fifth path piece 415R are disposed on a right half portion on the substrate holding surface side of the first main body 1110A of the first main body portion 111A, as illustrated in FIG. 21. The third path piece 413R is provided along an upper side of the first opening portion 112A on a side lying closer to the first arm portion 160A. One end of the third path piece 413R is connected to the other end of the second path piece 412R in the vicinity of a central portion of the first holding member 110A. The other end of the third path piece 413R is connected to one end of the fourth path piece 414R with a screw 416 in the vicinity of an upper corner portion of the first opening portion 112A (similar to a connection of the third path piece 413R with the fourth path piece 414R in FIGS. 22A, 22B). The fourth path piece 414R is provided along a right side of the first opening portion 112A in such a manner as to extend from a side lying closer to the first arm portion 160A towards a side lying far away from the first arm portion 160A. The other end of the fourth path piece 414R is connected to one end of the fifth path piece 415R with a fastening device such as a screw or the like in the vicinity of a lower corner of the first opening portion 112A (similar to a connection of the third path piece 413R with the fourth path piece 414R in FIGS. 22A, 22B). The fifth path piece 415R is provided along a lower side of the first opening portion 112A on the side lying far away from the first arm portion 160A. The other end of the fifth path piece 415R terminates in the vicinity of the central portion of the first holding member 110A while being spaced apart from the fifth path piece 415L.

As has been described heretofore, the first arm portion 160A, the attachment portion 181A, and the first main body portion 111A are assembled together after the first path pieces 411L, R are incorporated within the first arm portion 160A, the second path pieces 412L, R are incorporated within the attachment portion 181A, and the third to fifth path pieces 413L, R, 414L, R, 415L, R are incorporated within the first main body portion 111A. Due to this, the conductive path members can easily be formed.

Since the configuration of the conductive path portion 420 is generally similar to that of the conductive path portion 410, reference numerals 410, 411 for the conductive path portion 410 are replaced by 420, 421, respectively, to denote the corresponding configurations, and a detailed description thereof will be omitted here. The path pieces of the left conductive path member 420L and the right conductive path member 420R are disposed similar to the path pieces of the left conductive path member 410L and the right conductive path member 410R of the conductive path portion 410 from the external connection portion 161B to the second main body 1110B of the second main body portion 110B within the second holding member 110B (refer to FIGS. 19, 21, 22A, 22B, 24, 25).

Figure 22A:
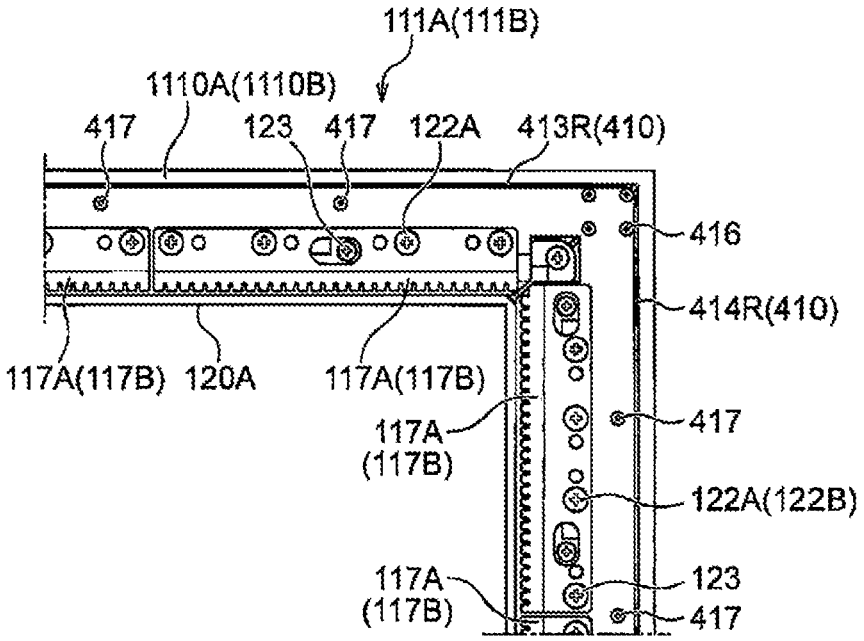
FIG. 22A is an enlarged view of the vicinity of a substrate contact of the substrate holder.
Figure 22B:
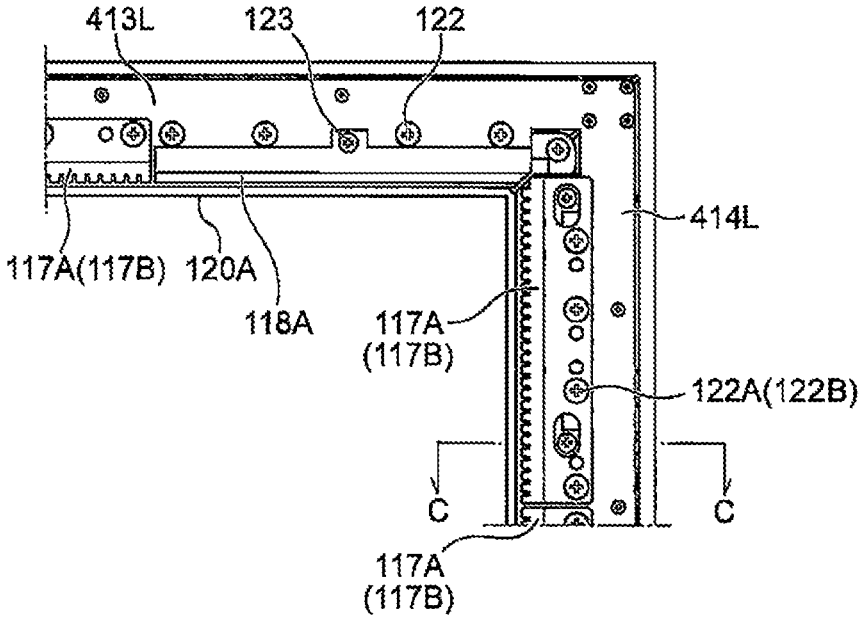
FIG. 22B is an enlarged view of the vicinity of the substrate contact of the substrate holder with some substrate contacts removed.
Figure 23:
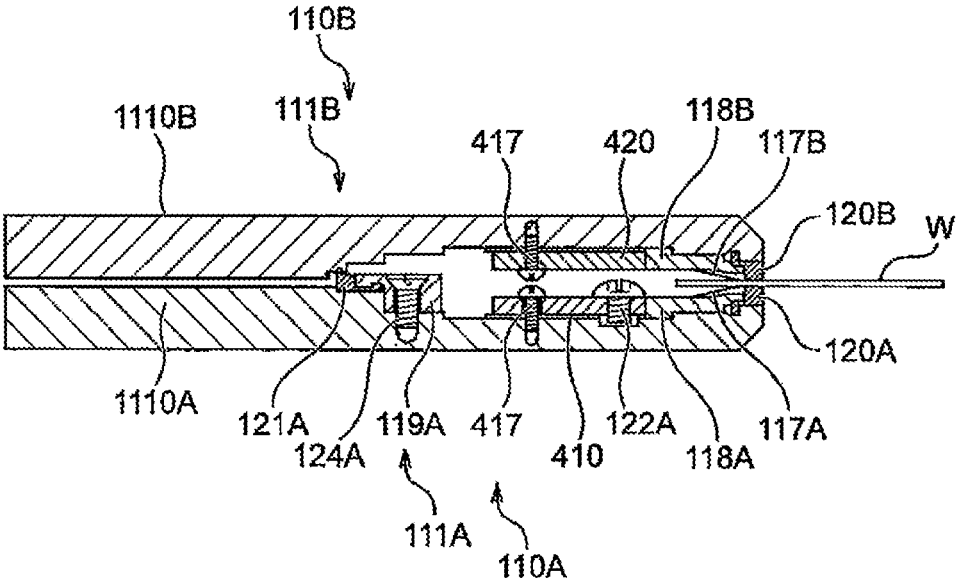
FIG. 23 is a cross-sectional view taken along a line C-C in FIG. 22B, illustrating the second holding member together with the first holding member.

FIG. 22A is an enlarged view of the vicinity of the substrate contacts of the substrate holder. FIG. 22B is an enlarged view of the vicinity of the substrate contacts of the substrate holder with some substrate contacts removed. FIG. 23 is a cross-sectional view taken along a line C-C in FIG. 22B, illustrating the second holding member together with the first holding member.

As illustrated in FIG. 23, the conductive path portion 410 and the conductive path portion 420 are disposed within a space that is tightly closed by inner seals 120A, 120B and an outer seal 121A. A seal holder 118A for fixing the inner seal 120A is fixed to the first main body 1110A with screws 123 (FIG. 22A).

As illustrated in FIGS. 22A and 22B, the path pieces 413R, 414R of the conductive path portion 410 are fixed to the first main body 1110A with screws 416 with end portions thereof superposed on each other and are fixed to the first main body 1110A with screws 417 at the other portions. The screws 417 are disposed at uniform intervals along a longitudinal direction of each path piece to thereby press against the path pieces uniformly along the longitudinal direction. That is, the path pieces can be replaced individually by removing the screws 416, 417. For example, in case a leakage of treatment liquid occurs in the substrate holder 11, there exists a portion tending to be easily affected by the treatment liquid depending on the posture of the substrate holder 11 within the treatment tank. In the case where the substrate holder is disposed in the plating tank with the substrate holder kept in an erected posture, in case a leakage of treatment liquid occurs, the treatment liquid tends to be accumulated in the vicinity of a lowermost portion of the substrate holder. Due to this, in the case where such a leakage of treatment liquid occurs, and the treatment liquid comes into contact only with the path piece in the vicinity of the lowermost portion of the substrate holder, in place of replacing the whole of the conductive path portions 410, 420 (or the individual conductive path members 410L, 410R, 420L, 420R), only the path piece which is in contact with the treatment liquid can be replaced. Compared with a case where the whole of the substrate holder, or the whole of the conductive path portion (or the individual conductive path members), the involved costs can be reduced.

In addition, the plurality of substrate contacts 117A are connected to the right conductive path member 410R of the conductive path portion 410 with screws 122A. That is, the individual substrate contacts 117A can be replaced separately from the conductive path portion 410 by removing the screws 122A. The substrate holder can be used continuously by replacing some of the substrate contacts, whereby costs involved in the maintenance or replacement of the substrate holder can be reduced. For example, when a leakage of treatment liquid occurs, by replacing only part of the substrate contacts such as the substrate contact tending to be easily be brought into contact with the treatment liquid (for example, the example of the lowermost portion of the substrate holder described above) depending on the posture of the substrate holder 11 in the treatment tank, compared with the case where the whole of the substrate holder 11 or the whole of the substrate contacts is replaced, the involved costs can be reduced.

Here, while the right conductive path member 410R of the conductive path portion 410 has been described, the left conductive path member 410L of the conductive path portion 410, the right conductive path member 420R and the left conductive path member 420L of the conductive path portion 420 are also similarly disposed.

Figure 24:
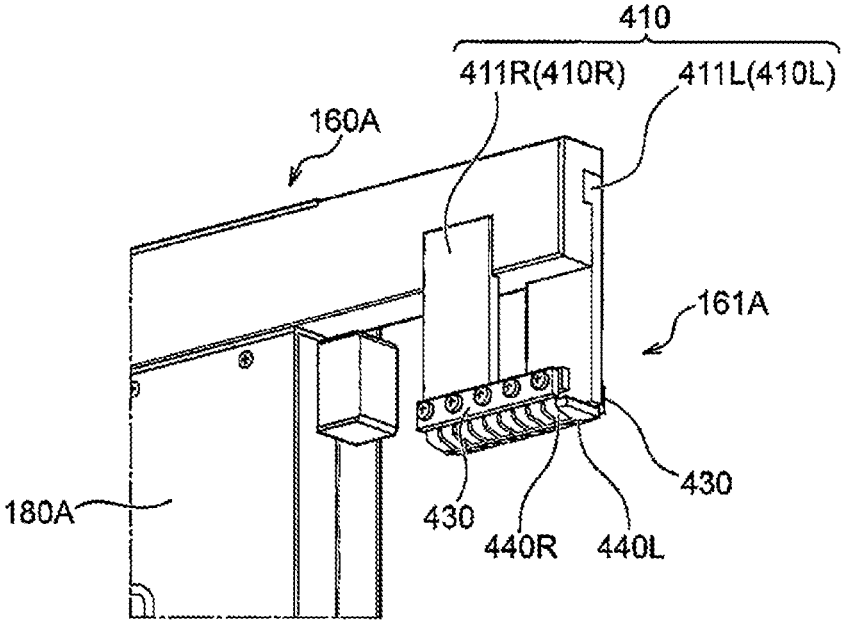
FIG. 24 is an enlarged perspective view of an external connection portion with an external connection portion cover removed.
Figure 25:
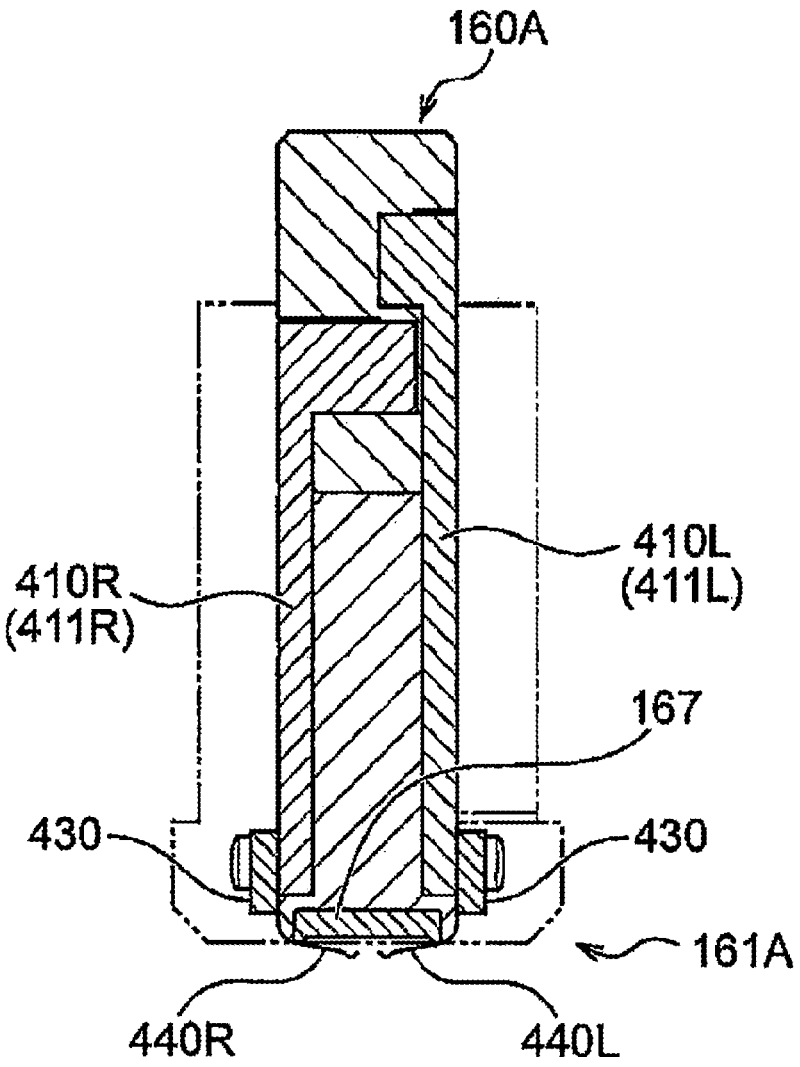
FIG. 25 is a cross-sectional view of the external connection portion.

FIG. 24 is an enlarged perspective view of the external connection portion with the external connection portion cover removed. FIG. 25 is a cross-sectional view of the external connection portion. One end of the right conductive path member 410R (the first path piece 411R) of the conductive path portion 410 is screwed together with a conductive plate 430 to an external connection contact 440R at the external connection portion 161A, whereby the right conductive path member 410R (the first path piece 411R) is electrically connected to the external connection contact 440R. The first path piece 411R can be removed from the external connection contact 440R by removing the screws. The external connection contact 440R is a leaf contact having a plurality of leaf portions (here, nine) in which proximal end sides of the leaf portions are collected integrally. One end of the left conductive path member 410L (the first path piece 411L) of the conductive path portion 410 is screwed together with a conductive plate 430 to an external connection contact 440L at the external connection portion 161A, whereby the left conductive path member 410L (the first path piece 411L) is electrically connected to the external connection contact 440L. The first path piece 411L can be removed from the external connection contact 440L by removing the screws. The external connection contact 440L is a leaf contact having a plurality of leaf portions (here, nine) in which proximal end sides of the leaf portions are collected integrally. When the substrate holder 11 is disposed in the plating tank, as illustrated in FIG. 25, in the external connection contact 440R and the external connection contact 440L, the leaf portions are brought into contact with a bus bar 167 and are electrically short-circuited via the bus bar 167. On the other hand, for an energization test, similar to FIG. 12D, the leaf portions of the external connection contact 440R and the external connection contact 440L are spaced apart from the bus bar 167. Due to this, by connecting contacts 230 of an energization confirmation device 169 to the external connection contact 440R and the external connection contact 440L so as to cause an electric current to flow through the external connection contact 440R, the right conductive path member 410R, the substrate contacts, the substrate W, the substrate contacts, the left conductive path member 440L, and the external connection contact 440L for execution of the energization test. This will be true with the conductive path portion 420.

Here, while the external connection contact 440R and the external connection contact 440L are described as being provided on the right conductive path member 410R and the left conductive path member 410L, respectively, in the case where the conductive path portion 410 is formed into one system, the external connection contacts may be formed into an integral member. The external connection portion 161B of the second holding member 110B is also configured similarly.

According to the embodiment described above, the substrate holder includes at least one substrate contact, at least one external contact, and the conductive path member configured to connect the substrate contact with the external contact together, and the conductive path member and/or the substrate contact are provided in such a manner as to be replaced. Consequently, in case corrosion or a deposition of metal occurs as a result of the conductive path member and/or the substrate contact being brought into contact with the plating liquid, the conductive path member and/or the substrate contact can be replaced. Due to this, the substrate holder can be used continuously by replacing the conductive path member and/or the substrate contact, the costs involved in maintenance and replacement of the substrate holder can be reduced. In particular, since the conductive path member is divided into the plurality of path pieces, only a portion needing replacement can be replaced. In addition, only part of the substrate contacts can be replaced. For example, when a leakage of treatment liquid occurs, by replacing only part of the substrate contacts and/or the path pieces such as the substrate contact and/or the path piece tending to be easily brought into contact with the treatment liquid (in the case of the substrate holder being kept in a vertical posture, a bottom portion side of the substrate holder) depending on the posture of the substrate holder in the treatment tank, compared with a case where the whole of the substrate holder, the whole of the conductive path member or the whole of the substrate contacts, the costs involved in replacement can be reduced.

A large cross-sectional area (corresponding to 10 to 20 cables in one example) can be ensured for each conductive path portion by collecting the wiring lines to the plurality of substrate contacts 117 into the conductive path portion, whereby a wiring resistance per unit length of each conductive path portion can be reduced. As a result, a difference in voltage drop in the path from the external connection portion to the individual first substrate contacts can be reduced. As a result, the plating current flowing through the individual first substrate contacts can be made uniform, whereby the plating thickness can be made uniform. In addition, since the wiring lines to the plurality of first substrate contacts are collected into each conductive path portion, the dimension of wiring to the plurality of first substrate contacts can be reduced, or the cable wiring can be omitted.

At least the following modes can be obtained from the embodiments that have been described heretofore.

One mode relates to a substrate holder for holding a substrate. This substrate holder has a first holding member having a first opening portion for exposing a first surface of the substrate, and a second holding member configured to hold the substrate together with the first holding member and having a second opening portion for exposing a second surface of the substrate. The first holding member has at least one first substrate contact configured to supply an electric current to the first surface of the substrate, at least one first external connection contact, and at least one first wiring configured to electrically connect the at least one first substrate contact with the at least one first external connection contact. The second holding member has at least one second substrate contact configured to supply an electric current to the second surface of the substrate, at least one second external connection contact, and at least one second wiring configured to electrically connect the at least one second substrate contact with the at least one second external connection contact. The at least one first external connection contact and the at least one second external connection contact are electrically independent. "Electrically independent" means that the at least one first external connection contact and the at least one second external connection contact are electrically isolated each other within the substrate holder.

According to the first mode, since the first and second external connection contacts, the first substrate contact and the second substrate contact, and the first wiring and the second wiring are provided independently on the first and second holding members, respectively, the electric current supply path for the first surface and the second surface of the substrate can be divided to the first and second holding members, respectively. As a result, the space for installing the electric current supply paths for the first surface and the second surface of the substrate can be ensured while restraining an increase in thickness of the substrate holder. In addition, since the electric current can be supplied independently to the first surface and the second surface of the substrate, the plating specification such as the plating thickness on each surface can be controlled independently.

In addition, the electric current can be supplied to the first surface of the substrate from at least one first external connection contact by way of at least one first wiring and at least one first substrate contact. The resistance value between at least one first substrate contact and at least one first external connection contact can be adjusted by adjusting the length of the first wiring. Similarly, the electric current can be supplied to the second surface of the substrate from at least one second external connection contact by way of at least one second wiring and at least one second substrate contact. The resistance value between at least one second substrate contact and at least one second external connection contact can be adjusted by adjusting the length of the second wiring.

In the embodiment, each of the first holding member and the second holding member is disposed, for example, along the outer circumference of the substrate and has the plurality of substrate contacts which are brought into contact with the substrate to supply the electric current to the substrate. The substrate contacts which are brought into contact with the substrate to supply the electric current to the substrate may be a single substrate contact formed by the substrate contacts being integrated into one unit along the outer circumference of the substrate.

According to a second mode, in the substrate holder of the first mode, the first holding member has a plurality of the first substrate contacts, a plurality of the first external connection contacts, and a plurality of the first wirings configured to electrically connect the plurality of the first substrate contacts with the plurality of the first external connection contacts.

One first substrate contact and one external connection contact may be caused to face each other in a one-to-one fashion and may be connected to each other by the single first wiring. In addition, two or more first wirings may be connected to one first external connection contact, and the other ends of the two or more first wirings may be connected to the different first substrate contacts. Additionally, a plurality of external connection contacts may be connected to a plurality of first wirings, and these first wirings may be connected to one substrate contact. In addition, two or more of these connection methods may be combined.

According to the second mode, the resistance value between at least one first substrate contact and at least one first external connection contact can be adjusted by adjusting the length of each first wiring. For example, the resistance value between at least one first substrate contact and at least one first external connection contact can be uniform by making the lengths of the first wirings identical. In addition, the energization can be confirmed prior to a plating operation by applying a potential difference between one part of the first wirings and the other part of the first wirings with the substrate held to the substrate holder.

According to a third mode, in the substrate holder of the second mode, the first holding member has a first arm portion, and the at least one first external connection contact is disposed on the first arm portion, the second holding member has a second arm portion, and the at least one second external connection contact is disposed on the second arm portion, and the at least one first external connection contact and the at least one second external connection contact are positioned at left and right ends of the substrate holder respectively.

According to the third mode, since the first surface and the second surface of the substrate can be fed from both the left and right ends of the arm portion when placing the substrate holder in the plating tank, compared with a case where the external contacts are collected to one end portion of the arm portion, an increase in thickness of the substrate holder can be prevented.

According to a fourth mode, in the substrate holder of the first mode, the first holding member has a first arm portion and has first and second positioning portions on both sides of the first arm portion respectively to position the substrate holder in a plating tank.

According to the fourth mode, since the positioning portions on both the sides of the arm portion are provided on the first holding member, even though there is a variation in an engaged state of the first holding member with the second holding member, the positional relationship between the positioning portions on both the sides are not affected in any way.

According to a fifth mode, in the substrate holder of the first mode, the first holding member has a first main body portion having the first opening portion, the second holding member has a second main body portion having the second opening portion, and the first main body portion and the second main body portion have positioning mechanisms configured to be brought into engagement with each other.

According to the fifth mode, since the positioning structures are provided between the first and second main body portions, the positioning accuracy with which the substrate is positioned relative to the first and second holding members is improved.

According to a sixth mode, in the substrate holder of the first mode, the first holding member has a first main body portion having the first opening portion and a first arm portion provided at one end side of the first main body portion, the second holding member has a second main body portion having the second opening portion and a second arm portion provided at one end side of the second main body portion, and with the first holding member and the second holding member staying in engagement with each other, the first arm portion and the second arm portion are aligned in a direction directed from the first and second main body portions towards the first and second arm portions.

According to the sixth mode, since the first arm portion and the second arm portion are aligned in the surface direction of the substrate holder, an increase in thickness of the arm portion can be restrained. As a result, a total thickness of a plurality of aligned substrate holders can be reduced.

According to a seventh mode, in the substrate holder of the first mode, the first holding member has a first main body portion having the first opening portion and the at least one first substrate contact, a first arm portion having at least the one first external connection contact, and a first wiring storage portion disposed between the first main body portion and the first arm portion and configured to store an extra length of the at least one first wiring.

According to the seventh mode, in adjusting the length of at least one first wiring to adjust the resistance value between at least one first substrate contact and at least one first external connection contact, there may occur a case where at least one first wiring has an extra length, and this extra length of the first wiring can be stored in the first wiring storage portion. In a case where a plurality of first substrate contacts are connected separately by a plurality of first wirings, in adjusting the length of each first wiring to adjust the resistance value between the plurality of first substrate contacts and at least one first external connection contact, although there may occur a case where an extra length of the first wiring is generated according to the position of the first substrate contact, the extra length of the first wiring can be stored in the first wiring storage portion. For example, the length of the first wiring is adjusted so that the resistance value between the plurality of first substrate contacts and at least one first external connection contact becomes uniform. In addition, the length of the first wiring may be changed so as to change the resistance value to adjust the quantity of electric current to a specific substrate contact.

According to an eighth mode, in the substrate holder of the seventh mode, the first wiring storage portion is formed integrally with a first attachment portion to attach the first wiring storage portion to the first arm portion.

According to the eighth mode, the first attachment portion for attaching the first wiring storage portion to the first arm portion does not have to be provided separately. This can reduce the number of components to be assembled and suppress the assemblage variation.

According to a ninth mode, in the substrate holder of the eighth mode, the first wiring storage portion has a first projecting portion projecting towards the first main body portion, and the first main body portion has two second projecting portions projecting on both sides of the first projecting portion of the first wiring storage portion.

According to the ninth mode, the first main body portion can be attached to the thick portion of the first wiring storage portion by avoiding the portion where the storage space to store the first wiring is disposed mainly within the first wiring storage portion, thereby making it possible to enhance the rigidity of the first holding member.

According to a tenth mode, in the substrate holder of the seventh mode, a wall of the first wiring storage portion overlaps an outer side of a wall of the first main body portion on a side constituting an outer surface side of the substrate holder at a coupling portion of the first wiring storage portion with the first main body portion.

According to the tenth mode, the wall of the first wiring storage portion is disposed further outwards than the first main body portion on the surface constituting the outer surface of the substrate holder, whereby the wall of the first wiring storage portion provides the umbrella structure, and therefore, the intrusion of plating liquid into the interior of the substrate holder due to the splashing of plating liquid or the like can be restrained or prevented. Thus, the intrusion of plating liquid into the interior of the substrate holder can be restrained or prevented, whereby disposing a seal on the wiring hole and the like in the substrate holder can be omitted.

According to an eleventh mode, in the substrate holder of the seventh mode, the first holding member is configured such that a coupling portion of the first wiring storage portion with the first main body portion is positioned above a plating liquid level when the substrate holder is disposed in a plating tank.

According to the eleventh mode, the intrusion of plating liquid into the interior of the substrate holder is restrained or prevented further, whereby disposing a seal on the wiring hole and the like in the substrate holder can be omitted.

According to a twelfth mode, in the substrate holder of the first mode, the first holding member has a first substrate contact configured to supply an electric current to the first surface of the substrate, the second holding member has a second substrate contact configured to supply an electric current to the second surface of the substrate, and a first contact fixing portion configured to fix the first substrate contact within the first holding member and a second contact fixing portion configured to fix the second substrate contact within the second holding member do not overlap each other with the first holding member and the second holding member kept in engagement with each other.

According to the twelfth mode, the interference between the first contact fixing portion and the second contact fixing portion is prevented, whereby an increase in thickness of the substrate holder can be restrained or prevented.

According to a thirteenth mode, in the substrate holder of the twelfth mode, the first holding member has a first seal holder provided on an outer side of the first opening portion, the second holding member has a second seal holder provided on an outer side of the second opening portion, the first and second substrate contacts are attached to the first and second seal holders by the first and second contact fixing portions, and a first seal holder fixing portion configured to fix the first seal holder within the first holding member and a second seal holder fixing portion configured to fix the second seal holder within the second holding member do not overlap each other with the first holding member and the second holding member kept in engagement with each other.

According to the thirteenth mode, an increase in thickness of the substrate holder can be restrained or prevented by preventing the interference of the first seal holder fixing portion with the second seal holder fixing portion.

According to a fourteenth mode, in the substrate holder of the first mode, the first holding member has a first seal provided on a circumference of the first opening portion, the second holding member has a second seal provided on a circumference of the second opening portion, and an outer seal is provided further on at least one of the first holding member and the second holding member further outwards or at a position outer than the first seal and the second seal.

According to the fourteenth mode, not only the substrate contact but also the first and second seal seals can be protected from the exterior of the substrate holder by providing the outer seal on at least one of the first holding member and the second holding member.

According to a fifteenth mode, in the substrate holder of the first mode, the first and second opening portions have a rectangular shape.

According to the fifteenth mode, the substrate holder for the rectangular substrate that tends to be enlarged in size can be provided.

According to a sixteenth mode, there is provided a plating system including: a substrate holder for holding a substrate; a substrate attaching/detaching portion configured to attach/detach the substrate to/from the substrate holder; a plating tank configured to apply a plating treatment to the substrate holder holding the substrate; and a transport machine configured to transport the substrate holder. The substrate holder of the plating system includes: a first holding member having a first opening portion for exposing a first surface of the substrate; and a second holding member configured to hold the substrate together with the first holding member and having a second opening portion for exposing a second surface of the substrate. The first holding member has at least one first substrate contact configured to supply an electric current to the first surface of the substrate, at least one first external connection contact, and at least one first wiring configured to electrically connect the at least one first substrate contact with the at least one first external connection contact. The second holding member has at least one second substrate contact configured to supply an electric current to the second surface of the substrate, at least one second external connection contact, and at least one second wiring configured to electrically connect the at least one second substrate contact with the at least one second external connection contact. The at least one first external connection contact and the at least one second external connection contact are electrically independent.

According to the sixteenth mode, since the first and second external connection contacts, the first substrate contact and the second substrate contact, and the first wiring and the second wiring are provided independently on the first and second holding members, respectively, the electric current supply path for the first surface and the second surface of the substrate can be divided to the first and second holding members, respectively. As a result, in the plating system, the space for installing the electric current supply paths for the first surface and the second surface of the substrate can be ensured while restraining an increase in thickness of the substrate holder. In addition, since the electric current can be supplied independently to the first surface and the second surface of the substrate, the plating specification such as the plating thickness on each surface can be controlled independently.

According to a seventeenth mode, there is provided a substrate holder for holding a substrate comprising: a first holding member having a first opening portion for exposing a first surface of the substrate; and a second holding member configured to hold the substrate together with the first holding member, wherein the first holding member has: a first external connection portion; at least one first substrate contact configured to be brought into contact with the first surface of the substrate to supply an electric current to the first surface of the substrate; and a first conductive path member configured to be brought into connection with the first external connection portion and the at least one first substrate contact, wherein the first substrate contact is attached to the first conductive path member in a removable manner, and wherein the first conductive path member is disposed within a space that is sealed up by the first holding member and the second holding member and is detachably attached to a main body of the first holding member.

According to this mode, when the substrate holder is disposed in the treatment tank, the first conductive path member is prevented from being brought into contact with the treatment liquid. In addition, since at least one first substrate contact is attached to the first conductive path member in such a manner as to be removed, at least one first substrate contact can easily be replaced. Due to this, by replacing part of the first substrate contacts, the substrate holder can be used continuously, the costs involved in maintenance and replacement of the substrate holder can be reduced. For example, when there occurs a leakage of treatment liquid, by replacing only part of the substrate contacts such as the substrate contact that tends to be easily brought into contact with treatment liquid (the bottom portion side of the substrate holder when the substrate holder is kept in a vertical posture) depending on the posture of the substrate holder within the treatment tank, compared with a case where the whole of the substrate holder or the whole of the first substrate contacts is replaced, the costs involved in replacement can be reduced.

In addition, the substrate holder includes the at least one substrate contact, the at least one external contact, and the conductor path member configured to connect them together, and the conductive path member is provided in such a manner as to be replaced. Thus, in the case where corrosion or metal deposition is generated as a result of the conductive path member being brought into contact with plating liquid, the conductive path member can be replaced. Due to this, the substrate holder can be used continuously by replacing the conductive path member, the costs involved in maintenance and replacement of the substrate holder can be reduced.

In addition, when the first conductive path member connected to the plurality of first substrate contacts is used, the wiring storage portion can be omitted, whereby a reduction in size and cost of the substrate holder can be realized. In addition, by collecting the wiring lines to the plurality of substrate contacts into the conductive path member, a large cross-sectional area can be ensured for the conductive path member, and the wiring resistance per unit length of the conductive path member can be reduced. This can reduce the difference in voltage drop in the path from the external connection portion to the individual first substrate contacts. As a result, the plating current flowing through the individual first substrate contacts can be made uniform, whereby the plating thickness can be made uniform. In addition, since the wiring lines to the plurality of first substrate contacts are collected into each conductive path member, the dimension of wiring to the plurality of first substrate contacts can be reduced, or the cable wiring can be omitted.

According to an eighteenth mode, in the substrate holder of the seventeenth mode, the first holding member has a plurality of first substrate contacts and has further a second conductive path member connected to the first external connection portion and at least one of the plurality of first substrate contacts and lying spaced apart from the first conductive path member.

According to this mode, energization can be confirmed prior to the plating process by forming the conductive path by dividing it into the first conductive path member and the second conductive path member and applying a potential difference to between the first conductive path member and the second conductive path member with the substrate held in the substrate holder. In addition, the difference in path length from the external connection portion to the individual first substrate contacts can be suppressed by dividing the first substrate contacts to the first and second conductive path members. For example, by dividing the plurality of first substrate contacts that lie on the symmetrical half portions of the first holding member to the first and second conductive path members, the path length differences from the external connection portion to the individual first substrate contacts can be made almost the same. In addition, a replacement for each conductive path member can be enabled.

According to a nineteenth mode, in the substrate holder of the eighteenth mode, at least one of the first conductive path member and the second conductive path member can be divided into a plurality of path pieces.

According to this mode, a replacement for each path piece can be enabled. For example, in the case where a leakage of treatment liquid occurs in the substrate holder, a portion exits which tends to be easily affected by the treatment liquid depending on the posture of the substrate holder within the treatment tank. In the case where the substrate holder is disposed in the plating tank with the substrate holder kept in an erected posture, when a leakage of treatment liquid occurs, the treatment liquid tends to be accumulated in the vicinity of a lowermost portion of the substrate holder. Due to this, in the case where the leakage of treatment liquid occurs, and the treatment liquid is brought into contact only with a path piece lying in the vicinity of the lowermost portion of the substrate holder, in place of replacing the whole of the conductive path members, only the path piece that is brought into contact with the treatment liquid can be replaced. Compared with a case where the whole of the substrate holder or the whole of the conductive path members are replaced, the costs involved in replacement can be reduced. In addition, the conductive path member is divided into path pieces, and these path pieces are assembled together thereafter, whereby the conductive path member can be fabricated at low costs.

According to a twentieth mode, in the substrate holder of the seventeenth mode, the first conductive path member has a plate-like shape or a rod-like shape.

The first conductive path member has the plate-like shape, whereby an increase in thickness of the substrate holder can be restrained. The first conductive path member has the rod-like shape, whereby the first conductive path member can easily be worked into a shape following the curved conductive path.

According to a twenty-first mode, in the substrate holder of any one of the seventeenth mode to the twentieth mode, the second holding member has: a second opening portion for exposing a second surface of the substrate; at least one second substrate contact configured to be brought into contact with the second surface of the substrate to supply an electric current to the second surface of the substrate; a second external connection portion; and a third conductive path member connected to the second external connection portion and the at least one second substrate contact, and the second substrate contact is attached to the third conductive path member in a removable manner.

According to this mode, the advantageous effects provided by the modes described above are provided for the holding members of the substrate holder for the double-surface plating process and.

According to a twenty-second mode, there is provided a plating system including: a substrate holder for holding a substrate; a substrate attaching/detaching portion configured to attach/detach the substrate to/from the substrate holder; and a plating tank configured to apply a plating treatment to the substrate holder holding the substrate. The substrate holder has: a first holding member having a first opening portion for exposing a first surface of the substrate; and a second holding member configured to hold the substrate together with the first holding member. The first holding member has: a first external connection portion; at least one first substrate contact configured to be brought into contact with the first surface of the substrate to supply an electric current to the first surface of the substrate; and a first conductive path member configured to be brought into connection with the first external connection portion and the at least one first substrate contact, the first substrate contact is attached to the first conductive path member in a removable manner, and the first conductive path member is disposed within a space that is sealed up by the first holding member and the second holding member and is detachably attached to a main body of the first holding member. According to this mode, an advantageous effect similar to that of the seventeenth mode is provided.

Thus, while the embodiments of the present invention have been described heretofore based on the several examples, the embodiments that have been described heretofore are intended to facilitate the understanding of the present invention and are not intended to limit the present invention. The present invention can be modified and improved without departing from the spirit thereof, and equivalents thereof are, of course, included in the present invention. For example, the shape of a large substrate is not limited to a rectangular shape, and hence, a square may be adopted, or other polygonal shapes than the rectangular and square shapes may be adopted, including, for example, a pentagonal shape or a hexagonal shape. Alternatively, the present invention can also be applied to a substrate detaching/attaching system for detaching and attaching a circular substrate from/to a substrate holder. In addition, constituent elements described in claims or the constituent elements described in the specification can be combined arbitrarily or omitted within a scope where at least part of the problems can be solved or within a scope where at least part of the advantageous effects can be provided.

This patent application is based upon and claims the benefit of priority of Japanese Patent Application No. 2017-126582 filed on Jun. 28, 2017 and Japanese Patent Application No. 2018-079388 filed on Apr. 17, 2018. All the disclosed contents including the specifications, claims, and abstracts of Japanese Patent Application No. 2017-126582 filed on Jun. 28, 2017 and Japanese Patent Application No. 2018-079388 filed on Apr. 17, 2018 are incorporated herein by reference in their entirety.

All the disclosed contents including the specifications, claims and abstracts of International Publication WO2014-076781 (PTL 1), Japanese Patent Application Laid-Open No. 2008-184692 (PTL 2), and U.S. Pat. No. 8,236,151 (PTL 3) are incorporated herein by reference in their entirety.

REFERENCE SIGNS LIST

10, 10*a*, 10*b*, 10*c* plating tank
11 substrate holder
110A first holding member
110B second holding member
111A first main body portion
111B second main body portion
1110A first main body
1110B second main body
112A first opening portion
112B second opening portion
113A, 113B attachment portion (projecting portion)
114A, 114B attachment portion
115A, 115B attachment portion
117A first substrate contact
117B second substrate contact
118A, 118B seal holder
119B seal holder
120A, 120B inner seal
121A outer seal
122A, 122B screw
123A, 123B screw
150 wiring storage portion
150A first wiring storage portion
150B second wiring storage portion
154A, 154B attachment portion
157A, 157B projecting portion
159A, 159B attachment portion
160 arm portion
160A first arm portion
160B second arm portion
163R, 163L positioning portion
168 external connection contact
170B substrate setting section
180, 180A, 180B attachment portion
181, 181A, 180B attachment portion
191A, 191B attachment portion
210A projecting portion
210B through hole
410, 420 conductive path portion
410L, 420L left conductive path member
410R, 420R right conductive path member
411L to 415L, 411R to 415R path piece
421L to 425L, 421R to 425R path piece
430 conductive plate
440L, 440R external connection contact
L wiring line
S plating liquid level
W substrate

The invention claimed is:

1. A holder for holding a substrate comprising:

a first holding member having a first opening portion for exposing a first surface of the substrate; and a second holding member configured to hold the substrate together with the first holding member, wherein the first holding member has:

a first external connection portion;

a plurality of first substrate contacts configured to be brought into contact with the first surface of the substrate to supply an electric current to the first surface of the substrate; and a first conductive path member having a plate-like shape or a rod-like shape forming a conductive path and configured to be brought into connection with the first external connection portion and the plurality of first substrate contact, wherein the first substrate contact is attached to the first conductive path member in a removable manner, and wherein the first conductive path member is disposed within a space that is sealed up by the first holding member and the second holding member and is detachably attached to a main body of the first holding member, and the first conductive path member comprises a plurality of pieces along the conductive path at least on a circumference of the first opening portion, each piece of the plurality of pieces being connected with one another by a fastening member mechanically and electrically in series, and at least one of the plurality of pieces is disposed in the vicinity of the lowermost portion of the substrate holder when the substrate holder is disposed in a plating tank with the substrate holder kept in an erected posture in the plating tank.

2. The holder according to claim 1, wherein the first holding member further comprises a plurality of second substrate contacts configured to be brought into contact with the first surface of the substrate to supply an electric current to the first surface of the substrate, and a second conductive path member forming a conductive path connected to the first external connection portion and at least one of the plurality of second substrate contacts and lying spaced apart from the first conductive path member.

3. The holder according to claim 2, wherein the second conductive path member comprising a plurality of pieces along the conductive path of the second conductive path member.

4. The holder according to claim 3, wherein pieces of the plurality of pieces of the first conductive path member disposed on the circumference of the first opening portion are located on one of a right half or a left half of the first opening portion, pieces of the plurality of pieces of the second conductive path member disposed on the circumference of the first opening portion are located at the other of the right half or the left half of the first opening portion, and the end of the first conductive path member and the end of the second conductive path member terminate at the central portion of a lower side of the first opening portion while the end of the first conductive path member and the end of the second conductive path member being spaced apart from one another.

5. A system for plating, comprising:

a holder for holding a substrate;

a substrate attaching/detaching portion configured to attach/detach the substrate to/from the holder; and a plating tank configured to apply a plating treatment to the holder holding the substrate, wherein the holder has:

a first holding member having a first opening portion for exposing a first surface of the substrate; and a second holding member configured to hold the substrate together with the first holding member, wherein the first holding member has:

a first external connection portion;

a plurality of first substrate contacts configured to be brought into contact with the first surface of the substrate to supply an electric current to the first surface of the substrate; and a first conductive path member having a plate-like shape or a rod-like shape and configured to be brought into connection with the first external connection portion and the plurality of first substrate contact, wherein the first substrate contact is attached to the first conductive path member in a removable manner, and wherein the first conductive path member is disposed within a space that is sealed up by the first holding member and the second holding member and is detachably attached to a main body of the first holding member, and the first conductive path member divided into a plurality of path pieces along a conductive path at least on a circumference of the first opening portion, each path piece of the plurality of path pieces being connected with one another by a fastening member mechanically and electrically in series, and at least one of the plurality of path pieces being disposed in the vicinity of the lowermost portion of the substrate holder when the substrate holder is disposed in a plating tank with the substrate holder kept in an erected posture in the plating tank.

* * * * *